US005898155A

United States Patent [19]

Imai et al.

[11] Patent Number: 5,898,155

[45] Date of Patent: Apr. 27, 1999

[54] AUTOMATED TELLER MACHINE INCLUDING MEDIUM ISSUING APPARATUS FOR ISSUING SUPPLEMENTARY INFORMATION

[75] Inventors: Masayuki Imai; Takehiro Imahayashi; Makoto Kurihara; Mitsushige Nakao; Takeshi Kashiwada, all of Kawasaki, Japan

[73] Assignee: Fujitsu Limited, Kawasaki, Japan

[21] Appl. No.: 08/564,435

[22] Filed: Nov. 29, 1995

[30] Foreign Application Priority Data

Nov. 29, 1994 [JP] Japan ..... 6-295404

[51] Int. Cl.[6] ..... G86F 15/30

[52] U.S. Cl. ..... 235/379; 902/36

[58] Field of Search ..... 235/380, 379, 235/383, 384, 462; 902/17, 36, 22, 18, 14, 8

[56] References Cited

U.S. PATENT DOCUMENTS

| | | | |
|---|---|---|---|
| 4,011,811 | 3/1977 | Kodis | 101/93.07 |
| 4,321,672 | 3/1982 | Braun et al. | 235/379 X |
| 5,110,043 | 5/1992 | Ashby | 229/304 |
| 5,268,561 | 12/1993 | Kimura et al. | 235/384 |
| 5,422,468 | 6/1995 | Abecassis | 235/380 |
| 5,483,047 | 1/1996 | Ramachandran et al. | 235/379 |

FOREIGN PATENT DOCUMENTS 0 183 234 4/1986 European Pat. Off. .

*Primary Examiner*—Anita Pellman Gross
*Assistant Examiner*—Karl Frech
*Attorney, Agent, or Firm*—Staas & Halsey

[57] ABSTRACT

An automated teller machine which issues media such as receipts is provided, this machine having as an object the provision of functions which satisfy a customer's desire for service, while saving space and improving installation efficiency. The automated teller machine has a holding section which holds each of a plurality of paper rolls, a plurality of paper roll drive motors which feed out and returns the paper from each of the paper rolls, a common printing unit which performs printing onto each of the paper fed out by the plurality of paper roll drive motors, a common cutter which cuts the paper from each of the paper rolls to a prescribed length, a common transport belt which transports cut pieces of paper, and a common ejection opening which ejects the thus transported cut pieces of paper.

21 Claims, 35 Drawing Sheets

AUTOMATED TELLER MACHINE INCLUDING MEDIUM ISSUING APPARATUS FOR ISSUING SUPPLEMENTARY INFORMATION

BACKGROUND OF THE INVENTION

1. Field of the Invention

The present invention relates to an automated teller machine including a medium issuing apparatus which issues receipts and the like, and more particularly it relates to an automated teller machine which is placed in a financial institution or the like, and which executes transactions such as deposits and withdrawals and the like by the insertion of a card or the like by the customer.

2. Description of the Related Art

In an automated teller machine, a receipt is issued onto which is printed the particulars of the transaction performed by the customer, and it is desirable, as part of the service provided to the customer, to be able to output and to show the customer such information as a record of transactions performed by the customer in the past and supplementary information such as financial institution service information or the like.

In prior art automated teller machines, the technology used to show supplementary information to a customer was the display of such supplementary information, during or after the transaction, on a display of the apparatus.

However, using the above-noted technology, since it was only possible to show the supplementary information, it was not possible for a customer to take the supplementary information home, preventing detailed examination of the supplementary information.

To solve this problem, technology providing an issuing section separate from the receipt issuing section has been proposed, this separate issuing section issuing a record of the past transactions of the customer and promotional information of the financial institution or the like.

However, with the technology which provides a new issuing section to the automated teller machine for supplementary information, there is a need to provide a supplementary information issuing section in addition to the existing receipt issuing section, leading to a physically large machine, thereby bringing about the problems of the inability to install the machine in the existing installation space, and causing a deterioration in installation effectiveness.

In addition, because this type of supplementary information issuing section is separate from the receipt issuing section, versatility is lost, since from the paper stored in the supplementary information issuing section it is only possible to issue supplementary information.

Furthermore, in recent years, there has been a demand for automated teller machines to issue such payment instruments as checks, traveler's checks, and the like. However, the supplementary information issuing section of prior art automated teller machines cannot issue such payment instruments in response to the customer demand.

SUMMARY OF THE INVENTION

An object of the present invention is to provide an automated teller machine including a medium issuing unit which not only meets the demands of the customers, but also one which is both space-saving and efficient.

According to one aspect of the present invention, there is provided a medium issuing apparatus operated by an operator for issuing a first medium and a second medium on which a first information and a second information are printed respectively, comprising: a medium holding means which holds a plurality of media respectively; a medium drive means which performs feedout or return drive of the plurality of media; a common printing means which performs printing onto the medium which is fed out by the medium drive means from each of the medium holding means; a common cutting means which cuts medium fed out from each of the medium holding means to a prescribed length; a common transport means which transports pieces of medium cut from each of media by the common cutting means; a control means for controlling each of the means mutually; and a common ejection opening which ejects the cut pieces of medium which are transported by the common transport means.

The control means may drive the common printing means to print the first information onto the first medium based on the transportation of the first medium to the printing means, and drive the common printing means to print the second information onto the second medium based on the transportation of the second medium to the printing means.

The control means may drive the common cutting means to cut one of the medium on which one of the information is printed by the common printing means, and drive the cut piece of medium to be ejected from a common ejection opening via the common transport means, after which the control means may drive the medium drive means to return the end of the medium to the side of the medium holding means via the common printing means, and further the control means may drive the drive means to feedout another medium, drive the common printing means to print another information, drive the common cutting means to cut another means, and after which the control means may drive the common transport means to eject another piece of medium to a common ejection opening.

The control means may drive the common cutting means to cut one of the medium on which one of the information is printed by the common printing means, drive the common cutting means to cut another medium on which another information is printed by the common printing means before the common transport means ejects one of the medium from the common ejection opening, and the control means may drive the transport means to transport one and another pieces of the medium to the common ejection opening to be ejected together.

A paper roll can be used for the medium.

According to another aspect of the present invention, there is provided an automated teller machine including a medium issuing apparatus for issuing a first and a second medium on which transaction information and supplementary information are printed respectively, which is operated by a customer and performs transactions such as deposits, withdrawals, and the like, comprising: a plurality of medium holding means each of which holds a medium; a plurality of medium drive means each of which performs feedout or return drive of a medium; a common printing means which performs printing onto the medium which is fed out by the medium drive means from each of the medium holding means; a common cutting means which cuts medium fed out from each of the medium holding means to a prescribed length; a common transport means which transports pieces of medium cut from each of media by the common cutting means; a particulars of transaction data generating means which generates data related to the particulars of a transaction executed in response to a customer operation; a supplementary information data generating means which generates supplementary information other than the particulars of a transaction; an instructing means which issues an instruction to the common printing means to print; a control means, whereby when the instruction means instructs the printing of the particulars of a transaction, the medium is fed out by the medium drive means, the common printing means is caused to print the data of the particulars of transaction of the particulars of transaction data generating means, and whereby, when the printing of supplementary information is specified by the instructing means, the medium drive means feeds out a medium, and the common printing means is caused to print the data from the supplementary information data generating means; and a common ejection opening which ejects the cut pieces of medium which are transported by the common transport means.

The medium may have a plurality of formats.

The automated teller machine may further comprise: a display section which asks the customer to select a desired transaction from several types of transactions such as deposit, withdrawal, issuing of supplementary information, and the like; and a customer operating section from which the customer selects a desired transaction.

The automated teller machine may further comprise: a display section which asks the customer, either during execution of a transaction or after the execution of a transaction, whether issuing of supplementary information is required; and a customer operating section from which the customer selects whether or not the issuing of supplementary information is required.

The control means may drive the common cutting means to cut the medium on which one of the information is printed by the common printing means, drive the common cutting means to cut the medium on which another information is printed by the common printing means before the common transport means ejects one of the medium from the common ejection opening, and the control means may drive the transport means to transport cut one on the another piece of medium to the common ejection opening to be ejected together.

The direction of printing of the particulars of a transaction printed by the common printing means may differ from the direction of printing of the supplementary information.

The supplementary information may be a payment instrument such as a check or the like, and a paper roll can be used for the medium.

The control means may drive the common printing means to print the first information onto the first medium based on the transportation of the first medium to the printing means, and drive the common printing means to print the second information onto the second medium based on the transportation of the second medium to the printing means.

The control means may drive the common cutting means to cut the medium on which one of the information is printed by the common printing means, and drive the cut piece of medium to be ejected from a common ejection opening via the common transport means, after which the control means may drive the medium drive means to return the end of the medium to the side of the medium holding means via the common printing means, and further the control means may drive the drive means to feedout another piece of medium, drive the common printing means to print another information, drive the common cutting means to cut another medium, and after which the control means may drive the common transport means to eject another piece of medium to a common ejection opening.

The common printing means may be caused to print the particulars of a transaction performed by the customer onto paper from one paper roll and, further, the common printing means may be caused to print supplementary information other than the particulars of a transaction onto paper from another paper roll.

The control means may drive the display section to display information on its screen which asks the customer whether the issuing of supplementary information is required during or after the execution of a transaction selected by a customer, may drive the common printing means to print the particulars of a transaction onto one of the paper roll, may drive the common cutting means to cut the printed part of one of the paper rolls, and, in the case in which the customer has not selected issuing of supplementary information from the customer operating section, the control means may drive the transport means to transport the cut printed piece of paper so as to eject it from the common ejection opening and, in the case in which the customer has selected issuing of supplementary information from the customer operating section, the control means may drive the paper roll drive means to feed out paper from another paper roll to the common printing means to print supplementary information thereon before the transport means ejects the one of piece of paper from the common ejection opening, may drive the common cutting means to cut paper from another paper roll on which supplementary information is printed, and the control means may drive the transport means to transport cut one or another piece of medium to the common ejection opening to be ejected together.

The paper roll holding means may hold paper rolls having the same width.

In this way, the present invention has the following merits:

(1) By using a single printing means, cutting means, transport means and ejection opening, it is possible to implement a space-saving medium issuing unit having a function of issuing two pieces of medium on which different information can be printed.

(2) It is possible to prevent the customer from forgetting to receive the media by eliminating the need for the customer to reach toward the ejection opening a number of times.

(3) It is possible to issue a medium with different information such as the particulars of a transaction and supplementary information printed on it, using one printing means, one transport means, and one ejection opening, without having the automated teller machine become large.

(4) The customer can specify the issuing of supplementary information, and can receive both the particulars of a transaction and the supplementary information from a common ejection opening after making a deposit or withdrawal, thereby eliminating the need to bother with an independent operation to issue the supplementary information, or the need to extend a hand to separate ejection openings.

(5) It is possible to issue not only a record of past transactions of the customer and promotional information, but also payment instruments in an automated teller machine, thereby enabling the provision of an automated teller machine which meets the desires of a greater number of customers, without having the automated teller machine become large.

(6) It is possible for the customer to select the issuing of supplementary information, and it is further possible to eject this from the same ejection opening as from which the receipt is ejected, eliminating the need to think about a separate ejection opening for supplementary information.

(7) It is possible to specify the issuing of supplementary information as well, and to eject the supplementary information and the receipt simultaneously from the common ejection opening when performing a transaction such as a deposit or a withdrawal, so that after completing one transaction there is no need to make a separate selection of issuing of supplementary information, and also preventing the customer from taking only the receipt and forgetting to take the supplementary information.

(8) It is possible to issue paper having differing widths even when using paper rolls of the same width.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Before describing the preferred embodiments, an explanation will be given of the conventional automated teller machine shown in FIG. 1.

Figure 1:
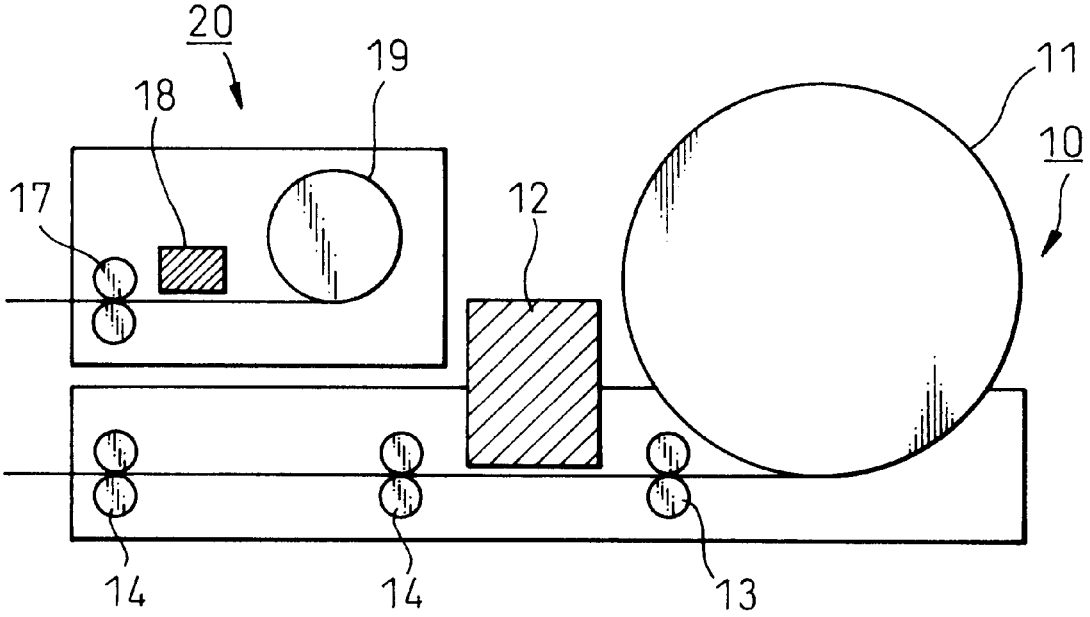
FIG. 1 is a block diagram which shows the configuration of a conventional automated teller machine equipped with a supplementary information issuing machine.

FIG. 1 shows a structure of a conventional automated teller machine 10 equipped with a supplementary information issuing machine 20. The automated teller machine 10 has a paper roll 11 for receipt, a paper feedout roller 12, a printer unit 13 including a paper cutter, and receipt feedout rollers 14. The supplementary information issuing machine also has a paper roll 34 for supplementary information, a paper feedout roller 17, and a printer unit 18. Usually the supplementary information issuing machine 20 is mounted on the automated teller machine 10.

However, the conventional automated teller machine 10 equipped with the supplementary information issuing machine 20 becomes to be a physically large machine, thereby bringing about the problems of the inability to install the machine in the existing installation space, and causing a deterioration in installation effectiveness.

In addition, because a supplementary information ejection opening of the supplementary information issuing machine is separate from the receipt ejection opening of the automated teller machine, it is a nuisance for the customer to reach toward the different ejection opening a number of times, and sometimes the customer may forget to receive one of the pieces of paper.

The present invention can prevent the customer from forgetting to receive a plurality of pieces of paper by eliminating the need to bother with an independent operation to issue the supplementary information, as well as the need to extend a hand to separate ejection openings.

Embodiments of the present invention will be described below.

(1) Outer view of the automated teller machine

Figure 2:
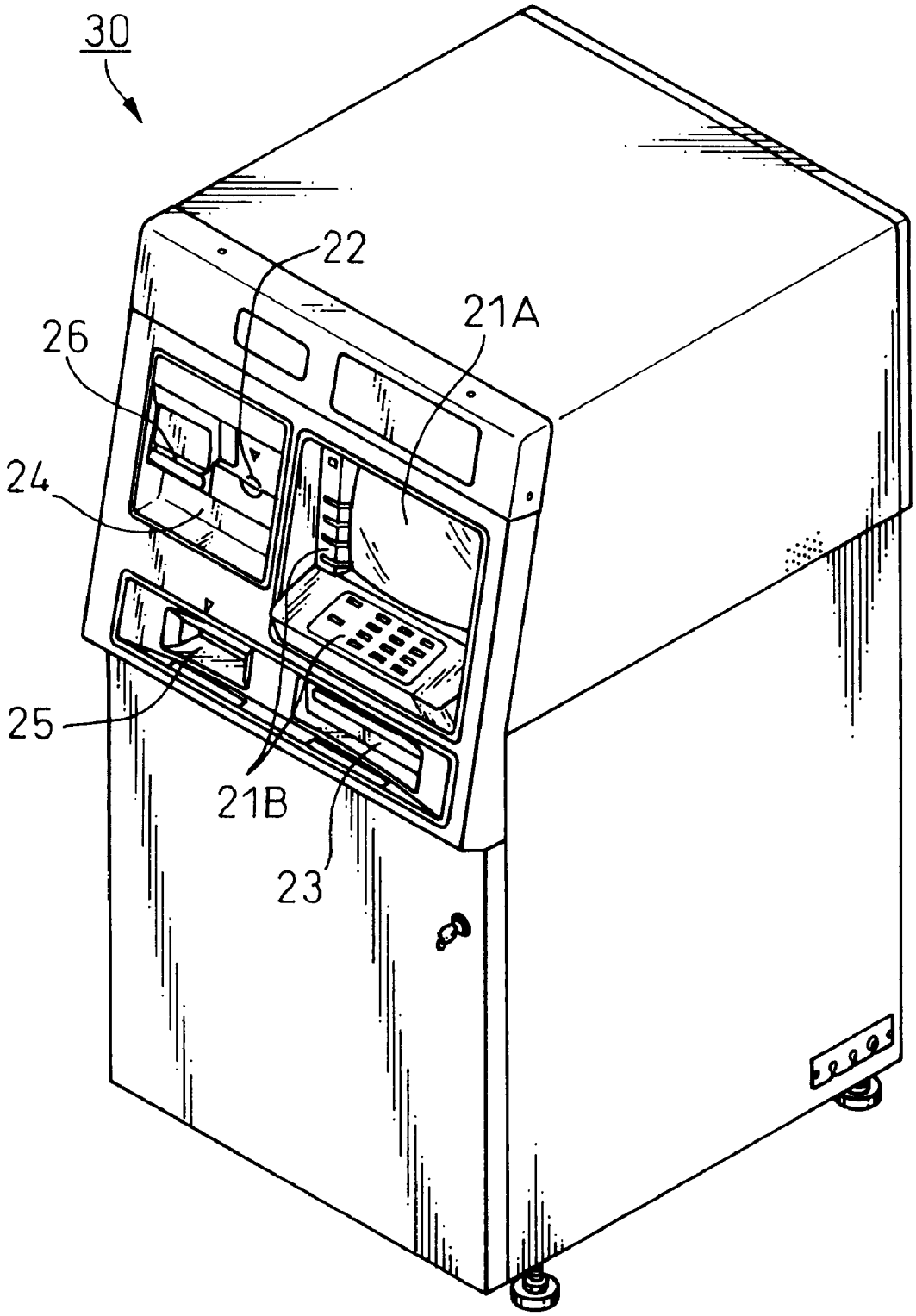
FIG. 2 is a outer view of an automated teller machine according to an embodiment of the present invention.

FIG. 2 shows an outer view of an automated teller machine 30 containing the technology of the present invention.

In this drawing, the reference numeral 21A denotes a display screen, which presents information related to the operation of the machine to the customer. The reference numeral 21B denotes a keyboard, at which data is entered by the customer, based on operational prompts displayed on the display screen 21A, so that transactions are performed. The reference numeral 22 denotes a card insertion/ejection opening at which, when a customer is performing a transaction, the card is inserted to make a transaction and then ejected when the transaction is completed. The reference numeral 23 denotes a cash payout opening, which pays out cash when making a withdrawal transaction.

The reference numeral 24 denotes an envelope receiving opening, into which is placed an envelope for an envelope deposit. When a customer wishes to make an envelope deposit, he or she removes an envelope from this envelope receiving opening, places cash into the envelope, and performs an envelope deposit. The reference numeral 25 denotes a cashing insertion opening, at which the above-noted cash in the envelope is inserted. The reference numeral 26 denotes a receipt ejection opening, from which a receipt onto which is noted the particulars of a transaction performed by the customer are noted.

(2) Configuration of the automated teller machine

Figure 3:
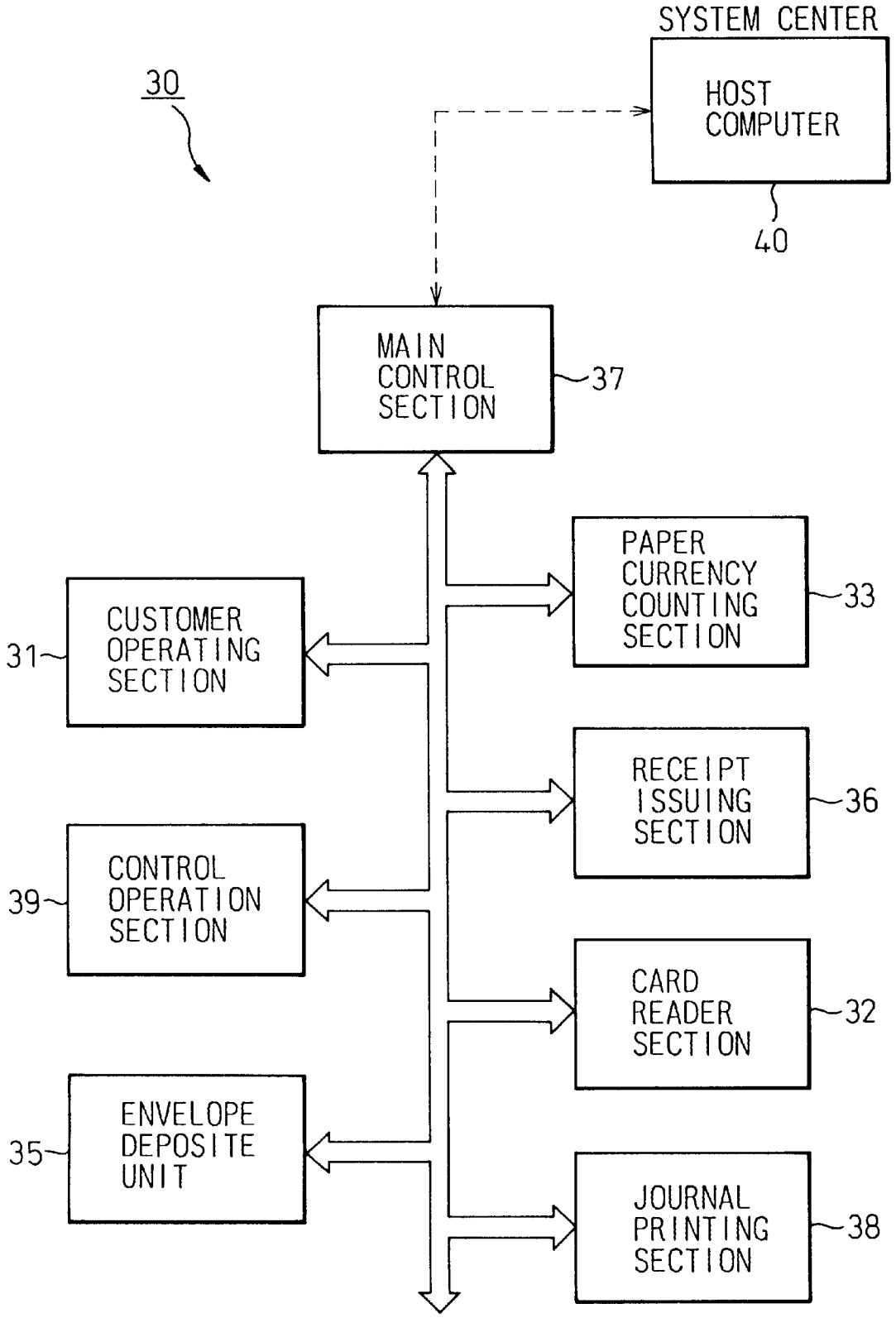
FIG. 3 is a block diagram which shows the configuration of an automated teller machine according to an embodiment of the present invention.

FIG. 3 is a block diagram which shows the basic configuration of an automated teller machine 30 according to the present invention.

In FIG. 3, the reference numeral 31 denotes the customer operating section, which displays operational prompts to the customer and enables the customer to perform operations based on these prompts. The display screen 21A and keyboard 21B shown in FIG. 2 are included in this customer operating section 31.

The reference numeral 32 denotes a card reader section, which reads the information stored on a card which is inserted by the customer. The card insertion/ejection opening 22 shown in FIG. 2 is included in this card reader section 32.

The reference numeral 33 denotes a paper currency counting section, which holds paper currency for the purpose of withdrawals and which releases paper currency when a withdrawal transaction is performed. The cash payout opening 23 shown in FIG. 2 is included in this paper currency counting section 33.

The reference numeral 35 denotes an envelope deposit unit, which holds paper money which has been placed in an envelope for making an envelope deposit, and which prints onto this envelope customer information which is read by the card reader section 32. The cash insertion opening 25 in FIG. 2 is included in this envelope deposit unit 35.

The reference numeral 36 denotes a receipt issuing section, which issues a receipt onto which is printed the particulars of a transaction performed by the automated teller machine. The receipt ejection opening 26 in FIG. 2 is included in this receipt issuing section 36. The receipt issuing section 36, in addition to issuing a receipt, also has a function which issues a medium onto which is printed supplementary information, as will be described later.

The reference numeral 37 denotes a main control section, which controls the automated teller machine 30 and communicates with the system center of the bank having a host computer 40.

The reference numeral 38 is a journal printing section, which prints and stores the particulars of transactions performed by the automated teller machine 30, and 39 is a control operating section, which in addition to displaying the status of the automated teller machine 30, also enables bank or servicing personnel to perform control operations. This control operation section 39 is usually provided at the rear of the automated teller machine, but can also be provided as part of the customer operating section 31.

(3) Basic operation of the automated teller machine

The basic operation of the automated teller machine 30 will next be described, with reference being made to FIGS. 2 and 3.

(3-1) Withdrawal transactions

First, the customer inserts a card, selects the withdrawal transaction from a transaction selection screen using the keyboard 21B, and inputs a personal identification number. The main control section 37 communicates with a host computer 40 in the system center to check the proper identity of the customer, without displaying the personal identification number.

When the proper identify of the customer has been verified, the main control section 37 displays a screen onto the display screen 21A which asks about the amount of the withdrawal, in response to which the customer inputs the amount to be withdrawn, using the keyboard 21B.

Next, the main control section 37 sends the amount of the withdrawal input from the keyboard 21B and the customer information read by the card reader section 32 to the center computer to verify the withdrawal.

If is possible to pay out the amount, the main control section 37 feeds out paper currency in the specified amount, from the paper currency, counting section 33, this being ejected from the cash payout opening 23.

When this is done, the main control section 37 causes the particulars of the transaction performed to be printed by the receipt issuing section 36, this being ejected from the receipt ejection opening 26.

When the customer information is sent to the host computer 40, at the point at which the verification is made that the cash can be paid out, the account of the customer within the center computer is updated to amount after the transaction.

(3-2) Envelope deposit transactions

First, the customer inserts a card, selects the envelope deposit transaction from a transaction selection screen using the keyboard 21B, and inputs a personal identification number. The main control section 37 communicates with a host computer 40 to check the proper identity of the customer, without displaying the personal identification number. After verifying the proper identity of the customer, the cash insertion opening 25 is opened.

The customer takes an envelope from the envelope receiving opening 24, places into the envelope the amount, in paper currency, to be deposited, and places the envelope in the cash insertion opening. The main control section 37 closes the cash insertion opening, and displays on the display screen 21A a screen which asks what amount is to be deposited.

When the customer inputs the amount to be deposited from the keyboard 21B, the main control section 37 sends this amount to be deposited and the customer information read by the card reader section 32 to the host computer 40 to verify the specified deposit, prints the customer information read by the card reader section 32 onto the envelope, and holds the envelope.

When this is done, the main control section 37 causes the receipt issuing section 36 to print the particulars of the transaction performed, this being ejected from the receipt ejection opening 26 as the receipt.

When the customer information is sent to the host computer 40, at the point at which the judgment is made that the deposit is possible, the account of the customer in the center computer is not updated. This is because in an envelope deposit it is not possible to verify whether the amount of money in the envelope coincides with the amount of money specified to be deposited. After the work is completed, a bank employee or other person first makes a verification of this, after which the customer account is updated.

In making an envelope deposit, the contents placed into the envelope are not limited to cash, and can also include checks and the like.

In an automated teller machine 30, in addition to the above-described withdrawal and deposit transactions, it is possible to perform money transfer transactions. In this embodiment of the present invention, in addition to receipts, the receipt issuing section 36 prints supplementary information.

(4) Receipt issuing section 36

Figure 4:
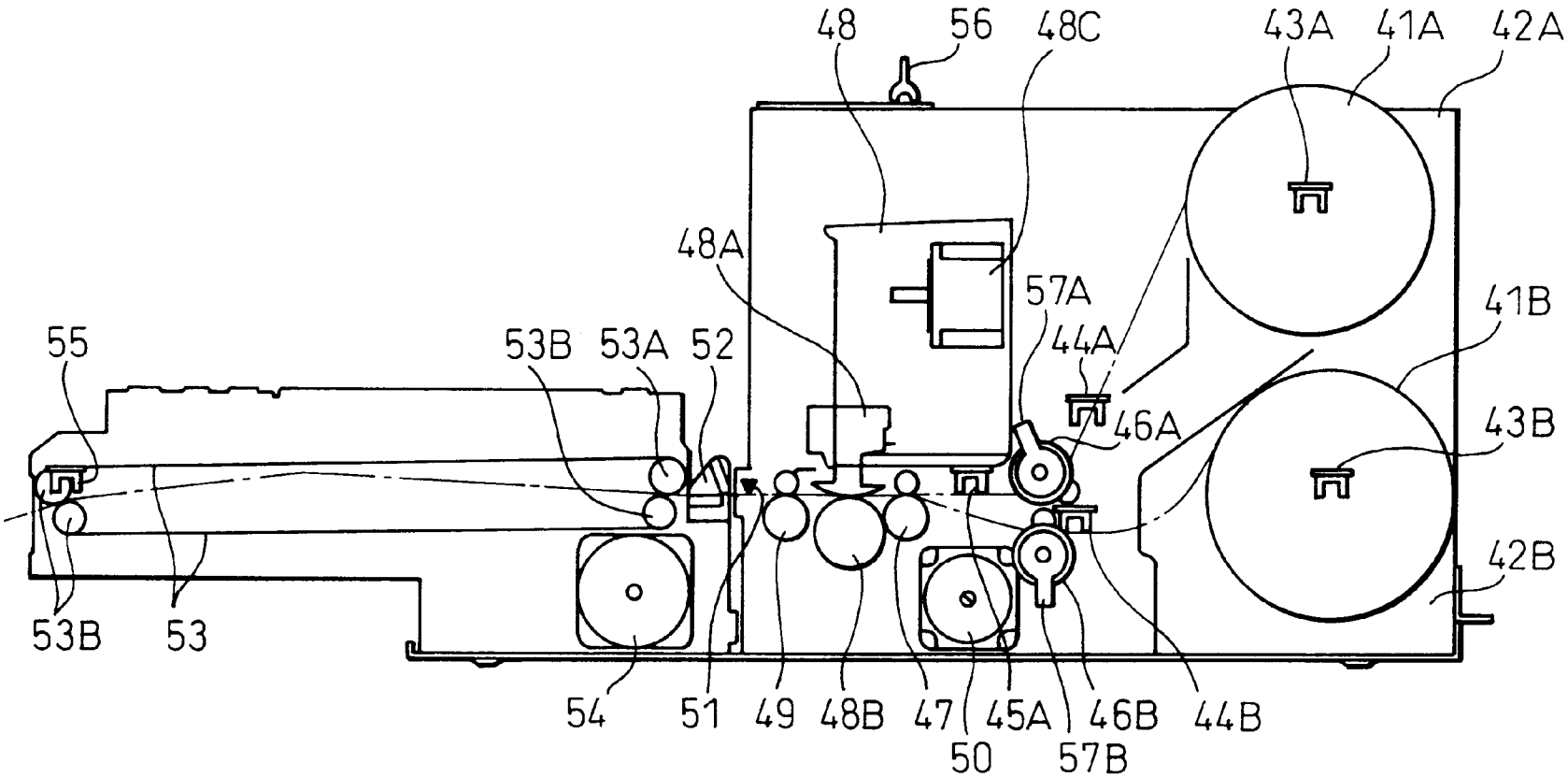
FIG. 4 is a drawing which illustrates the general configuration of the receipt issuing unit of an automated teller machine according to an embodiment of the present invention.

FIG. 4 shows the configuration of the receipt issuing section 36.

In FIG. 4, the reference numeral 41A denotes a receipt paper roll, which is used to create receipts, and 41B is a supplementary information paper roll, which is used to create a medium onto which is printed supplementary information. The reference numerals 42A and 42B denote paper roll holding sections, which hold the paper rolls. The paper roll holding section 42A holds the receipt paper roll 41A, and the paper roll holding section 42B holds the supplementary information paper roll 41B.

The reference numerals 43A and 43B denote paper roll near end detection sensors, which detect when the paper roll is near the end by detecting the diameter of the paper roll. The paper roll near end detection sensor 43A detects the near-end condition for the receipt paper roll 41A, and the paper roll near end detection sensor 43B detects the near-end condition of the supplementary information paper roll 41B.

The reference numerals 44A and 44B are paper roll end detection sensors, which detect the end of the paper rolls. The paper roll end detection sensor 44A detect the end of the receipt paper roll 41A, and the paper roll end detection sensor 44B detect the end of the supplementary information paper roll 41B.

The reference numeral 45A denotes a paper end detection sensor, which by detecting the end of the paper from the receipt paper roll 41A, thereby provides a reference for establishing the position of the end of the receipt paper roll 41A.

In this embodiment of the present invention, the paper end detection sensor 45A is provided only with respect to the receipt paper roll 41A, the establishment of the reference position for the supplementary information paper roll 41B being an additional function of the cutting reference sensor 51, to be described later.

By doing this, it is not necessary to provide paper end sensors for each of the paper rolls, thereby reducing both the cost and the installation space required by the sensors.

The reference numerals 46A and 46B denote paper feedout rollers, which feed out paper from the paper rolls. The paper feedout roller 46A feeds paper out from the receipt paper roll 41A, and the paper feedout roller 46B feeds paper out from the supplementary information paper roll 41B. The reference numeral 47 denotes a merging roller, which is provided at the location at which the end of the paper fed out from the receipt paper roll 41A and the end of the paper fed out from the supplementary information paper roll 41B merge, and guides these ends to a printer unit 48, which is described below.

The reference numeral 48 denotes a printer unit, which prints onto the fed-out paper, this printer unit having a printing head 48A which performs printing, a platen 48B which pushes up against the printing head 48A, and a spacing motor 48C which moves the printing head 48A in a direction which is perpendicular to the direction of paper feedout.

The reference numeral 49 denotes a feedout roller, which feeds the end of the paper onto which the printing head 48A has printed to a cutter 52 to be described later. The reference numeral 50 denotes a first stepping motor, which imparts drive force to the paper feedout rollers 46A and 46B, the merging roller 47, and the feedout roller 49.

The reference numeral 51 denotes a reflection sensor, which detects a black mark which is applied to the paper which is fed out, thereby detecting the cutting position of the cutter 52, which is described below. The reflection sensor 51 also serves to determine the end position of the paper from the supplementary information paper roll.

The reference numeral 52 denotes a cutter, which performs cutting of the paper from the receipt paper roll 41A and the paper from the supplementary information paper roll 41B. The reference numeral 53 denotes a transport belt, by which a piece of paper cut by the cutter 52 is held and transported by an upper and a lower belt. The transport belt 53 has an appropriate tension imparted to it by a drive pulley 53A and a driven pulley 53B, the upper and lower belts rotating so as to transport the piece of cut paper in response to the drive of the drive pulley 53A.

The reference numeral 54 denotes a second stepping motor, which imparts drive force to the drive pulley 53A and which also drives the cutter 52. The reference numeral 55 is a pull-out detection sensor, which detects the transport of a piece of paper up to the ejection opening and the removal of the piece of paper therefrom.

The reference numerals 57A and 57B denote electromagnetic clutches, which switch the drive force of the first stepping motor 50 with respect to the rollers 46A and 46B. That is, the electromagnetic clutch 57A engages (on condition) and disengages (off condition) the drive force from the first pulse motor 50 to the paper roll feedout roller 46A, and the electromagnetic clutch 57B engages (on condition) and disengages (off condition) the drive force from the first pulse motor 50 to the paper roll feedout roller 46B.

These electromagnetic clutches 57A and 57B are switched on and off to switch the drive force, thereby enabling a reduction in the number of motors, which both reduces cost and saves space. On the side of the cabinet of the receipt issuing section 36 there is mounted a printing board (not shown in the drawing), this printing board serving to perform overall control of the receipt issuing section 36 as a unit control section with both a memory function and an MPU.

(4-1) First stepping motor drive transmission

Figure 5:
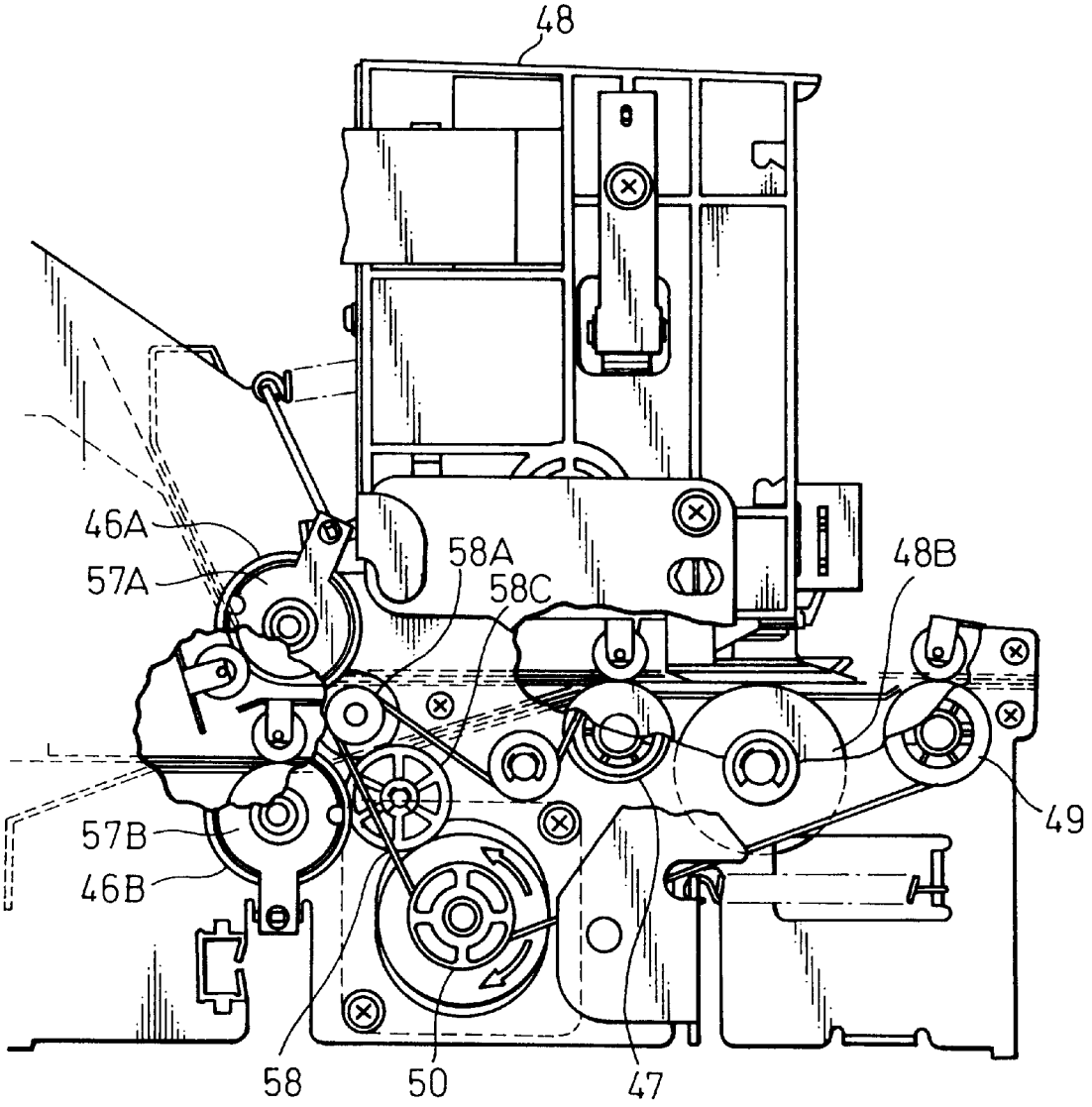
FIG. 5 is a drawing which shows a first stepping motor drive transmission, as viewed from the opposite side as in FIG. 4.

FIG. 5 is a drawing which shows the drive transmission of the first stepping motor 50, which is as seen from the opposite direction to FIG. 4.

Elements in FIG. 5 which correspond to elements shown in FIG. 4 have been assigned the same reference numerals and are not explicitly described herein. The reference numeral 58A is a drive gear, which, by rotating in a meshed condition with the paper roll feedout rollers 46A and 46B, causes the paper roll feedout rollers 46A and 46B to rotate. The reference numeral 58B is a transmission belt which is installed around the first stepping motor 50, the drive gear 58A, the merging roller 47, and the feedout roller 49. By means of this transmission belt 58, the drive from the first stepping motor 50 is transmitted to the drive gear 58A, the merging roller 47, and the feedout roller 49.

The reference numeral 58C denotes an idler gear, which is disposed between and meshes with the first stepping motor 50 and the drive gear 58A for the purpose of adjusting the rotational speed of the drive gear 58A.

When the electromagnetic clutch 57A, which is provided on the paper roll feedout roller 46A for the receipt paper roll 41A is turned on so as to engage drive from the first stepping motor 50, the drive gear 58A is turned by the transmission belt 58B, and the action of the electromagnetic clutch 57A causes the rotation of the drive gear 58A to be transmitted to the paper roll feedout roller 46A, so that this paper roll feedout roller 46A rotates.

When the electromagnetic clutch 57B, which is provided on the paper roll feedout roller 46B for the supplementary information paper roll 41B is turned on so as to engage drive from the first stepping motor 50, the drive gear 58A is turned by the transmission belt 58, and the action of the electromagnetic clutch 57B causes the rotation of the drive gear 58A to be transmitted to the paper roll feedout roller 46B, so that the paper roll feedout roller 46B rotates.

In this manner, in this embodiment of the present invention, by switching the electromagnetic clutches 57A and 57B, the driven paper roll feedout rollers 46A and 46B are switched, so that just one of the paper rolls is fed out.

(4-2) Second stepping motor drive transmission

Figure 6A:
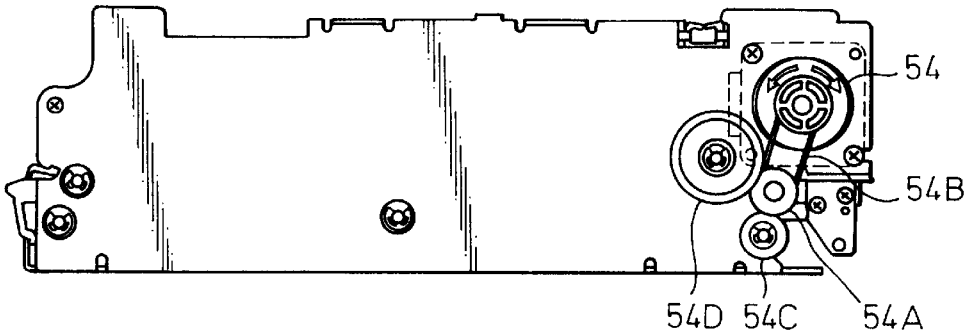
FIG. 6A is a drawing which shows a side view of the second stepping motor drive transmission as viewed from the same direction as in FIG. 4.
Figure 6B:
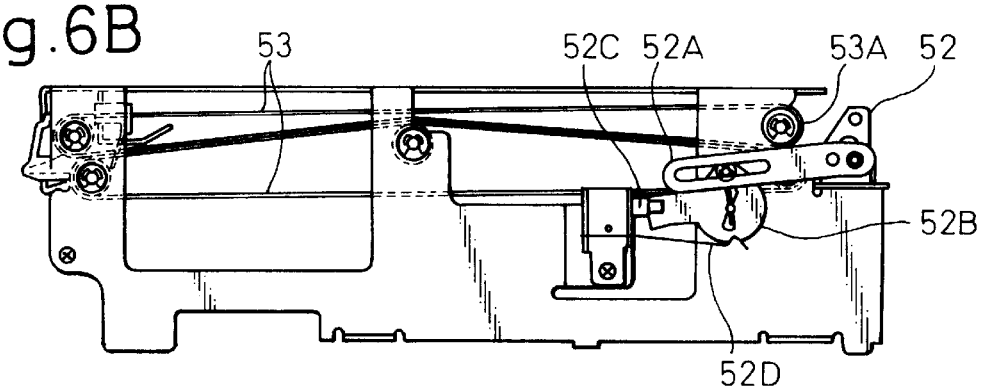
FIG. 6B is a drawing which shows the cutter mechanisms as viewed from the reverse direction as the same in FIG. 6A.

FIG. 6A shows a drive transmission of the second stepping motor 54 and FIG. 6B shows a mechanism of the cutter 52. FIG. 6A is a drawing as seen from the same plane as FIG. 4 and FIG. 6B is a drawing as seen from the reverse direction of FIG. 4. Elements in FIGS. 6A and 6B which correspond to elements shown in FIG. 4 have been assigned the same reference numerals and are not explicitly described herein.

The reference numeral 52A denotes a lever which is pivotally supported about the same axis as the moving blade inside the cutter 52, which will be described later. When this lever 52A swings, the moving blade also swings so as to perform a cutting operation. The reference numeral 52B denotes a cam, which is provided so as to swing freely about a center axis and also so as to slide freely in an elongated hole provided in the lever 52A.

The reference numeral 52C denotes a cam sensor which detects the passage of a protrusion which is provided on the outer periphery of the cam 52C, so as to detect the position (home position) of the cam 52C. The reference numeral 52D denotes a leaf spring, which mates with a cutout part provided in the outer periphery of the cam 52B, thereby serving as a stopper for the cam 52B.

The reference numeral 54A denotes a transmission gear: A belt 54B is wound around this transmission gear 54A and the second stepping motor 54. The rotation of the second stepping motor 54 is transmitted by the belt 54B so as to cause this transmission gear 54A to rotate. The reference numeral 54C denotes a unidirectional transport clutch, which is installed on the same shaft as the drive pulley 53A, and which meshes with the transmission gear 54A, so that the drive from the second stepping motor 54 is transmitted to the drive pulley 53A so as to rotate it only when the transmission gear 54 is rotating in the direction of paper transport.

The reference numeral 54D denotes a unidirectional clutch which is installed onto the same shaft as the cam 52C and which is meshed with the transmission gear 54A, so that the drive from the second stepping motor 54 is transmitted to the cam 52C to cause it to rotate only when the transmission gear 54 is rotating in the paper returning direction.

Therefore, when the second stepping motor 54 is providing drive in the paper transport direction, the drive pulley 53A only is rotated, without causing the cam 52C to swing, and when the second stepping motor 54 is providing drive in the paper returning direction, the cam 52C only is caused to swing, without causing the drive pulley 53A to rotate.

By virtue of the above-noted configuration, it is possible to reduce the number of motors, thereby providing both a reduction in cost and a saving of space.

(4-3) Cutting Operation of the Cutter

FIGS. 7A through 7H are drawings which show the cutting operation of the cutter 52. Elements in FIGS. 7A through 7H which correspond to elements which are shown in FIG. 6 are assigned the same reference numerals and will not be explicitly described herein. The cutting action of the cutter 52 will be described, with reference being made to FIGS. 7A through 7H.

The cutter 52 includes a moving blade 52E, which swings, and a fixed blade 52F. The moving blade 52E is pivotally supported at the same pivot support 52G as the lever 52A, and the moving blade 52E swings in concert with a swinging of the lever 52A. An elongated hole 52H is provided in the lever 52A, the cam 52B and the lever 52A being linked via this elongated hole 52H.

Additionally, the cam 52B can swing freely about the shaft 52I, this shaft 52I having mounted to it a unidirectional clutch 54D for the cam. A pin 52J is provided on the shaft 52I, the cam 52B being caused to rotate by this pin making contact with an inner hole 52K of the cam 52B. In addition, a protruding part 52L is provided on the outer periphery of the cam 52B, the cam sensor 52C detecting this protruding part 52L so as to detect the swing angle of the cam 52B.

In the same manner, a cutout part 52M is provided in the outer periphery of the cam 52B, this cutout part 52M mating with the leaf spring 52D. A moving blade guide 52N is provided on the cutter 52, this moving blade guide 52N restricting the range of swing of the moving blade 52E.

In the normal condition (shown in FIGS. 7A and 7B), the leaf spring 52D is mated with the cutout part 52M, the cam 52B is positioned by the leaf spring 52D, so that the lever 52A linked to the cam 52B, and the moving blade 52E which is linked to the lever 52A, does not swing. When the second stepping motor 54 drives the paper in the returning direction, the shaft 52I is driven via the unidirectional cam clutch 54D, the pin 52J which is mounted to the shaft 52I makes contact with the inner hole 52K of the cam 52B, and cam 52B starts to swing against the force of the leaf spring 52D.

Figure 7A:
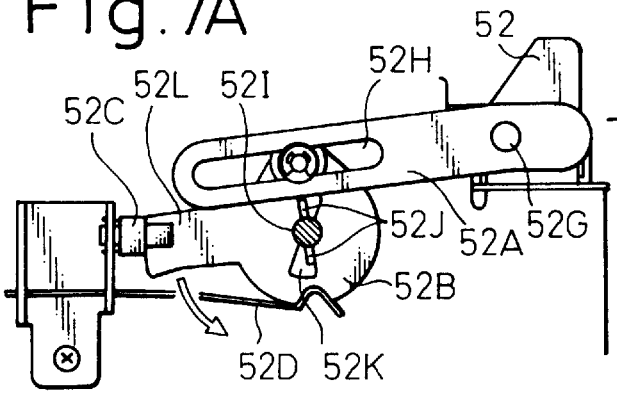
FIGS. 7A through 7H are drawings which show the cutting operation of the cutter.
Figure 7B:
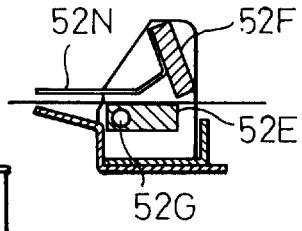
Figure 7C:
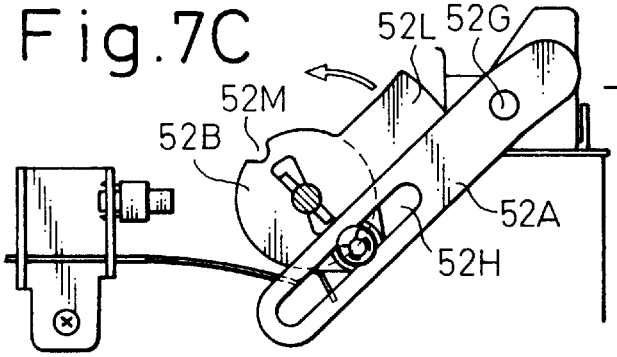
Figure 7D:
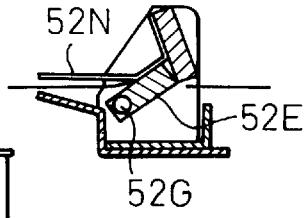
Figure 7E:
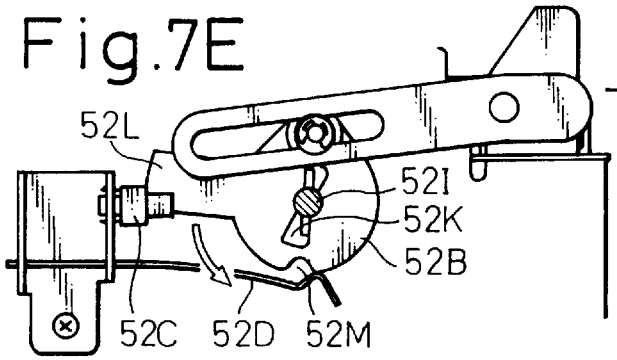
Figure 7F:
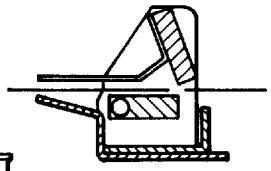
Figure 7G:
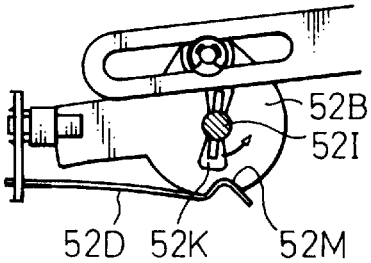
Figure 7H:
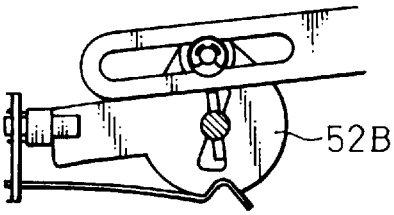

When the cam 52B rotates, the lever 52A which is linked to the cam 52B also rotates, as does the moving blade 52E which is pivotally supported at the pivot support 52G of the lever 52A, this condition being shown in FIGS. 7C and 7D.

When the second stepping motor 54 rotates further, the moving blade 52E strikes up against the moving blade guide 52N, and the moving blade 52E and lever 52A swing no further. However, the cam 52B continues to swing by sliding within the elongated hole 52H, and the lever 52A and moving blade 52E begin to return to the original position.

In response to the protruding part 52L of the cam 52B passing the cam sensor 52C (shown in FIGS. 7E and 7F), the rotation of the second stepping motor 54 in the paper returning direction stops, and the leaf spring 52D once again mates with the cutout part 52M of the cam 52B. When this happens, the rotating speed of the cam 52B becomes faster than the rotating speed of the shaft 52I. This rotational speed of the cam 52B is absorbed by the play in the inner hole 52K of the cam 52B, this condition being shown in FIG. 7G, and the cam 52B settles into the original position, this condition shown in FIG. 7H.

(4-4) The Area Surrounding the Paper Roll Holding Sections

Figure 8:
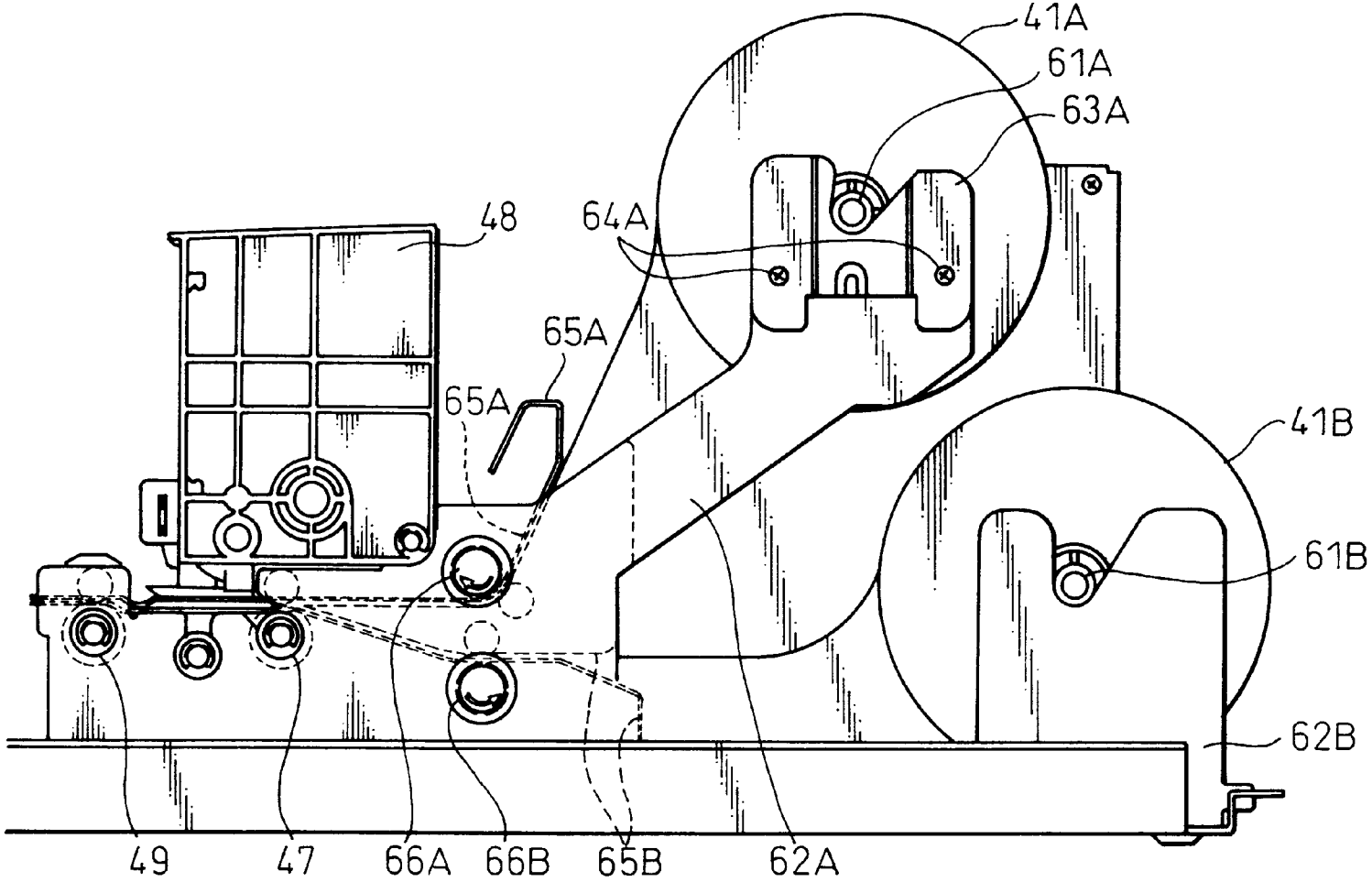
FIG. 8 is a drawing of the local area around the paper roll holding section.

FIG. 8 is a drawing which shows the local area around paper roll holding sections. Elements which are the same as those shown in FIG. 4 are assigned the same reference numerals and are not explicitly described herein.

The reference numerals 61A and 61B denote the cores of the paper rolls, which are inserted into the empty center part of the paper rolls. The core 61A is inserted into receipt paper roll 41A, and the core 61B is inserted into the supplementary information paper roll 41B.

The reference numerals 62A and 62B denote holding frames, which hold the paper rolls. The holding frame 62A holds the receipt paper roll 41A, and the holding frame 62B holds the supplementary information paper roll 41B.

The reference numeral 63A denotes a height adjuster, which is provided on the end part of the holding frame which holds the receipt paper roll 41A. The reference numeral 63B denotes a setscrew, which is used to fix the position of the height adjuster 63A.

The cores 61A and 61B are longer than the widths of the paper rolls, and when they are inserted in the paper rolls, both ends of the cores protrude from the paper rolls. Cutouts are provided on the height adjuster 63A and the holding frame 62B for the supplementary information paper roll, the paper roll being held by these cutouts mating together with the parts of the cores which protrude from the paper rolls.

By adjusting the position of the height adjuster 63A, it is possible to install paper rolls of different diameters.

Figure 9:
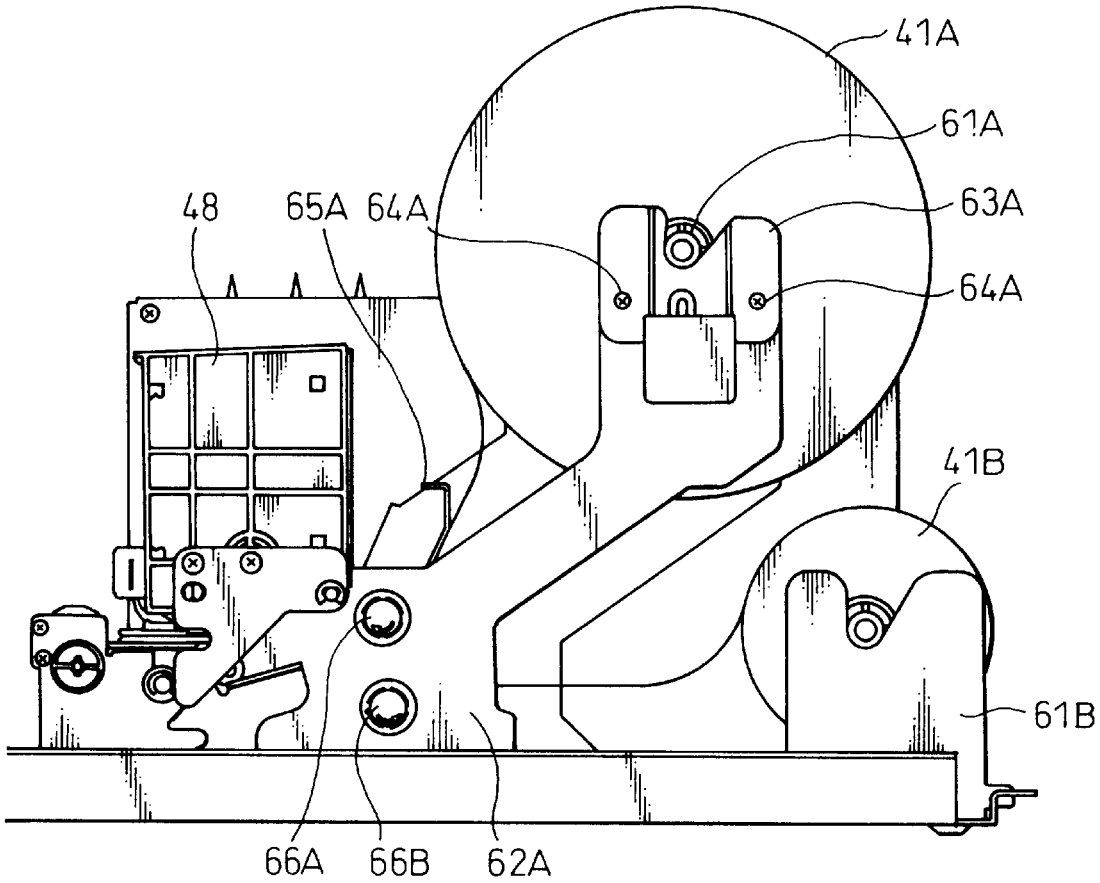
FIG. 9 is a drawing of the local area around the paper roll holding section in the case in which the height adjuster is moved upward to hold a paper roll, for receipts, which has a diameter larger than usual.

FIG. 9 shows a local view of the condition when the height adjuster 63A is moved.

When the height adjuster 63A is moved upward from its usual position and fixed in that position, it is possible to hold a paper roll having a diameter greater than the usual diameter.

In this embodiment of the present invention, the above-noted type of height adjuster 63A is provided for only the receipt paper roll 41A. This is in consideration of the fact that a receipt is always issued for transactions such as deposits and withdrawals, making the frequency of use significantly grater than for the supplementary information paper roll 41B.

The intraframe distance of the holding frame 62A for the receipt paper roll 41A is the same as the intraframe distance of the holding frame 62B for the supplementary information paper roll 41B, so that these hold paper rolls having the same width.

By having both holding frames hold paper of the same width, in the case in which the customers of a financial institution or the like do not require the issuing of supplementary information, one paper roll can serve as a spare for the other paper roll when the other paper roll runs out.

When the above-noted operation is expected, the program of the main control section of the automated teller machine is previously changed for controlling the space paper roll to feed the paper when the present paper roll runs out.

The reference numerals 65A and 65B denote guides, which guide the end of paper from a roll to the paper feedout rollers 46A and 46B. The guide 65A guides the end of the paper from the receipt paper roll 41A to the paper feedout roller 46A, and the guide 65B guides the end of the paper from the supplementary information paper roll 41B to the paper feedout roller 46B. The guides 65A and 65B, as shown by the dotted lines in FIG. 5, are provided at the upper surface and lower surface of the paper to be fed out to the printer unit 48, and form the transport path for the paper from the paper roll.

The reference numerals 66A and 66B denote knobs which are mounted on the same shafts as the paper feedout rollers 46A and 46B, and which, when turned, cause the paper feedout rollers 46A and 46B to rotate, so that the ends of the paper from the paper rolls are grabbed by the paper feedout rollers 46A and 46B, respectively.

(4-5) Operation when installing paper rolls

Figure 10A:
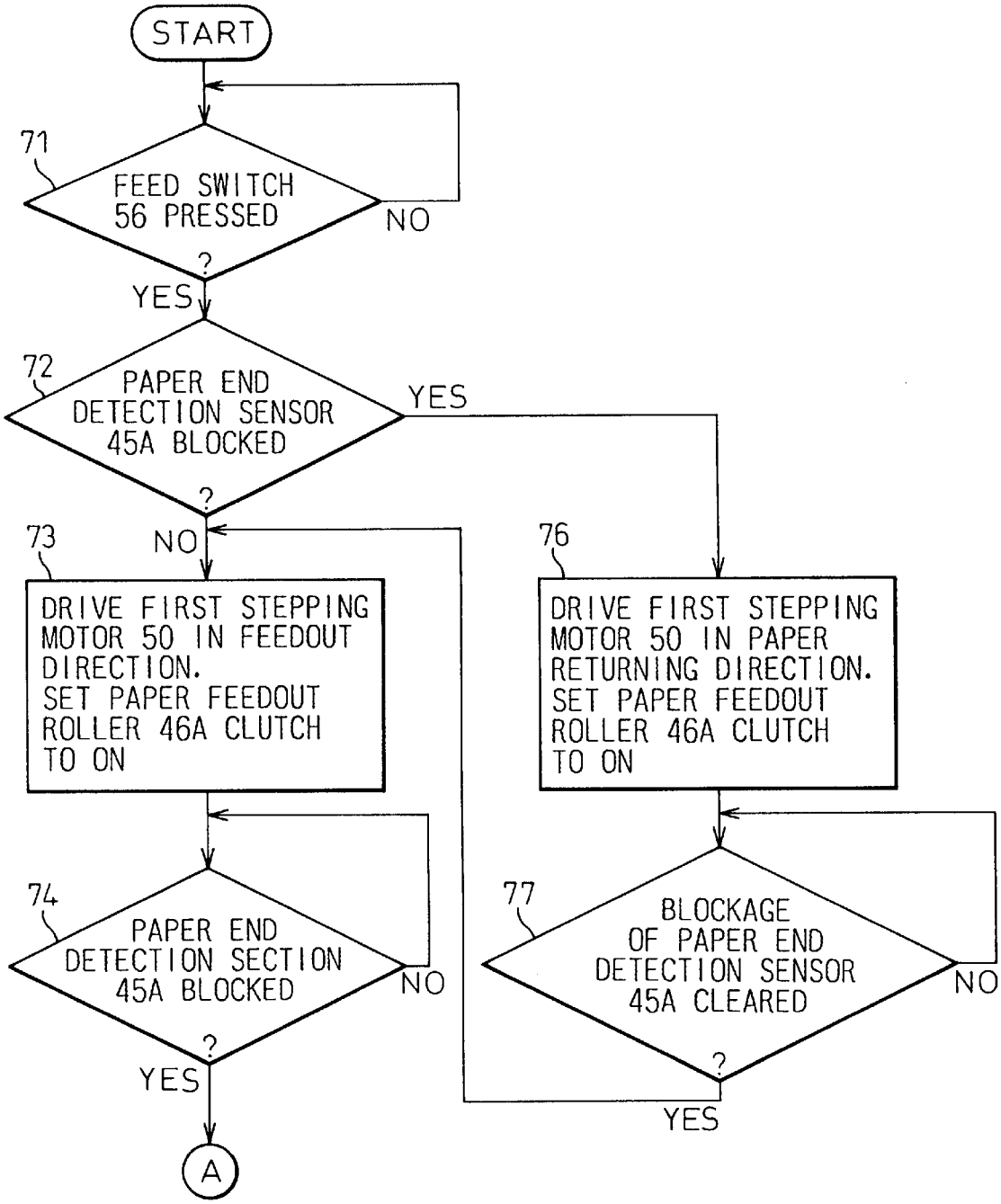
FIGS. 10A through 10E are flowcharts which show the operation of the unit control section when installing a paper roll.
Figure 10B:
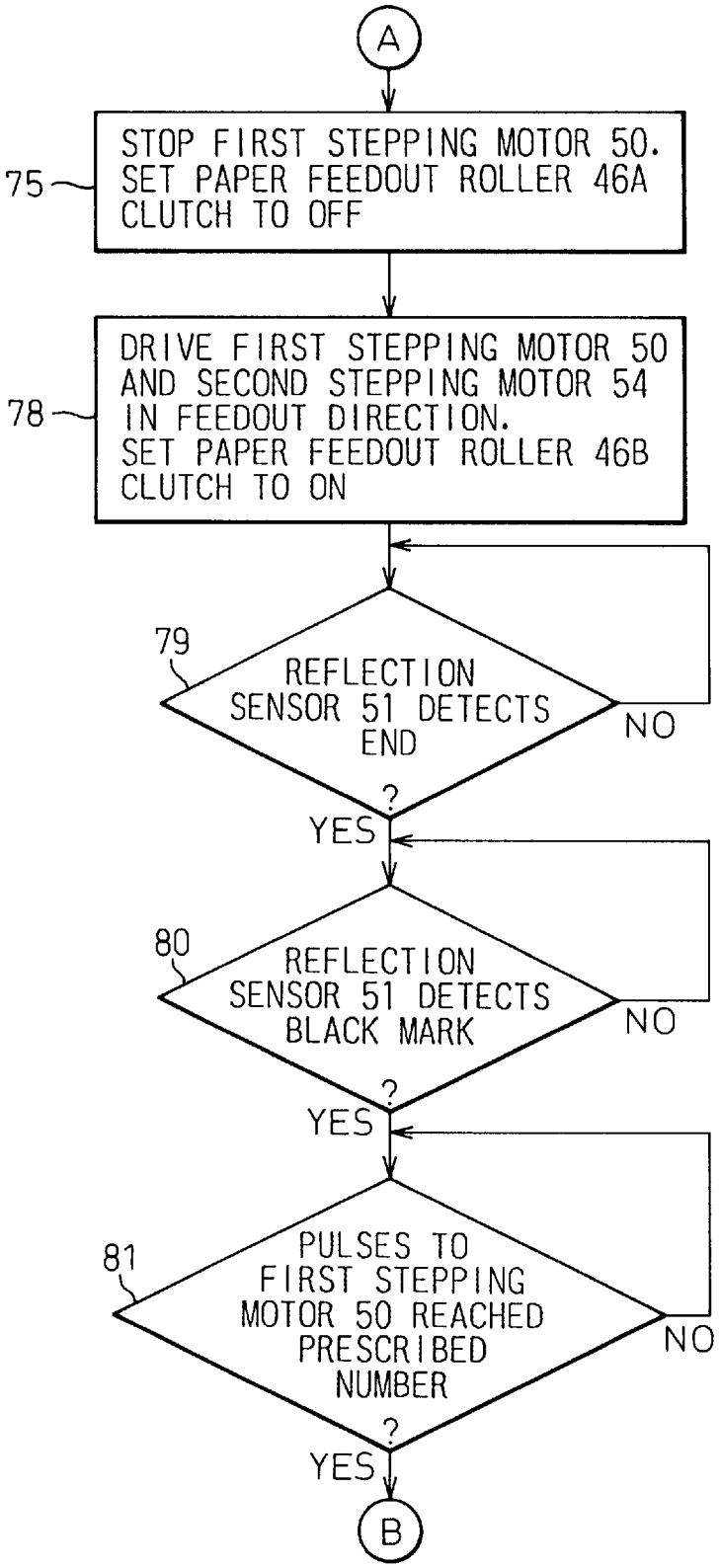
Figure 10C:
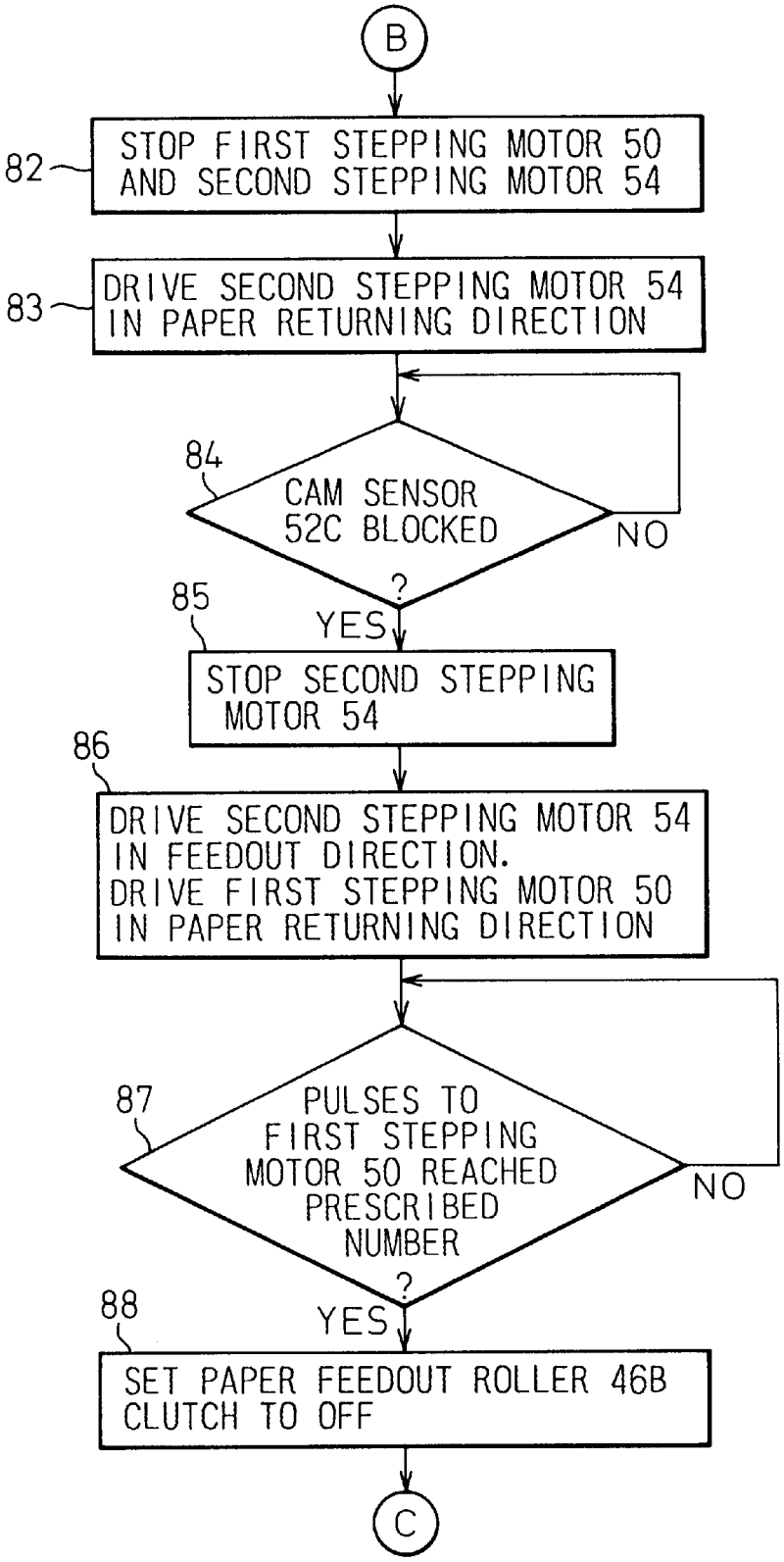
Figure 10D:
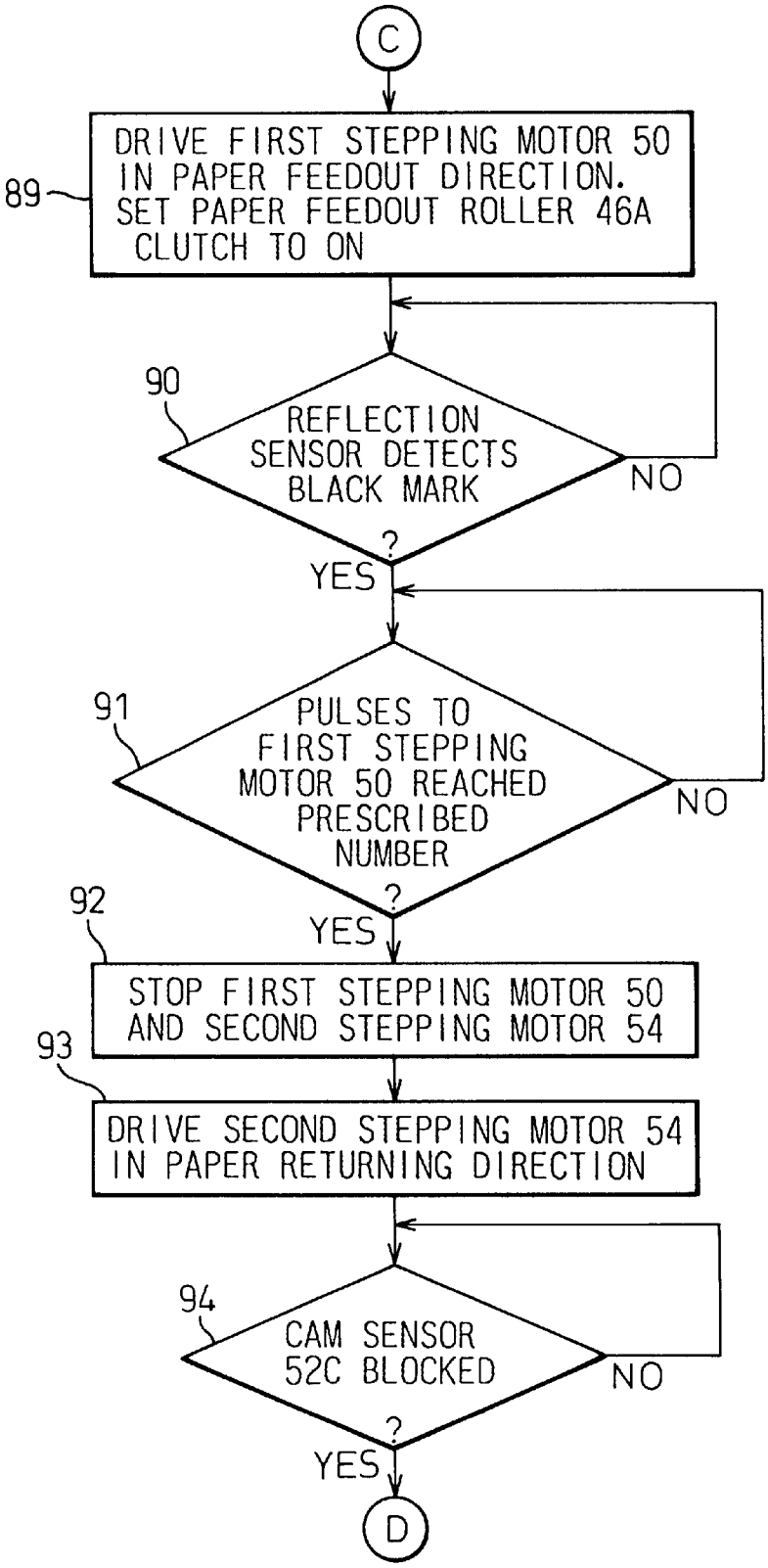
Figure 10E:
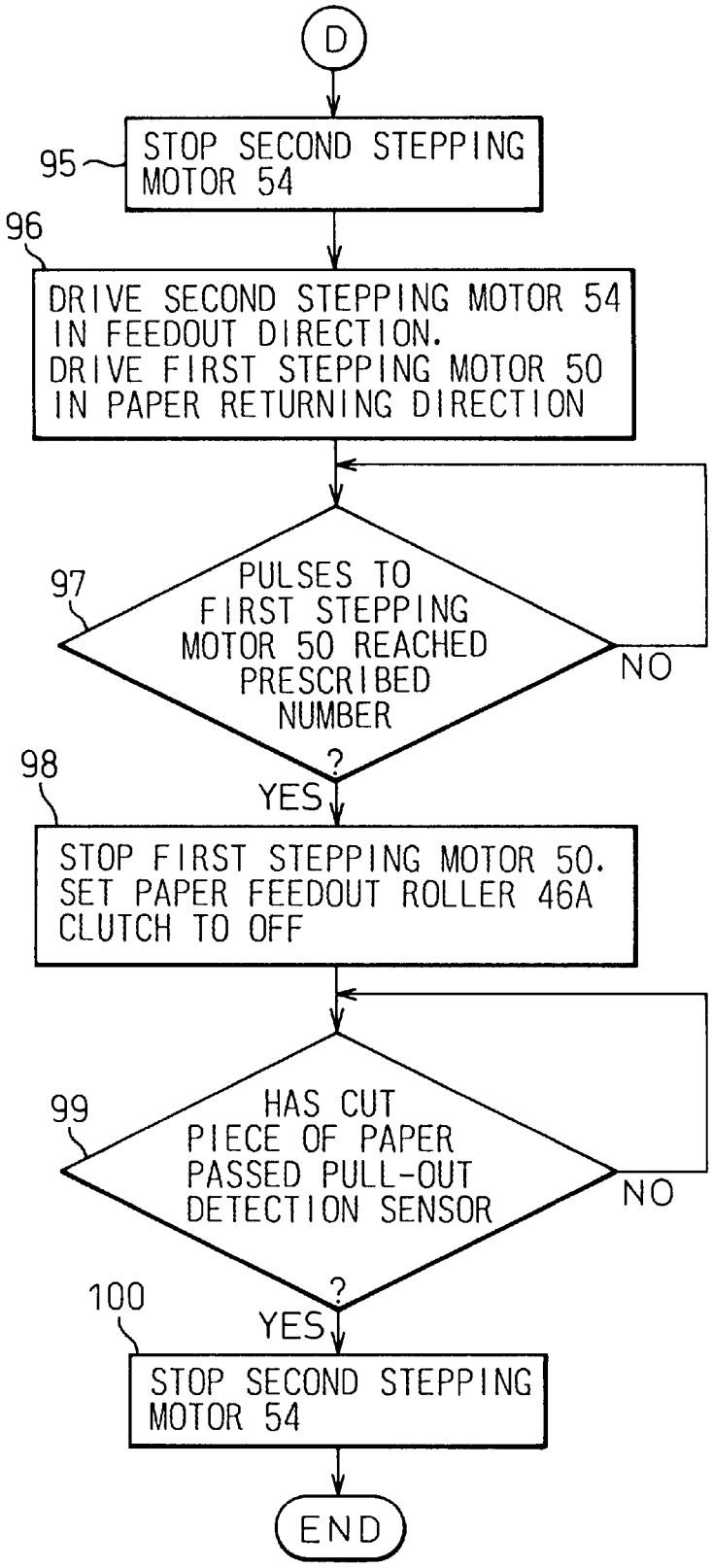

FIGS. 10A, 10B, and 10C are flowcharts which show the control by the unit control section when a roll of paper is installed. The operation of the unit control section is completed by the operations shown in FIGS. 10A through 10C.

The operation when a paper roll is installed will be described next, making reference to FIGS. 4 through 8 and FIGS. 10A through 10E.

First, when an operator such as a bank clerk first sets the receipt paper roll 41A into the machine, the bank clerk inserts the core 61A into the empty center part of the receipt paper roll 41A and sets it in the cutouts of the height adjuster 63A. Next, the operator guides the end of the paper from the receipt paper roll 41A via the guide 65A to the paper feedout roller 46A, and operates the knob 66A so that the end of the paper from the receipt paper roll 41A is grabbed by the paper feedout roller 46A.

While this completes the operation of installing the roll of paper, when the operator installs the paper roll, because its end might be damaged, when installing paper in this embodiment, the end of the paper from the paper roll must be prepared by cutting the end of the paper. Furthermore, not only the newly installed paper roll, but the paper from the other roll is also cut as a measure of preventative maintenance.

The operator operates the knob 66A so that the end of the paper from the receipt paper roll 41A is grabbed by the paper feedout roller 46A, and then presses the feed switch 56.

When the feed switch is pressed at step 71, the unit control section performs a registering of the paper from the receipt paper roll 41A, and whether or not the paper from the receipt paper roll 41A is blocking the paper end detection sensor 45A is sensed at step 72.

In the case in which the paper end detection sensor 45A is not blocked, the first stepping motor 50 is driven in the feedout direction, the clutch 57A of the paper feedout roller 46A is set to on, and the paper from the receipt paper roll 41A is fed out at step 73.

When the fed out paper from the receipt paper roll 41A blocks the paper end detection sensor 45A at step 74, the unit control section stops the drive of the first stepping motor 50, and turns off the clutch 57A of the paper feedout roller 46A, thereby stopping the feeding out of the paper from the receipt paper roll 41A at step 75.

At step 72, in the case in which the paper end detection sensor 45A is blocked, the first stepping motor 50 is driven in the returning direction and the clutch 57A of the paper feedout roller 46A is set to on, thereby transporting the paper from the receipt paper roll 41A in the returning direction.

By returning the paper from the receipt paper roll 41A, the blocking of the paper end detection sensor 45A is cleared at step 77, at which point the unit control section stops the drive to the first stepping motor 50 and sets the clutch 57A of the paper feedout roller 46A to off, thereby stopping the returning of the paper from the receipt paper roll 41A at step 75.

In this manner, when the end of the paper from the receipt paper roll 41A is stopped at the position at which the paper end detection sensor 45A is provided, that is, at the point immediately before the merging roller 47, the unit control section then performs registering of the end of the paper from the supplementary information paper roll 41B.

The reflection sensor 51 serves as the reference for the registering of this supplementary information paper roll 41B. The reflection sensor 51 is a sensor for the purpose of determining the cutting position by detecting the black mark on the paper from the roll. As noted above, it also serves to cue the end of the supplementary information paper roll 41B.

The unit control section drives the first stepping motor 50 and the second stepping motor 54 in the feedout direction and sets the clutch 57B of the paper feedout roller 46B to on, so that the paper from the supplementary information paper roll 41B is fed out at step 78.

When the end of the paper from the supplementary information paper roll 41B passes by the reflection sensor 51, causing the amount of reflected light to change at step 79, the unit control section feeds more paper out from the supplementary information paper roll 41B.

Then, after the end of the paper from the supplementary information paper roll 41B is detected by the reflection sensor 51, when the first black mark is detected by means of the change in the amount of reflected light at step 80, the unit control section counts the pulses to the first stepping motor 50, and when the prescribed number of pulses is reached at step 81 (corresponding to the time when the black mark reaches the cutter 52), it stops the first stepping motor 50 and the second stepping motor 54, that the paper from the supplementary information paper roll 41B is stopped at step 82.

Next, the unit control section drives the second stepping motor 54 in the paper returning direction and a cutting operation is performed on the paper from the supplementary information paper roll 41B at step 83.

At this time, even if the second stepping motor 54 turns in the paper returning direction, as explained in connection with FIGS. 6A and 6B, the unidirectional transport clutch 54C and the unidirectional cam clutch 54D act so that the paper from the supplementary information paper roll 41B is cut without returning it.

The cutter 52 begins the cutting operation, and when the protruding part 52L of the cam 52B blocks the cam sensor 52C at step 84, the unit control section makes the judgment that the cutting operation with respect to the paper from the supplementary information paper roll 41B has been completed, and stops the second stepping motor 54 at step 85.

Next, the unit control section drives the second stepping motor 54 in the paper feedout direction so that the cut paper is transported by the transport belt 53 and ejected from the ejection opening 22, the first stepping motor 50 being driven in the paper returning direction at step 86 to return the paper until the prescribed number of pulses is reached at step 87 (corresponding to returning the paper from the supplementary information paper roll 41B so that the end of the paper is separated from the merging roller).

When the paper from the supplementary information paper roll 41B is returned far enough for its end to be distanced from the merging roller 47, the unit control section sets the clutch 57B of the paper feedout roller 46B to off at step 88, drives the second stepping motor 54 in the paper feedout direction, and sets the clutch 57A of the paper feedout roller 46A to on to feed out the paper from the receipt paper roll 41A at step 89.

Then, when reflection sensor detects the black mark on the paper from the receipt paper roll 41A by means of the change in the amount of reflected light at step 90, the unit control section counts the pulses to the first stepping motor 50, and when the prescribed number of pulses is reached at step 91 (corresponding to the point at which the black mark reaches the cutter 52), it stops the first stepping motor 50 and the second stepping motor 54, thereby stopping the feedout of the paper from the receipt paper roll 41A at step 92.

Next, the unit control section drives the second stepping motor 54 in the paper returning direction and performs a cutting operation on the paper from the receipt paper roll 41A at step 93.

The cutter 52 begins the cutting operation, and when the protruding part 52L of the cam 52B blocks the cam sensor 52C at step 94, the unit control section makes the judgment that the cutting operation with respect to the paper from the receipt paper roll 41A has been completed, and stops the second stepping motor 54 at step 95.

Next, the unit control section drives the second stepping motor 54 in the paper feedout direction, so that the cut piece of paper is transported by the transport belt 53 and ejected from the ejection opening 22, the first stepping motor 50 being driven in the paper returning direction at step 96 to return the paper until the prescribed number of pulses is reached at step 97 (corresponding to returning the paper from the receipt paper roll 41A so that the end of the end of the paper is opposite the printing head 48A).

When the paper from the receipt paper roll 41A is returned so that its end is opposite the printing head 48A, the unit control section stops the first stepping motor 50 and sets the clutch 57A of the paper feedout roller 46A at step 98.

Then, when the paper from the supplementary information paper roll 41B and the paper from the receipt paper roll 41A pass by the pull-out detection sensor 55 which is provided in the region of the receipt ejection opening 26 at step 99, the unit control section makes the judgment that the cut part has been ejected, and stops the second stepping motor 54 at step 100, thereby completing the processing of the paper from the rolls.

During the paper roll installation operation in this embodiment, the end of the paper is cut and ejected without performing a printing operation, and it is also possible to print the letters NG, for example, on the paper, to prevent its improper use.

Furthermore the same operation as with the receipt paper roll 41A is performed with respect when a new supplementary information paper roll 41B is installed as well.

As described above, when installing a new paper roll, the ends of both rolls are always cut to prepare them properly.

In this embodiment, in consideration of the fact that receipts are issued with a higher frequency than supplementary information, the end of the paper from the paper roll 41B is backed off to a position that is distanced from the merging roller, and the end of the paper from the receipt paper roll 41A is backed off to a position which is opposite the printing head 48A.

By doing this, when issuing of a receipt is required, it is possible to perform a printing operation using the printing head 48A immediately.

The above-described setup operation is performed not only when a new paper roll is installed, but also when the automated teller machine is started up and when resetting from an error condition, so as to reliably establish and position the ends of the paper from the paper rolls.

(4-6) Paper rolls

Figure 11:
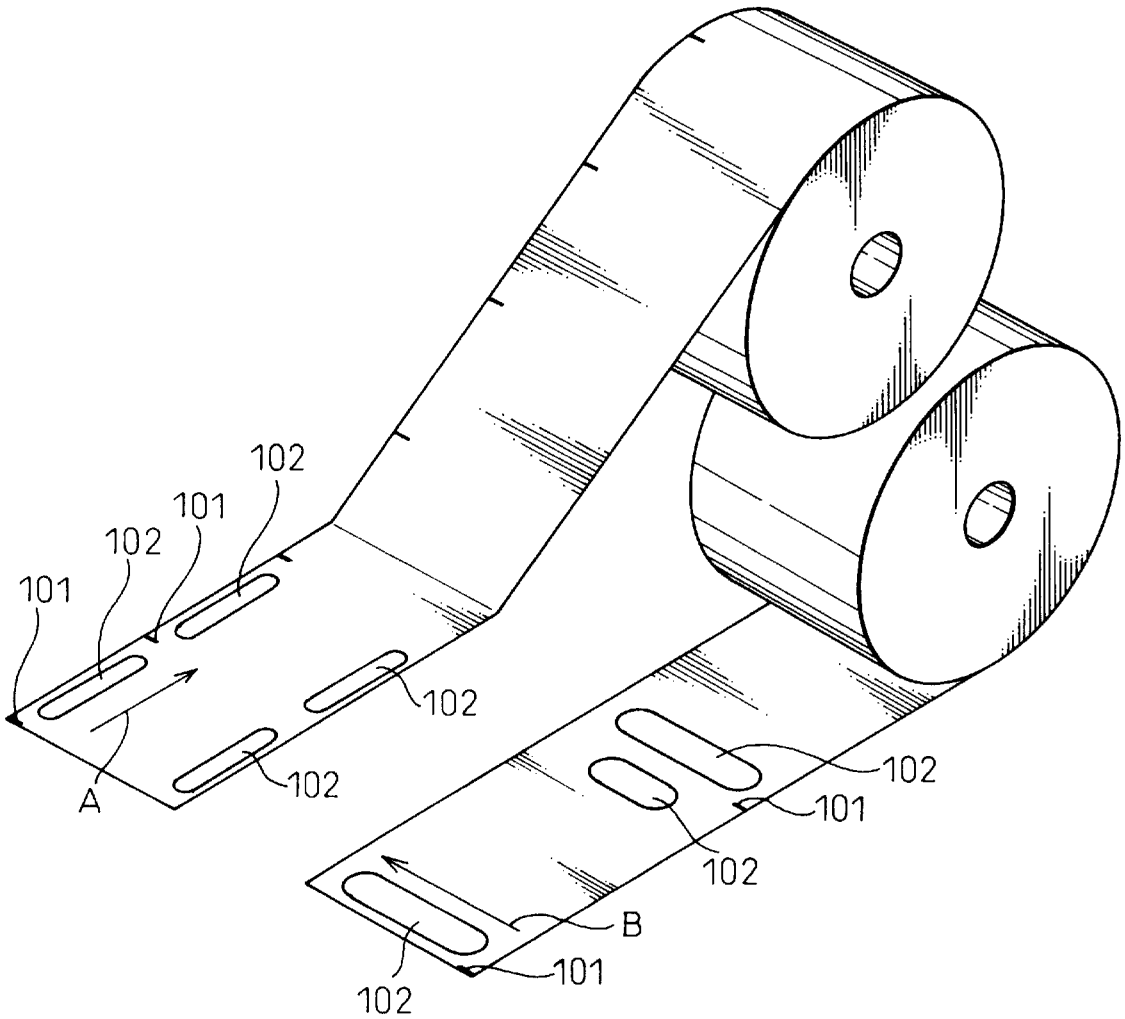
FIG. 11 is a drawing which shows the paper roll for receipts and the paper roll for supplementary information in an embodiment of the present invention.

FIG. 11 is a drawing which shows paper from the receipt paper roll 41A and the supplementary information paper roll 41B in this embodiment. The reference numeral 101 denotes a black mark which is used as a reference when cutting the paper, and 102 is a pre-printed part, which is printed onto the paper forms beforehand.

Having the pre-printed part which includes pre-established characters and symbols printed onto the paper reduces the amount of printing that the printing head 48A must do, thereby shortening the printing time. There are some financial institutions issuing receipts and supplementary information (it may be called service information) which use paper onto which, in addition to characters and symbols, printing frames are also printed.

Because supplementary information includes printing of a record of the customer's past transactions, and of promotional information for the financial institution, it includes more information that the receipt onto which is printed the particulars of a transaction, and the size of this is much larger than the size of the receipt.

Therefore, in the case in which supplementary information, which is more information than receipt information, is issued from the receipt paper roll 41A, to issue one set of supplementary information, it is necessary to cut up a plurality of receipt-sized papers, this representing a problem in appearance, since the supplementary information issued will have the receipt pre-printed part printed on it a number of times.

Also, when issuing supplementary information using the receipt paper roll 41A, the black mark 101, which is applied to suit the size of the receipt, cannot be used as the reference for cutting, thus making the positioning for cutting complex.

In addition, because receipts are issued much more frequently than supplementary information, it is desirable to use the receipt paper roll 41A for the purpose of issuing receipts only, to reduce the number of times the paper roll is replaced.

For the reasons described above, in this embodiment of the present invention, the receipt paper roll 41A is used only for the issuing of receipts, with supplementary information being issued from the supplementary information paper roll 41B.

However, in a financial institution that does not desire to issue supplementary information, it is wasteful in terms of mechanisms to install a supplementary information paper roll 41B, to print on it with a common printer that also prints the receipt, to cut it using a common cutter, and to eject it from a common ejection opening.

For this reason, in this embodiment, the intraframe spacing of the holding frame 62A for the receipt paper roll 41A is the same as the intraframe spacing of the holding frame 62B for the supplementary information paper roll 41B, but instead of installing a supplementary information paper roll 41B in this latter holder, a spare receipt paper roll 41A is installed, so that when the end of the paper in the receipt paper roll 41A is reached, the other receipt paper roll 41A can be fed out and used.

By doing this, it is possible to reduce the number of times the machine needs to be stopped because of running out of paper, thereby improving the uptime ratio of the machine.

However, if the intraframe spacings of the both holding frames for the receipt paper rolls are fixed to be equal length to satisfy this requirement, only the paper rolls having the same width can be installed therein and it is impossible to issue the different supplementary paper having a different width.

In this regard, in the present invention, as shown in FIG. 11, printing is done in the direction of the arrow A, that is in the direction of paper feedout, onto the receipt paper roll 41A, and printing is done in the direction of the arrow B, that is, in a direction perpendicular to the paper feedout, onto the supplementary information paper roll 41B (normal printing).

Therefore, the width of the paper roll corresponds to the length of the receipt issued and the width of the supplementary information issued.

By doing this, even if it is only possible to install paper rolls of the same width, it is possible to issue supplementary information which has a greater width than the receipt.

(5) Modes of the embodiments

In an automated teller machine of the above-described embodiment of the present invention, in the case of issuing supplementary information, the following first, second, and third modes can be envisioned.

<1> When selecting a transaction, the issuing of supplementary information is selected from the selections displayed on the display screen 21A, and independent supplementary information issued, separate from other transactions.

<2> When making a transaction such as a deposit or a withdrawal, or when completing such a transaction, a request is made for the issuing of supplementary information, and the supplementary information is ejected after ejecting the receipt.

<3> When making a transaction such as a deposit or a withdrawal, or when completing such a transaction, a request is made for the issuing of supplementary information, and the supplementary information is ejected simultaneously with the receipt.

(5-1) The first embodiment mode

Figure 12A:
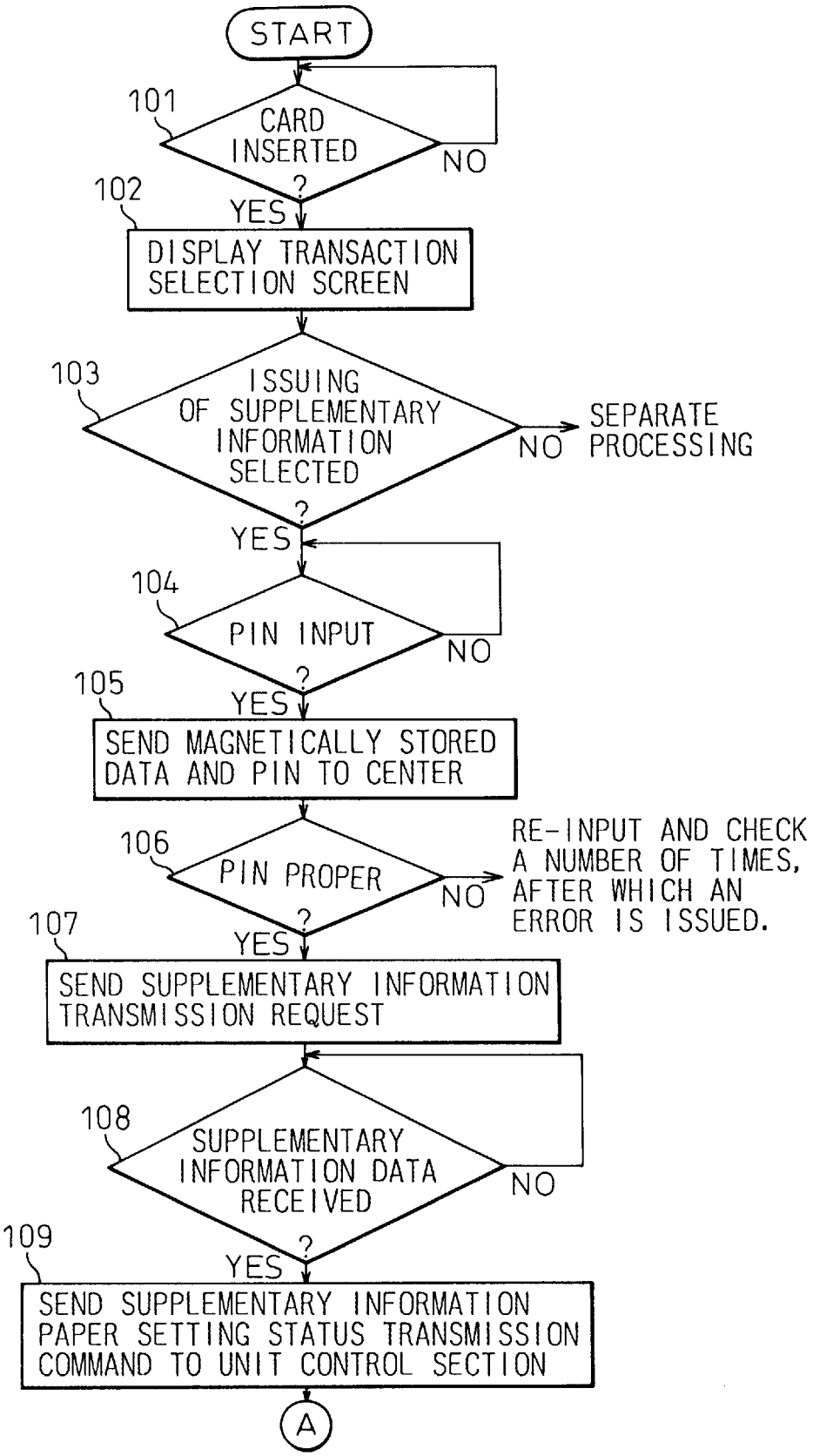
FIGS. 12A and 12B are flowcharts showing the operation of the main control section of an automated teller machine of the first mode of an embodiment of the present invention.
Figure 12B:
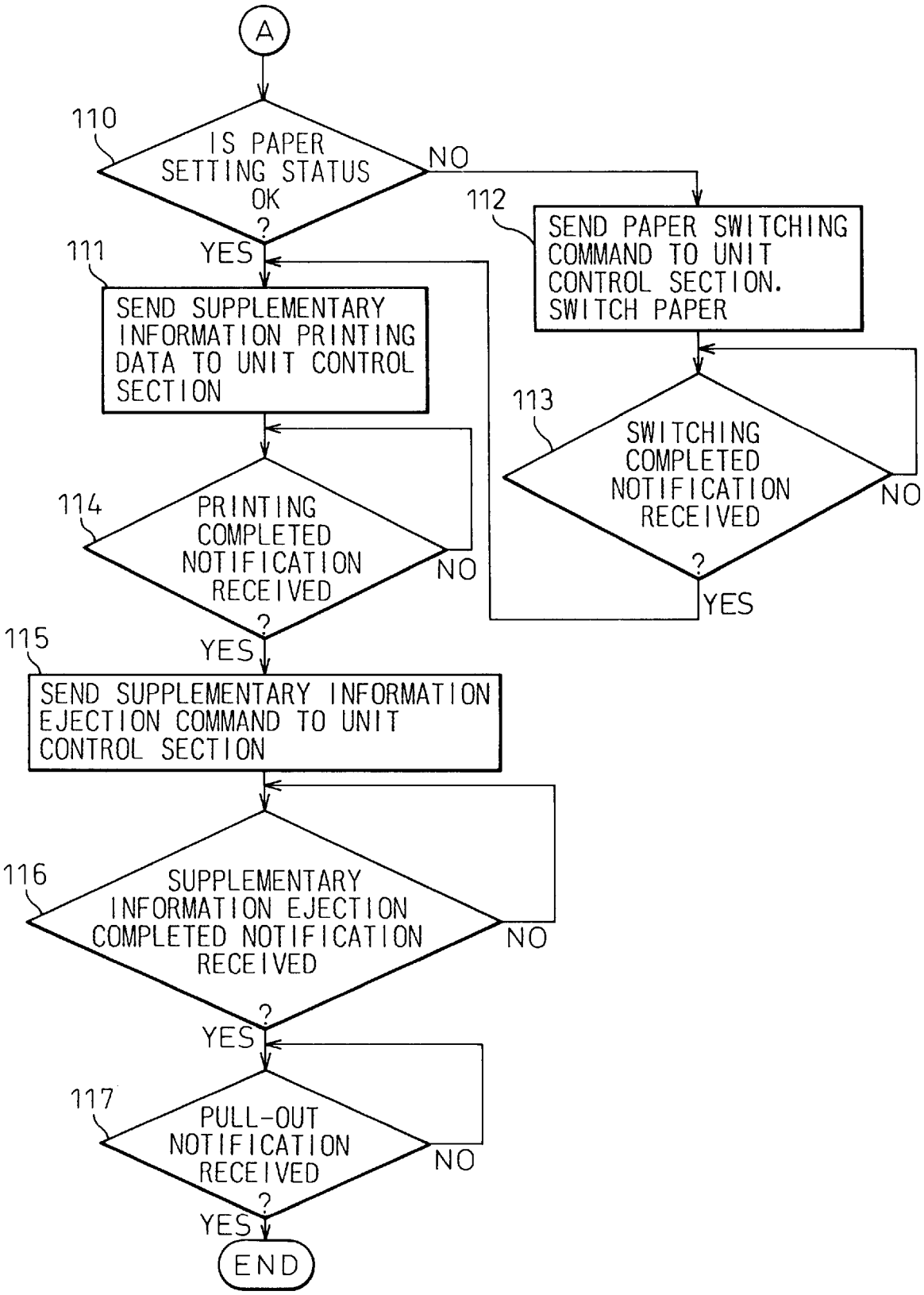

FIGS. 12A and 12B are flowcharts of the main control section 37 of an automated teller machine according to the first embodiment mode. The operation of the main control section is completed by the operations shown in FIGS. 12A and 12B.

FIGS. 13A to 13D are flowcharts of the unit control section of the receipt issuing section 36 of the first embodiment mode. The operation of the unit control section is completed by the operations shown in FIGS. 13A through 13D. The first embodiment mode is described below, with reference made to FIGS. 12A through 13D.

First, the operation of the main control section 37 will be described, with reference made to FIGS. 12A and 12B.

When a card is inserted into the card insertion/ejection opening 22 of the automated teller machine by the customer at step 101, the main control section 37 displays on the display screen 21A a transaction selection screen at step 102. In addition to such general financial transaction as deposits and withdrawals, this transaction selection screen includes a selection for the issuing of supplementary information. If the customer selects issuing of supplementary information, using the keyboard 21B at step 103, the main control section 37 displays on the display screen 21A a screen which requests input of a personal identification number.

It is possible to reverse the sequence of the transaction selection screen and the personal identification number request screen, without incurring problems. When the personal identification number is input from the keyboard 21B at step 104, the main control section sends the customer information that is recorded on a magnetic stripe on the card and the input personal identification number to a center computer for verification of the proper identity of the customer at step 105.

As a result of a check performed at the center computer, if the personal identification number was improper, a further request is made for input of the personal identification number, with a further check of the personal identification number. If, however, a proper personal identification number is not input within a prescribed number of attempts, notice of an error is made, and the transaction is terminated.

If the check of the personal identification number shows that the proper personal identification number had been input at step 106, the main control section 37 sends a supplementary information transmission request to the center computer at step 107. The supplementary information noted here is, in general, such information as a record of the customer's past transactions or promotional information for the financial institution.

With regard to the history of the customer's transactions, a customer file is stored in the center computer, and it is possible to access the transaction history corresponding to the customer information which is stored on the magnetic stripe of the card and which has been at this point sent to the center computer. With regard to financial institution promotional information, it can be either stored in one place at the center computer or stored individually in each automated teller machine.

Therefore, if the information to be issued is only promotional information, and if this promotional information is stored within the automated teller machine, there is no need to issue a transmission request for this to the center computer.

Note that it is also possible, before entering step 107, to have the customer select the type of supplementary information to be issued from the display screen, and to issue a transmission request to the center computer only if the customer selects issuing of a transaction history.

When the main control section 37 receives the supplementary information data from the center computer at step 108, it performs control so that received data is printed at the receipt issuing section 36, and issued to the customer.

First, the main control section 37 sends command for transfer of the paper setting status of the receipt issuing section 36 to the unit control section of the receipt issuing section 36 at step 109. The above-noted paper setting status is the status of which of the receipt paper roll 41A which held in the receipt issuing section 36 and the supplementary information paper roll 41B is ready to be printed onto.

Because, as described with regard to FIG. 4, the receipt issuing section 36 is formed on a printed circuit board having a memory, it is possible for the receipt issuing section 36 to tell which type of medium was issued last by accessing this memory.

Therefore, if the last medium which was issued was a receipt, the unit control section the receipt paper roll 41A is judged to have been fed out to a position opposite the printing head 48A, and if the last medium issued was supplementary information, the supplementary information paper roll 41B is judged to have been fed out a position opposite the printing head 48A and paper setting information which indicates which paper has been fed out to a position opposite the printing head 48A is sent to the main control section 37.

When the paper setting status is received from the unit control section, the main control section 37 makes a determination of whether the paper which is currently fed out to a position opposite the printing head 48A is the appropriate one at step 110, and if this paper setting status indicates that it is (that is, that the supplementary information paper roll 41B paper is fed out to a position opposite the printing head 48A), supplementary information printing data is sent to the unit control section at step 111 and the printing operation is started.

If at step 110 the paper setting status was improper (that is, if the receipt paper roll 41A paper had been fed out a position opposite the printing head 48A), a paper switching command is sent at step 112, and after a switching completed notification is received from the unit control section at step 113, supplementary information printing data is sent to the unity control section and the printing operation is started at step 111.

When the printing completed notification is received at step 114, the main control section 37 sends a command to the unit control section to cut the printed paper off and eject it step 115.

In response to this ejection command, the unit control section of the receipt issuing section 36 causes execution of the ejection of the cut piece of paper and the return of the paper from the roll after this cutting operation, and when the cut piece of paper is transported to the receipt ejection opening 26, an ejection completed notification is sent to the main control section 37.

When the ejection completed notification is received from the unit control section at step 116, the main control section 37 only has to wait for the customer to remove the cut piece of paper, that is, the supplementary information, processing being completed at the point at which the pull-out notification is received from the unit control section at step 117.

Figure 13A:
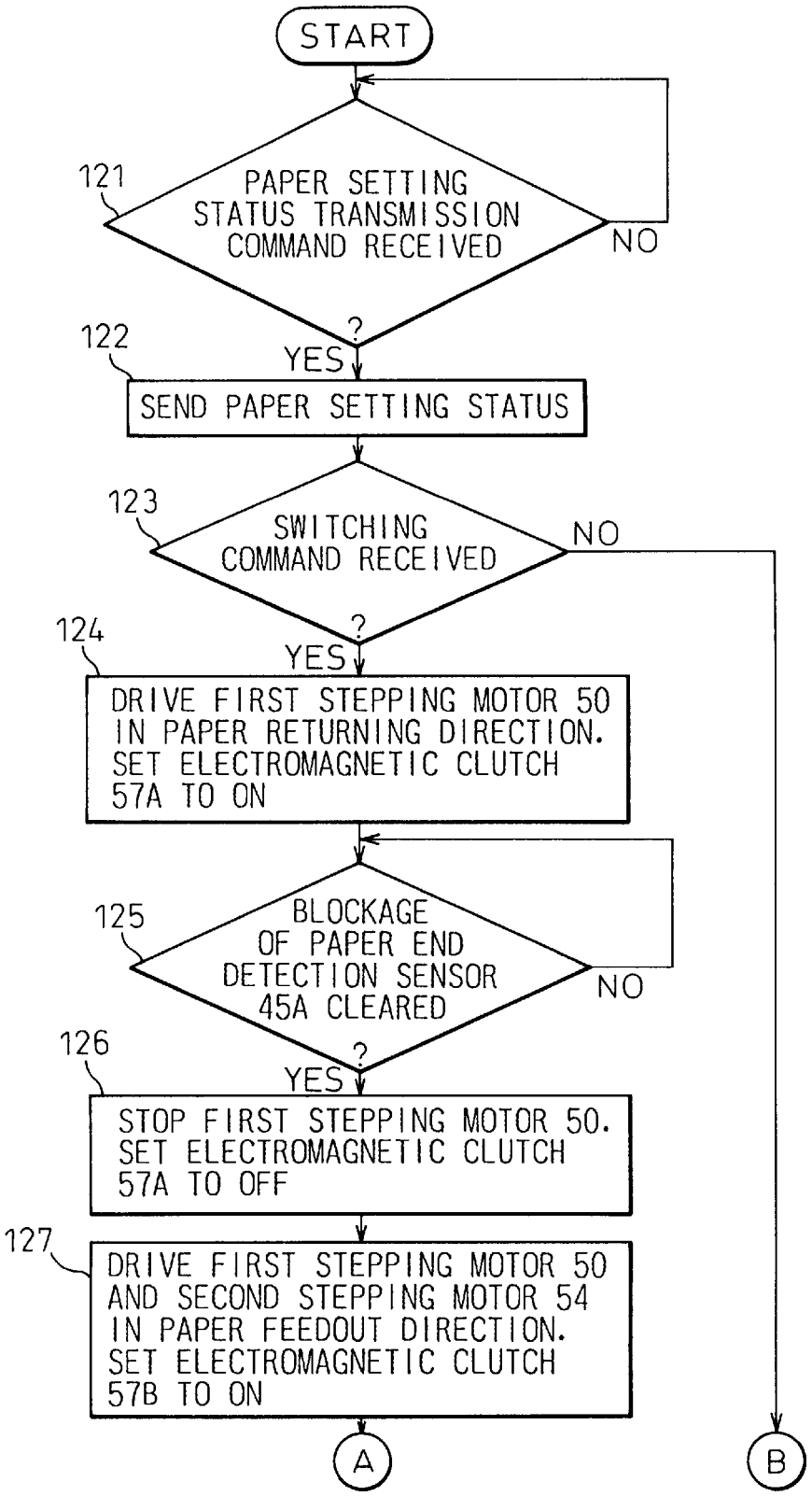
FIGS. 13A through 13D are flowcharts showing the operation of the unit control section of the receipt issuing section of an automated teller machine of the first mode of an embodiment of the present invention.
Figure 13B:
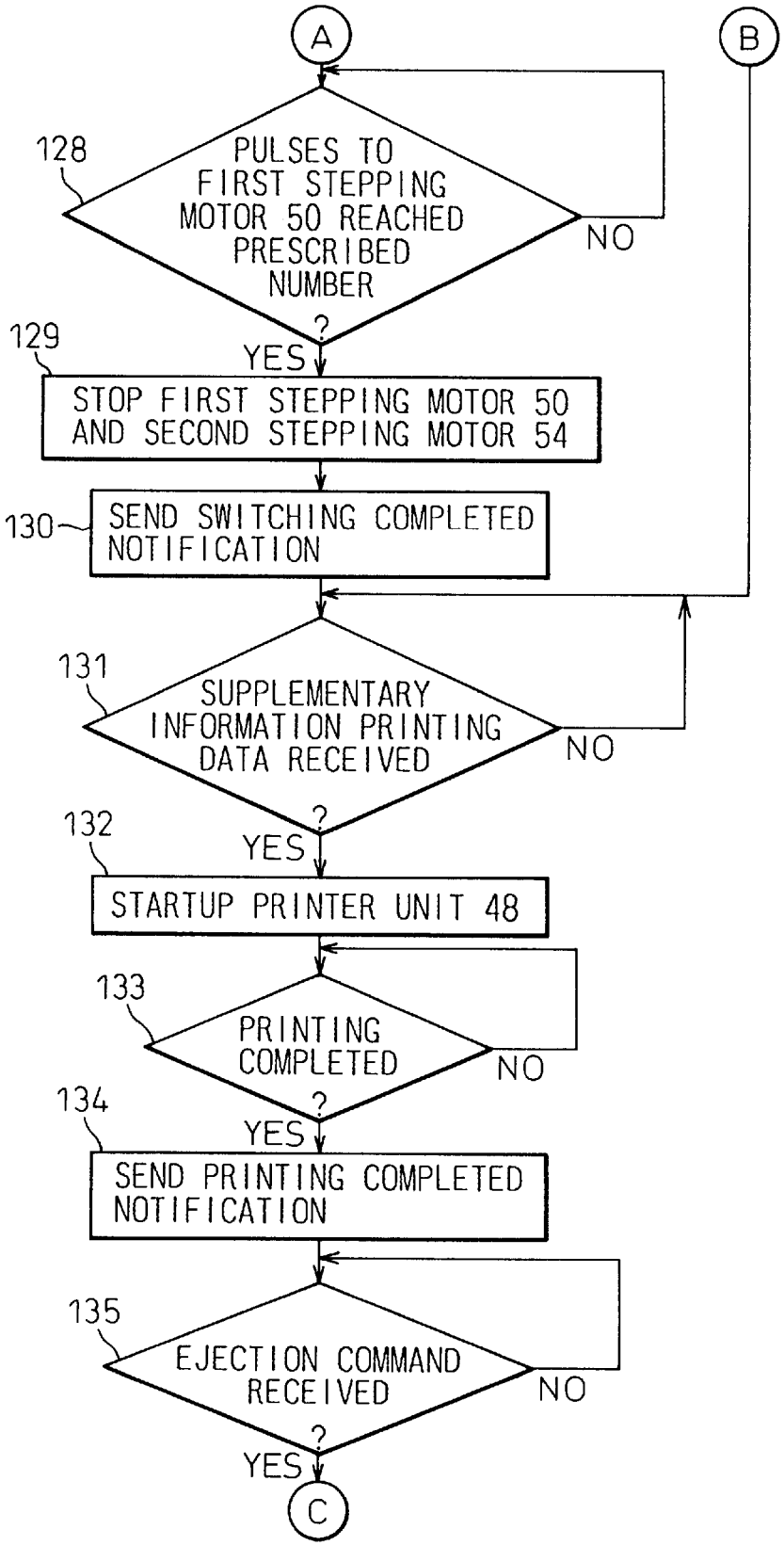
Figure 13C:
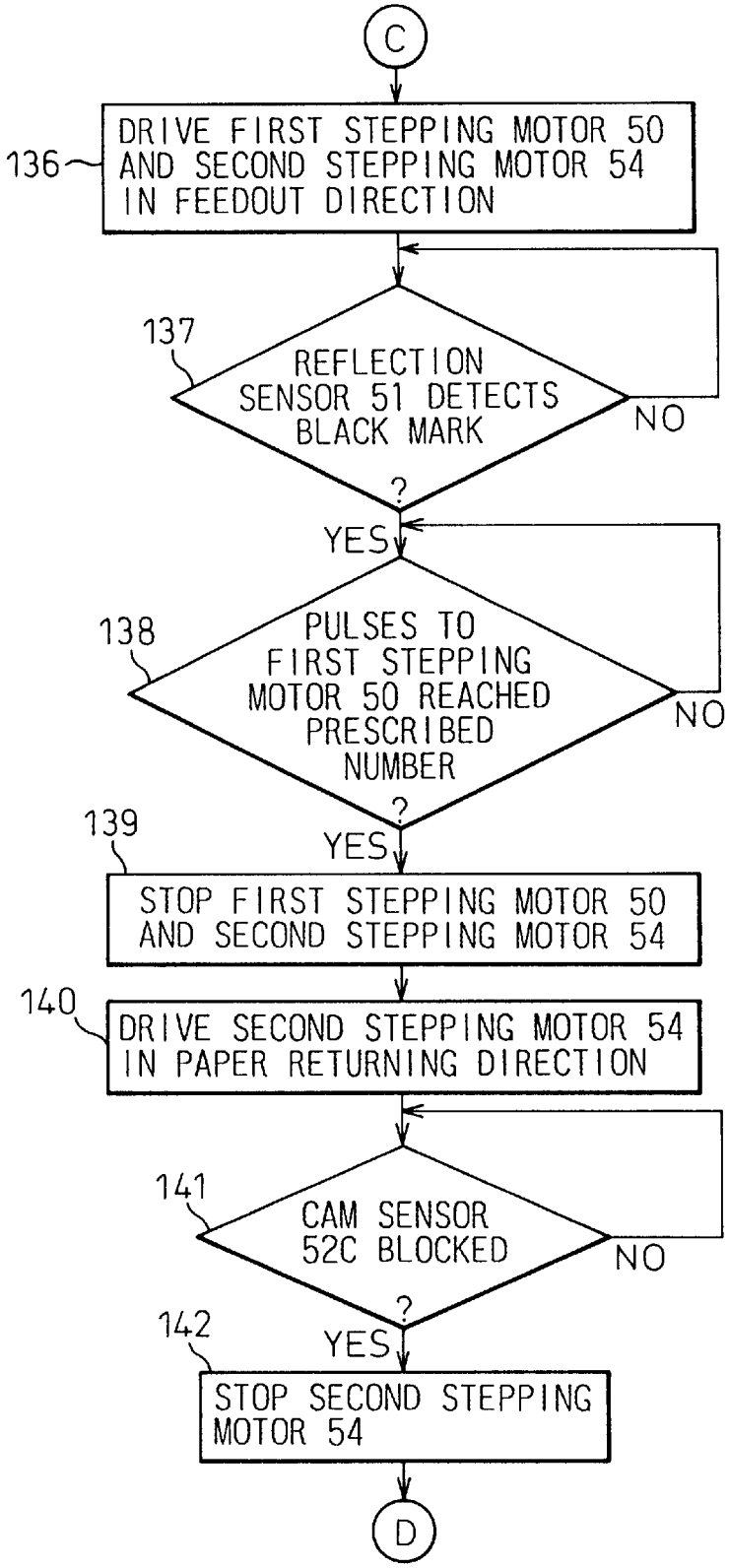
Figure 13D:
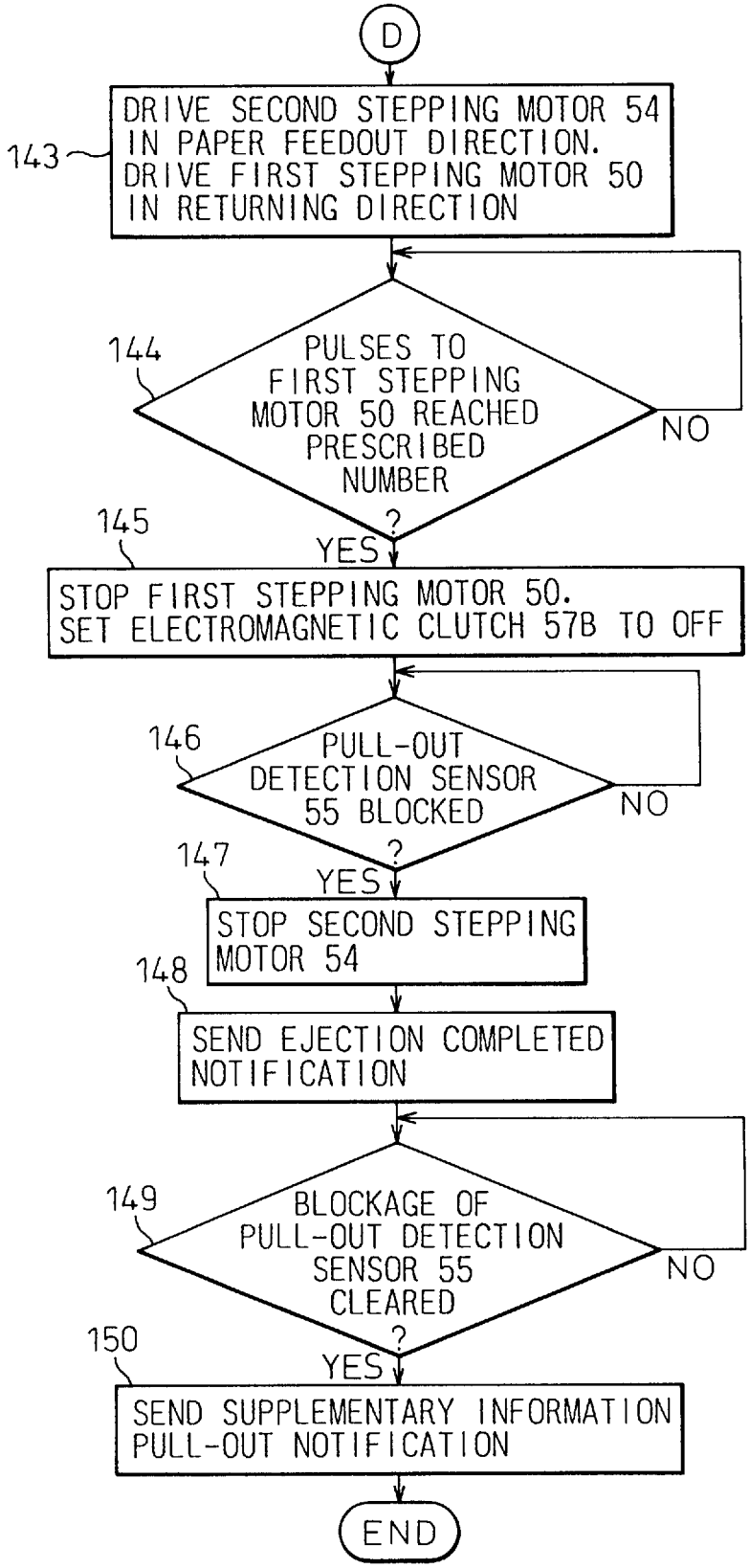
Figure 14A:
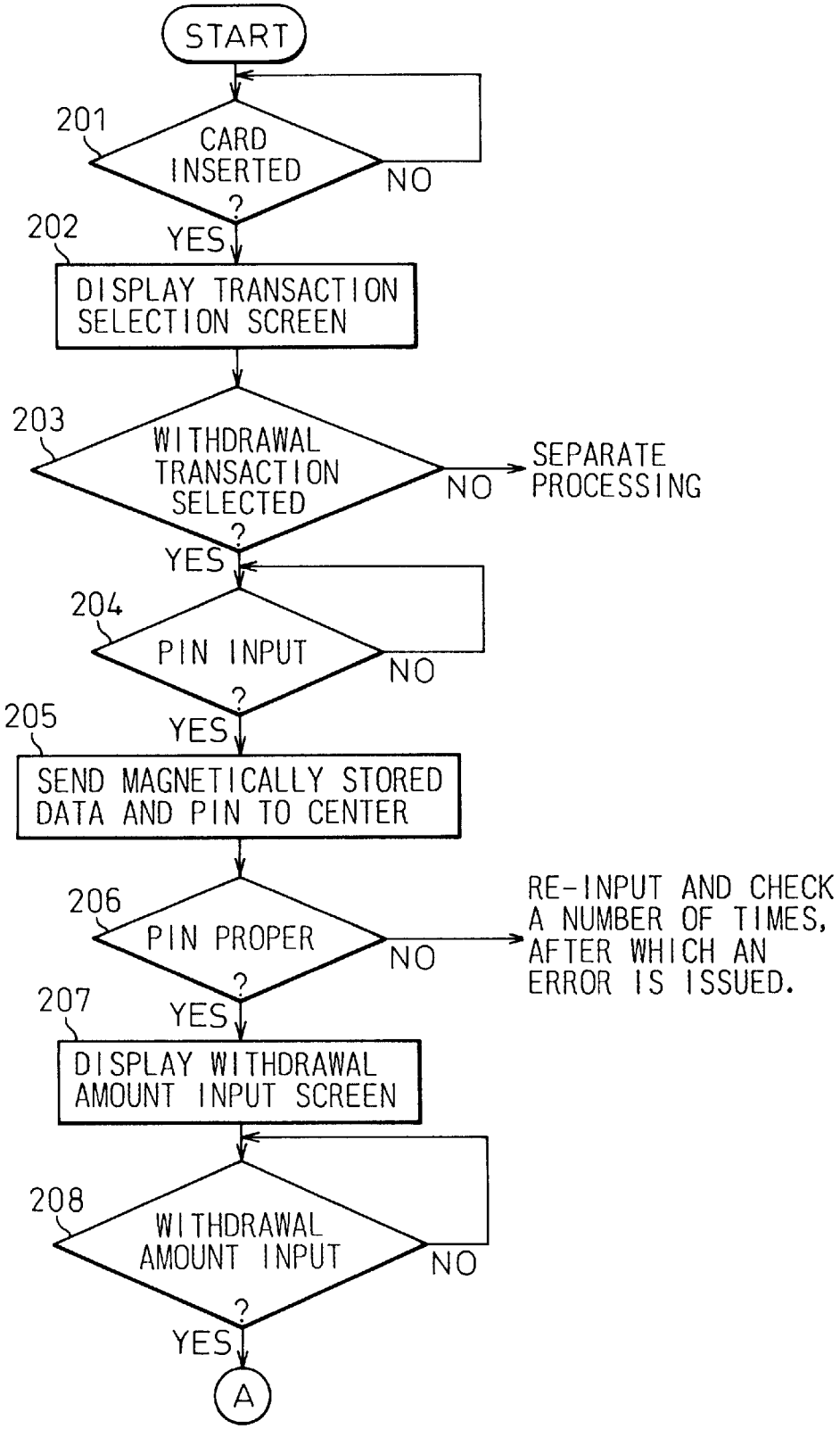
FIGS. 14A through 14D are flowcharts showing the operation of the main control section of an automated teller machine of the second mode of an embodiment of the present invention.
Figure 14B:
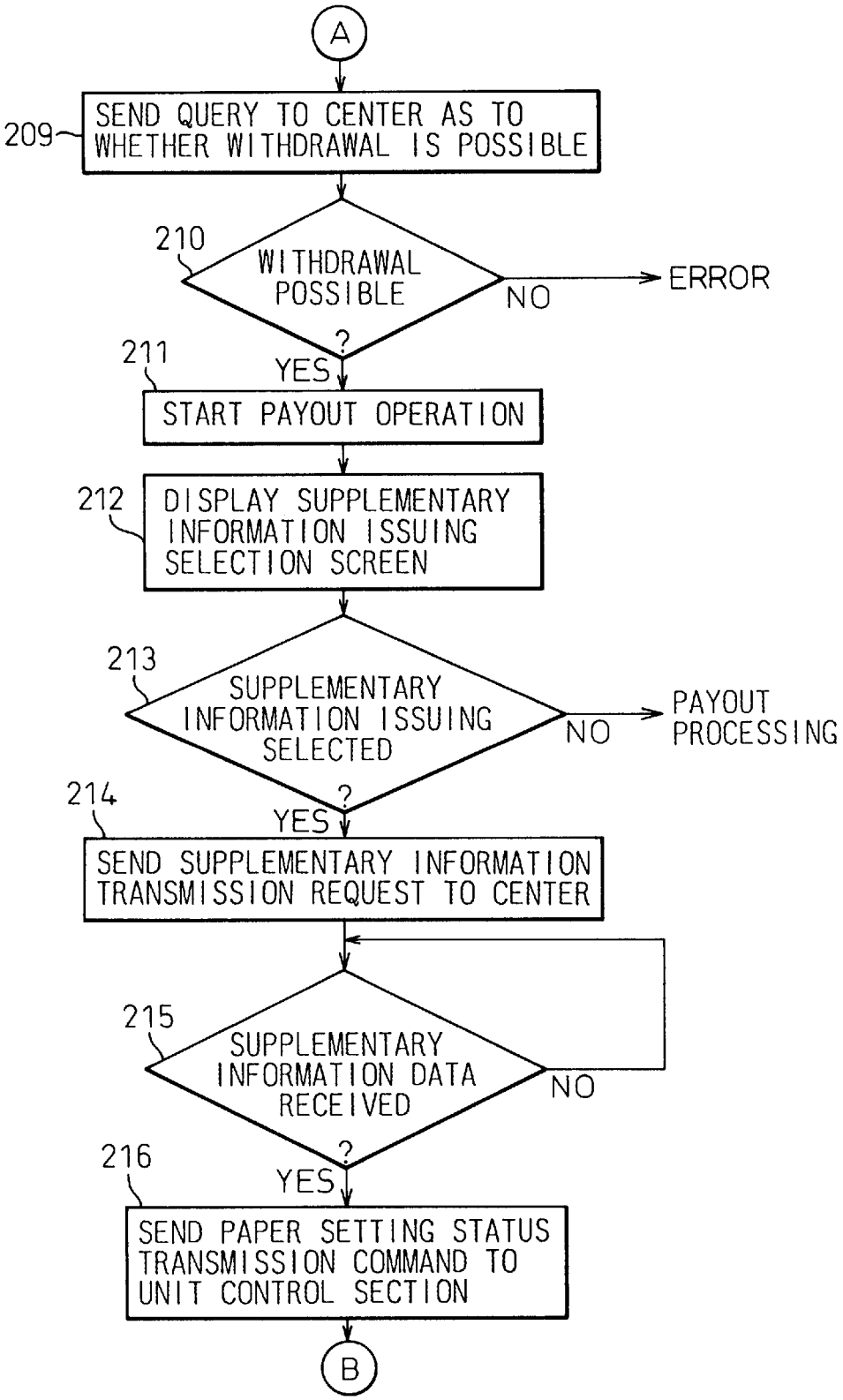
Figure 14C:
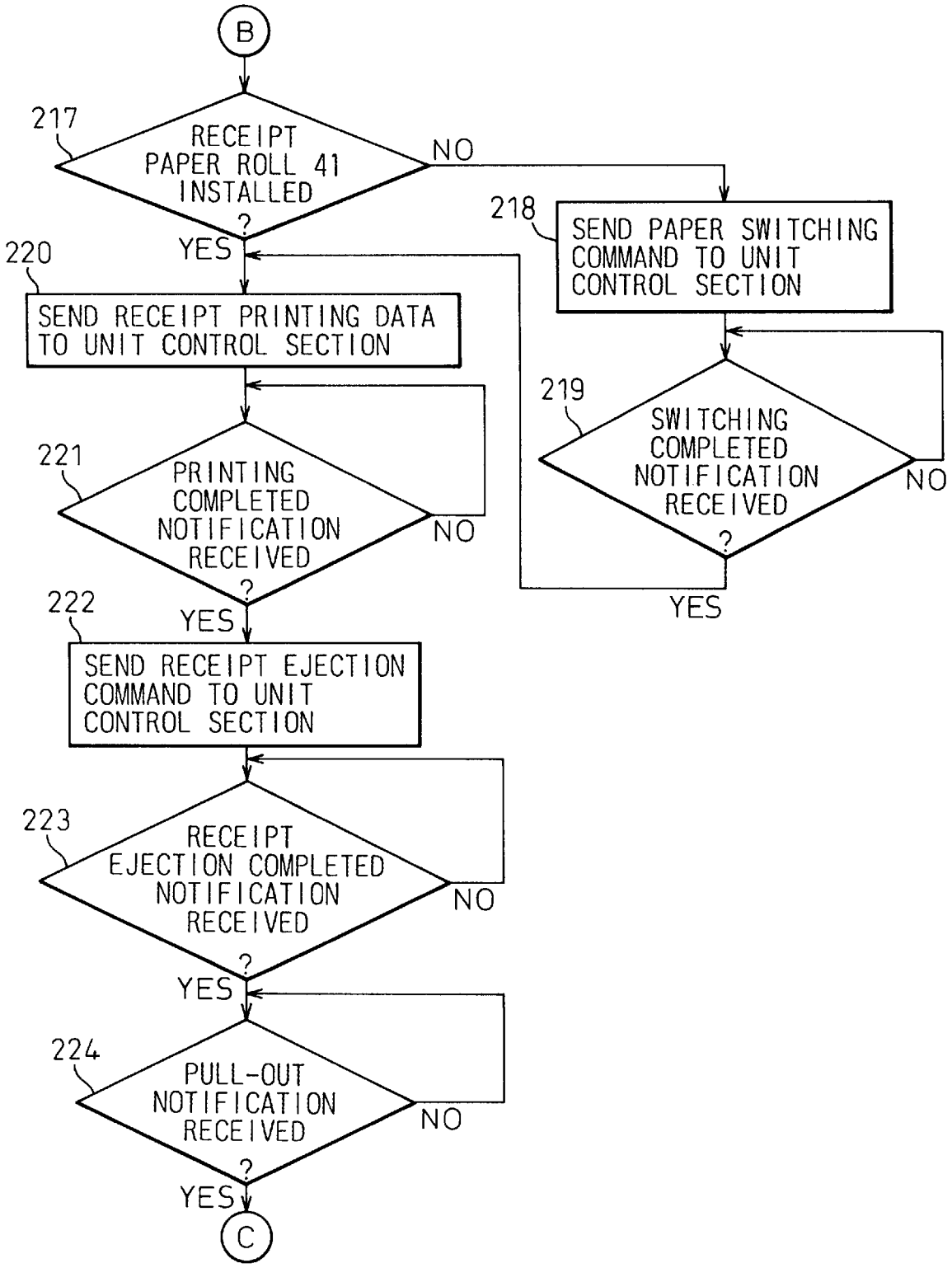
Figure 14D:
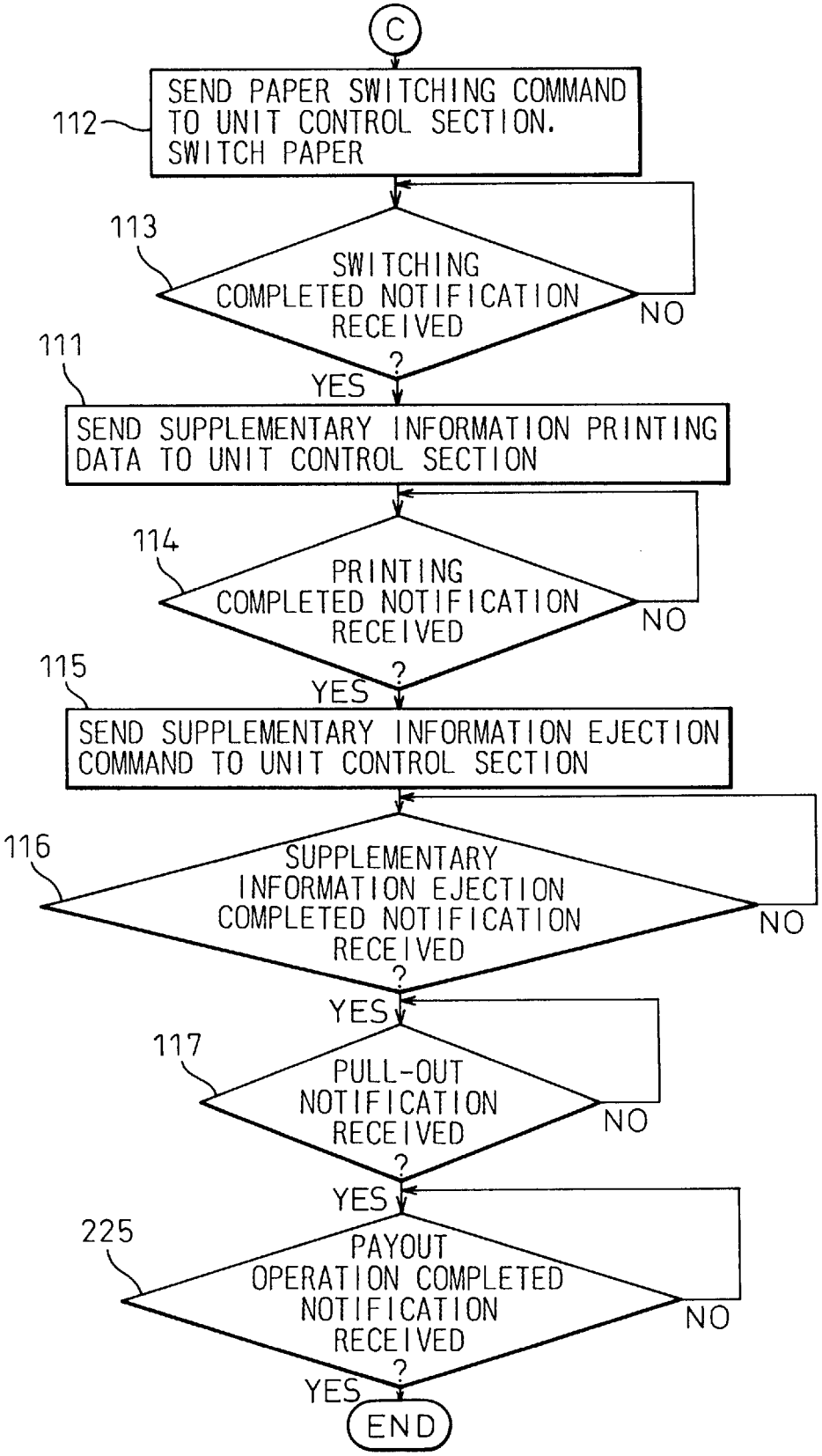
Figure 15A:
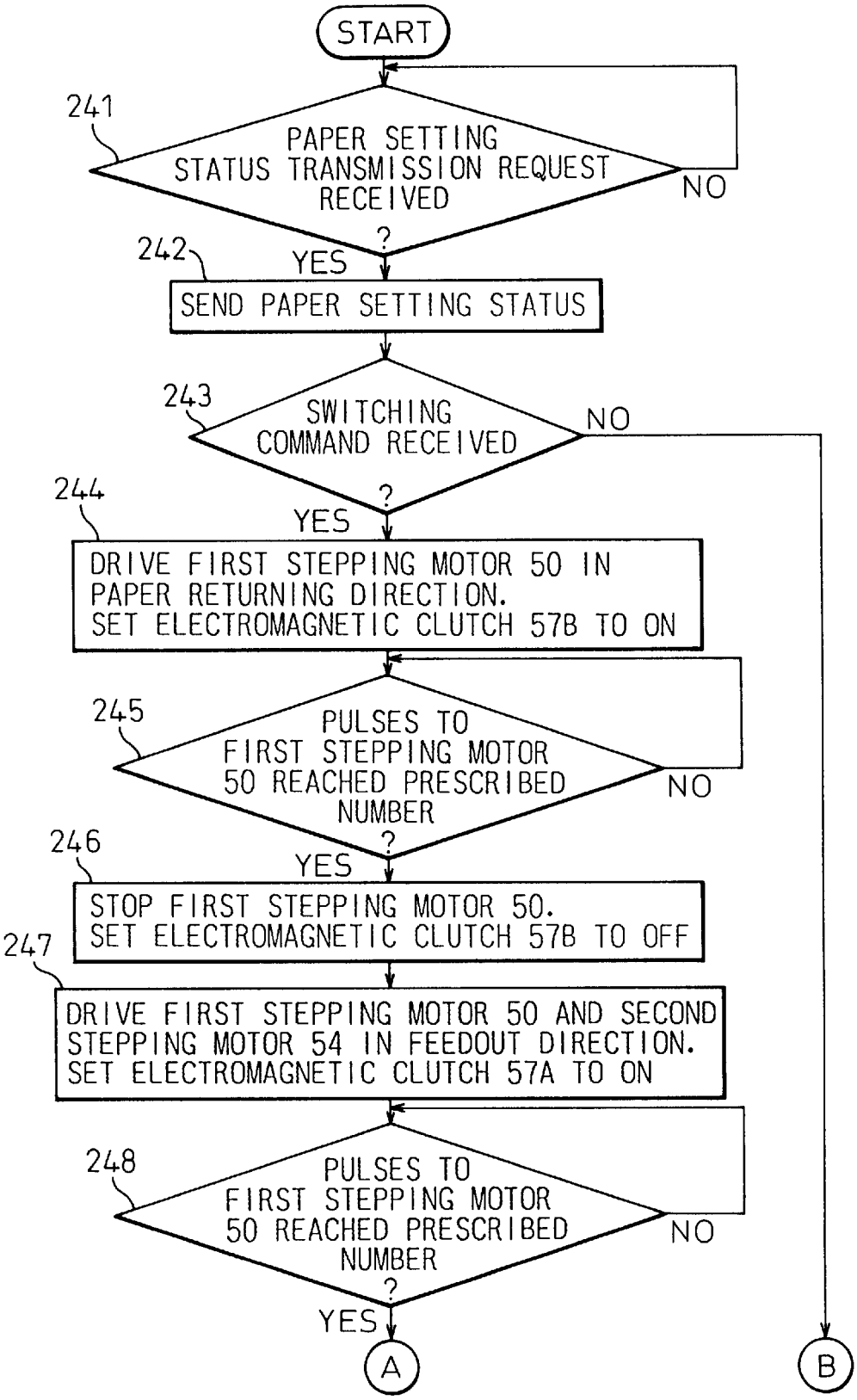
FIGS. 15A through 15F are flowcharts showing the operation of the unit control section of the receipt issuing section of an automated teller machine of the second mode of an embodiment of the present invention.
Figure 15B:
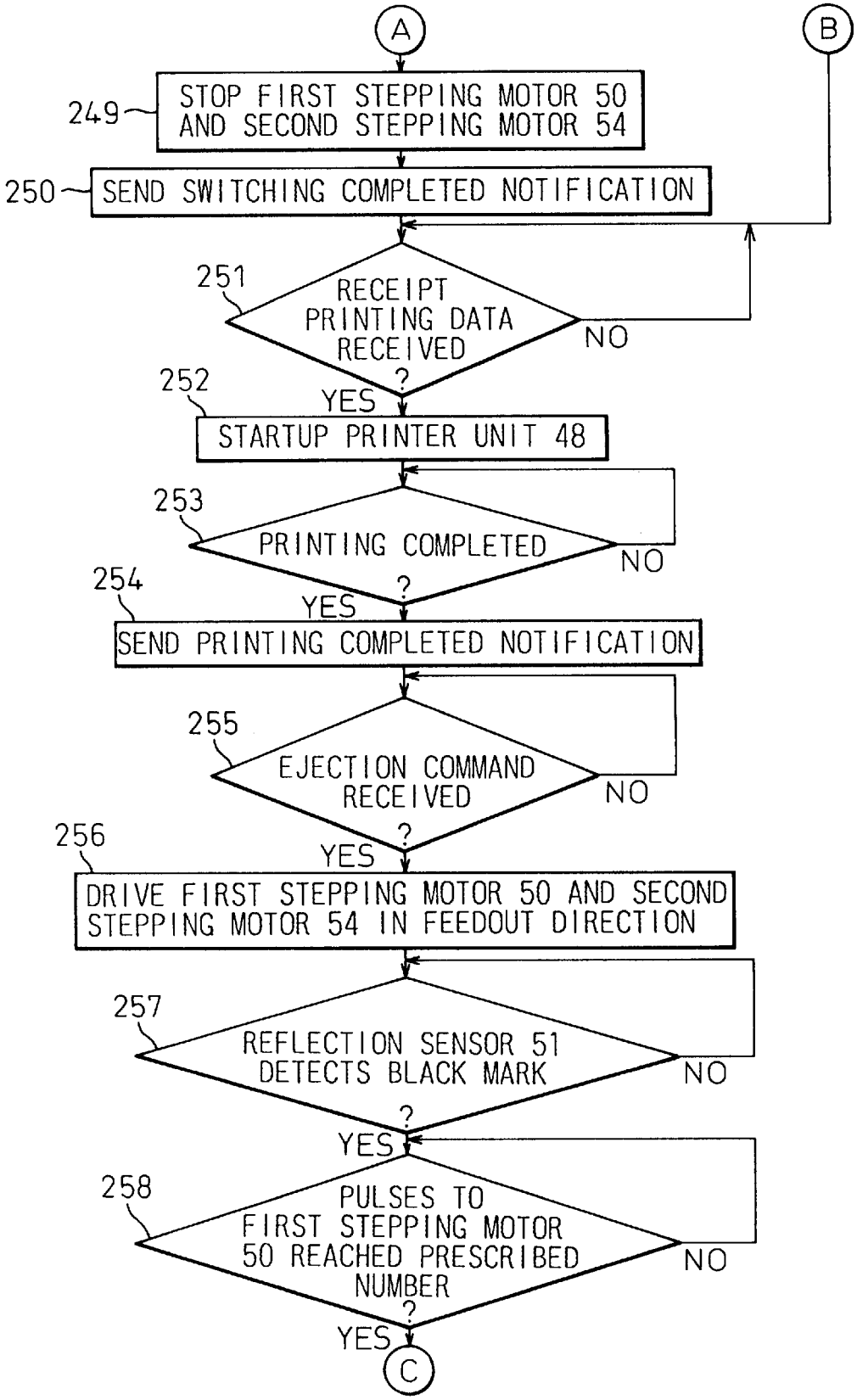
Figure 15C:
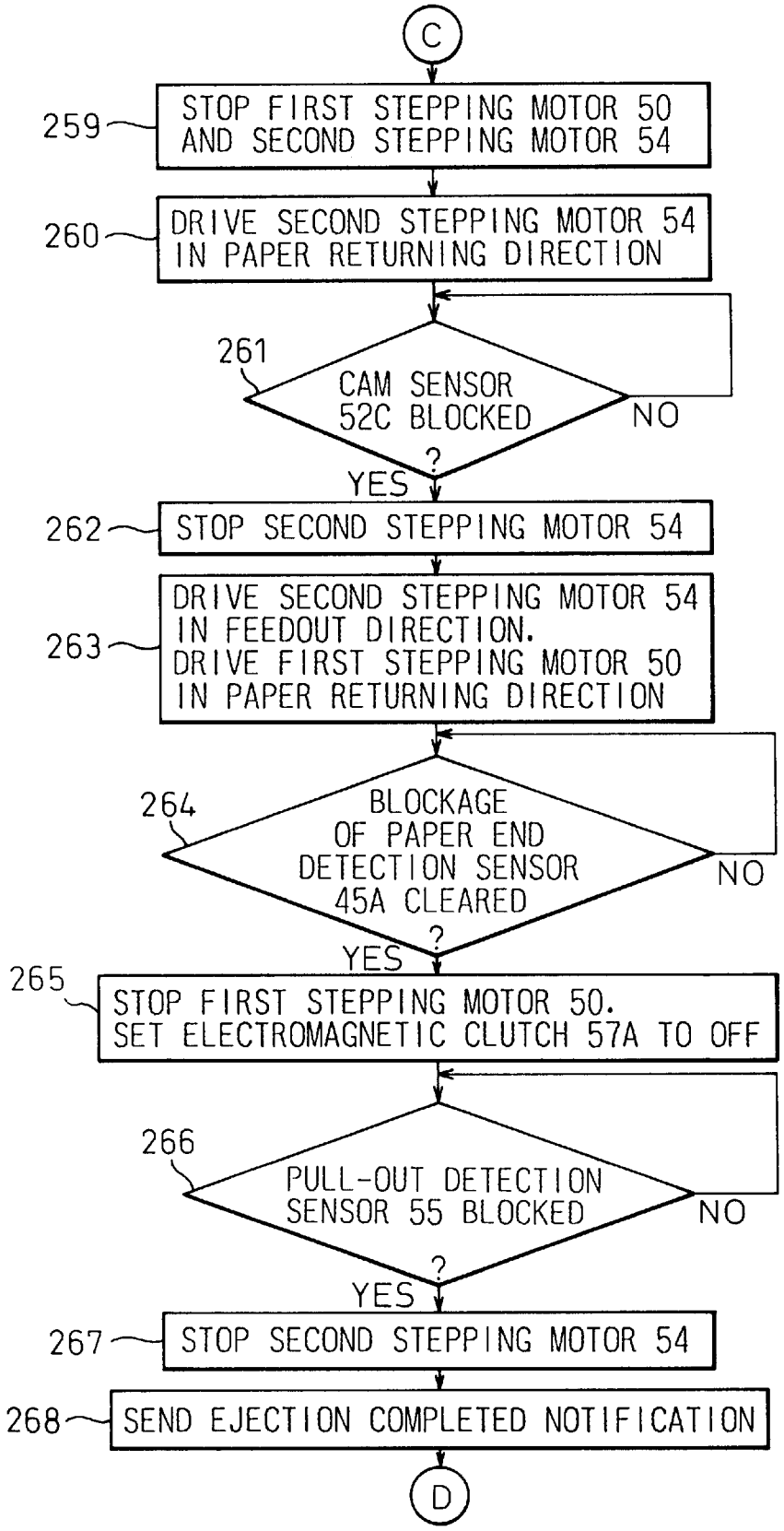
Figure 15D:
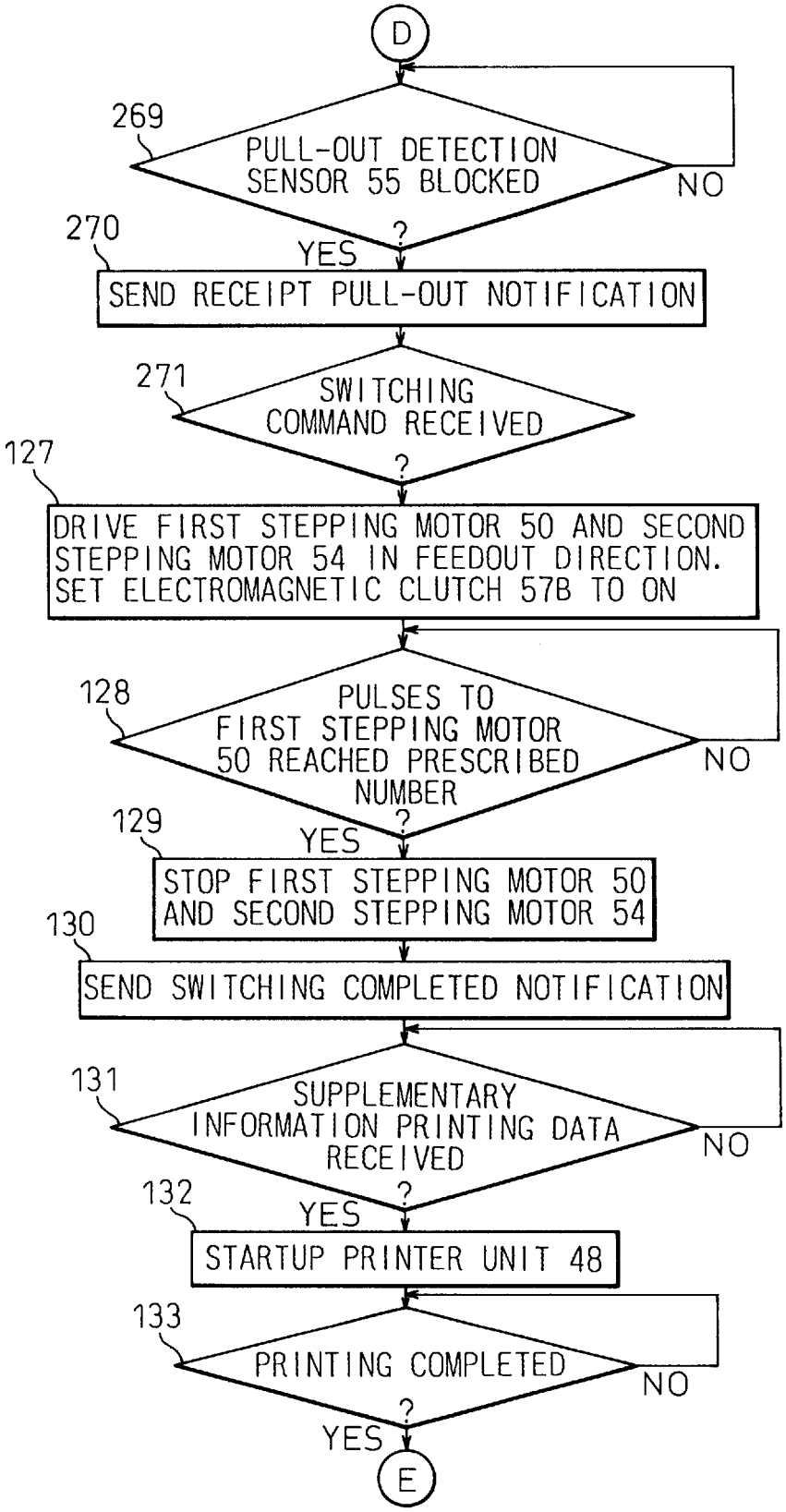
Figure 15E:
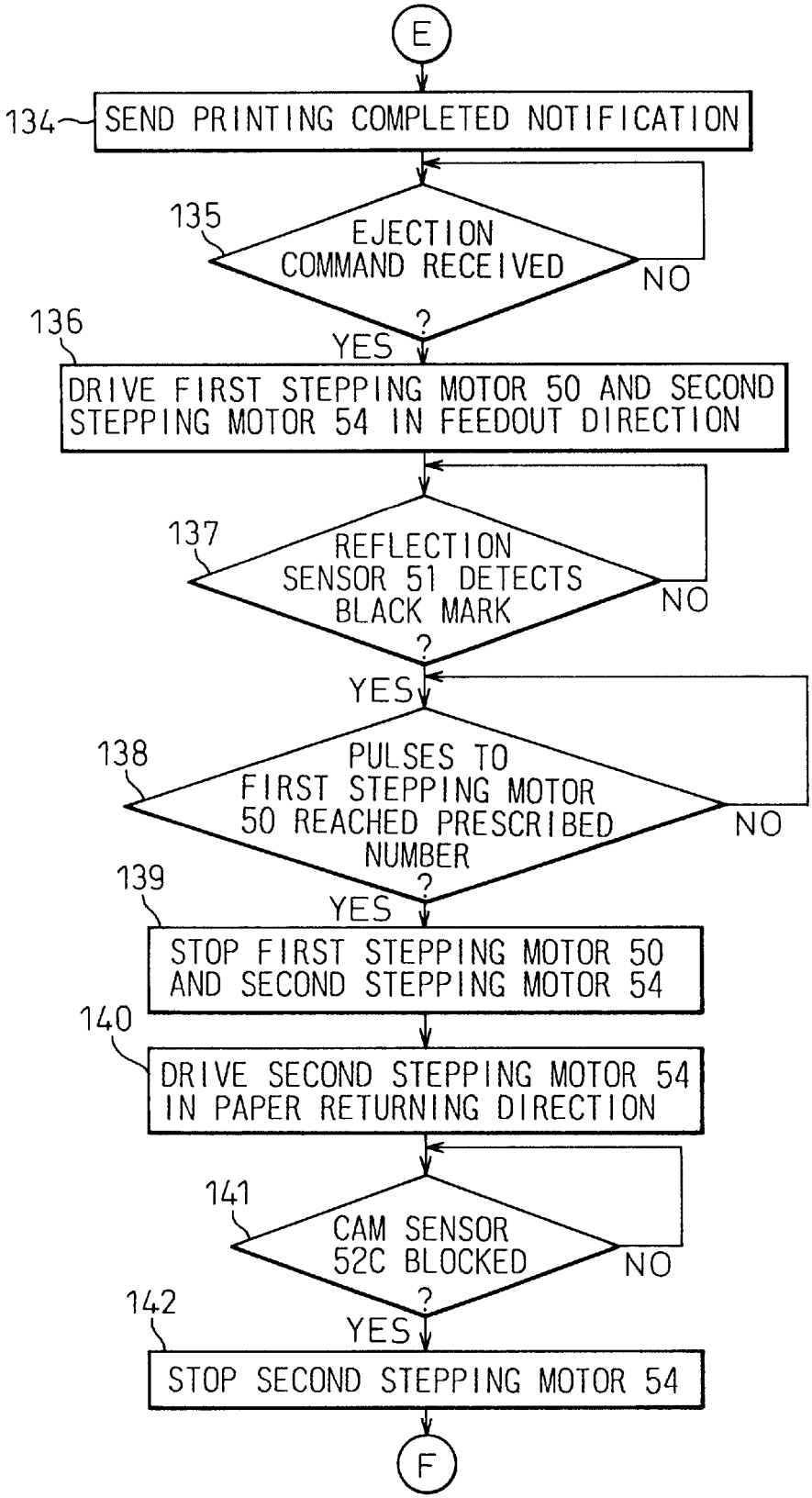
Figure 15F:
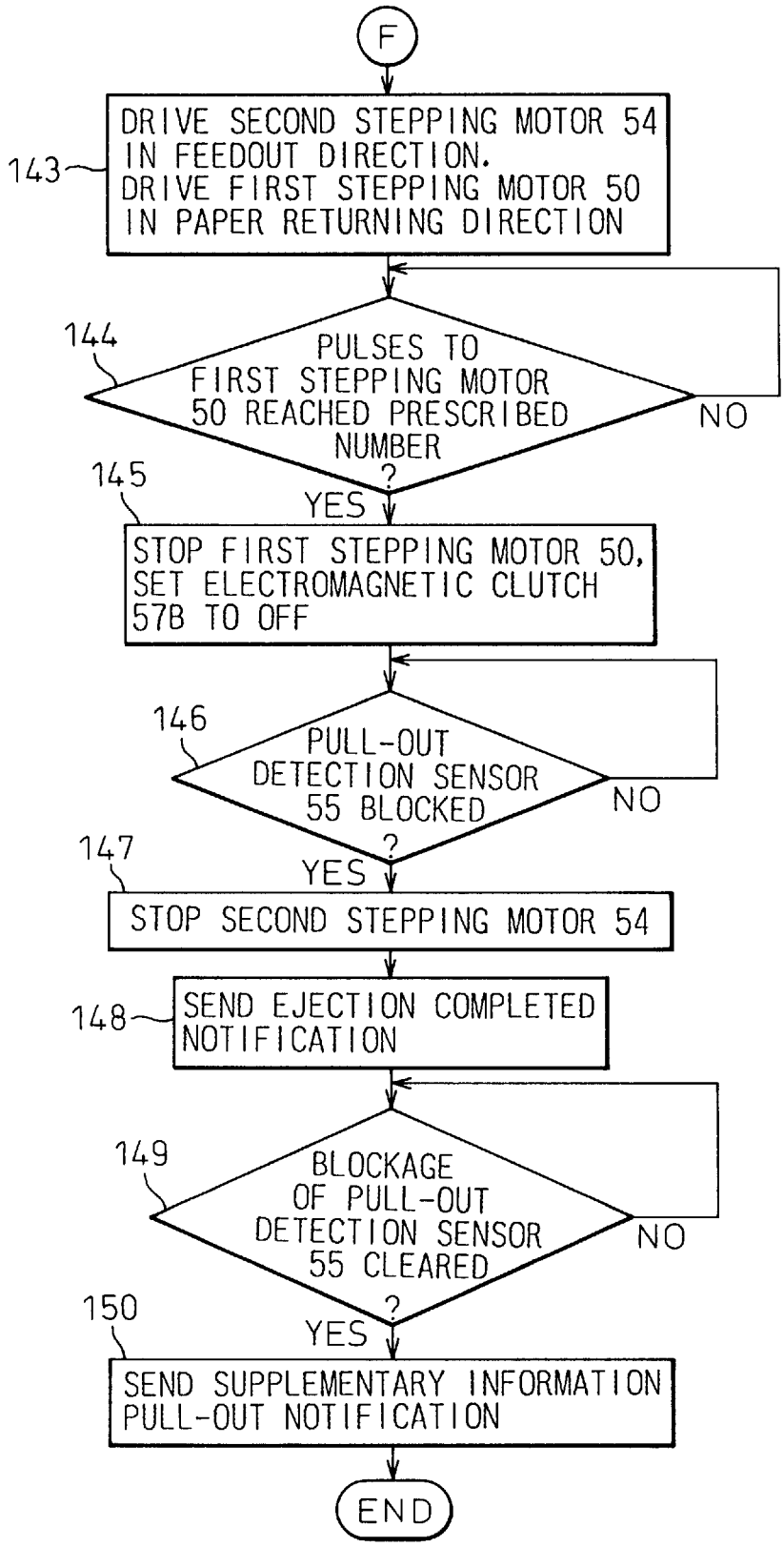

Next, the operation of the unit control section will be described, with reference made to FIGS. 13A to 13C.

First, when a paper setting status transfer command is received from the main control section 37 of the automated teller machine at step 121, the unit control section accesses memory to determine what type of medium was issued last.

If the last issued medium was a receipt, the paper at the position opposite the printing head 48A is from the receipt paper roll 41A, and if the last issued medium was supplementary information, the paper at the position opposite the printing head 48A is from the supplementary information paper roll 41B, the type of paper currently positioned opposite the printing head 48A being sent to the main control section 37 as paper setting status information at step 122.

After sending the paper setting status, when a switching command, that is, a command to perform the necessary switching with the supplementary information paper roll 41B because the receipt paper roll 41A is currently positioned opposite the printing head 48A, is sent from the main control section 37 at step 123, the unit control section drives the first stepping motor 50 in the paper returning direction, the electromagnetic clutch 57A provided on the paper feedout roller 46A is set to on at step 124, and the operation of returning the paper of the receipt paper roll 41A is started.

When the operation of returning the paper of the receipt paper roll 41A is performed, the paper end detection sensor which had been blocked until then by the paper from the receipt paper roll 41A, is unblocked when the end of the paper from the receipt paper roll 41A passes by it at step 125, the unit control section stopping the drive of the first stepping motor 50 at that point, the electromagnetic clutch 57A being set to off at step 126 and the operation of returning the paper from the receipt paper roll 41A is completed. That is, the end of the paper from the receipt paper roll 41A is returned to the position of the paper end detection sensor 45A which is provided further in the returning direction than the merging roller 47.

When the operation of returning the paper from the receipt paper roll 41A is completed, the unit control section performs control so that the end of the paper from the receipt paper roll 41A is transported to a position which is opposite the printing head 48A. That is, the unit control section drives the first stepping motor 50 and the second stepping motor 54 in the feedout direction, and turns on the electromagnetic clutch 57B which is provided on the paper feedout roller 46B at step 127 so as to feed out the paper from the supplementary information paper roll 41B.

After feeding out this paper, at the point at which a prescribed number of pulses have been sent to the first stepping motor 50 at step 128 (corresponding to feeding the end of the paper out to a position which is opposite the printing head 48A), the drive of the first stepping motor 50 and the second stepping motor 54 is stopped, thereby stopping the feedout at step 129, and notification that the paper roll which is set at the position opposite the printing head 48A was switched is sent to the main control section 37 at step 130, at which time the receive wait condition for supplementary information printing data is entered.

At step 123, in the case in which the supplementary information paper roll 41B is already positioned opposite the printing head 48A, no switching command is sent from the main control 37, the unit control section performs no switching operation, and the receive wait condition for supplementary information printing data is entered. When the supplementary information printing data is received at step 131, the unit control section starts the printer unit at step 132, causing it to print the received data onto the paper from the roll.

When printing supplementary information printing data, the unit control section causes this to be printed in a direction which is perpendicular to the paper feedout direction, and when printing receipt printing data, printing is performed in the direction of paper feedout. When the printing of the received printing data is completed at step 133, the unit control section sends a printing completed notification to the main control section 37 at step 134.

After the printing completed notification is sent, when an ejection command is received from the main control section 37 at step 135, the unit control section performs control so that the operations of cutting the paper and ejecting it are executed.

Specifically, the unit control section drives the first stepping motor 50 and the second stepping motor 54 in the direction of paper feedout at step 136, so as to feed out the paper from the supplementary information paper roll 41B and, based on the detection of the black mark applied to the paper from the roll by the reflection detection sensor 51 provided in the region near the cutter at step 137, the pulses to the first stepping motor 50 are counted, and when this reaches a prescribed number at step 138 (corresponding to the feed out of the black mark to a position opposite the cutter 52), the drive to the first stepping motor 50 and second stepping motor 54 is stopped at step 139, thereby temporarily stopping the feedout of the paper from the supplementary information paper roll 41B.

Then, in order to cause the cutter 52 to operate, the unit control section drives the second stepping motor 54 in the return direction at step 140. When the second stepping motor 54 is driven in the return direction, the cutter 52 operates by means of the action of the cam unidirectional clutch 54D, the drive pulley 53A for the purpose of driving the transport belt 53 does not rotate in the roll returning direction due to the action of the transport unidirectional clutch 54C.

Therefore, by driving the second stepping motor 54 in the return direction, the cutter is caused to perform a cutting operation, with the paper remaining stopped. When the second stepping motor 54 is driven in the return direction, the cam for the purpose of causing the cutter 52 to swing rotates, thereby blocking the cam sensor 52C at step 141.

When this happens, the unit control section judges that the cutting operation has been completed, and stops the drive to the second stepping motor 54 at step 142. Then, the unit control section performs control so that the cut piece of paper is transported to the ejection opening as the supplementary information, and so that the paper from the supplementary information paper roll 41B after being cut is returned to a position opposite the printing head 48A.

Specifically, the unit control section drives the second stepping motor 54 in the feedout direction so as to eject the cut piece of paper, and also drives the first stepping motor 50 in the paper returning direction so as to return the end of the paper from the supplementary information paper roll 41B step 143.

When this is done, the unit control section counts the pulses to the first stepping motor 50 and when they reach a prescribed number at step 144 (corresponding to the return of the end of the paper from the supplementary information paper roll 41B to the position opposite the printing head 48A), the drive to the first stepping motor 50 is stopped, and the electromagnetic clutch 57B is set to off at step 145.

By doing this, the end of the paper from the supplementary information paper roll 41B is stepped at the position which is opposite the printing head 48A.

Then, in response to the blocking of the pull-out detection sensor 55 by the piece of paper, that is, the supplementary information, which is transported by the second stepping motor 54 at step 146, the unit control section stops the second stepping motor 54 at step 147 and sends a pull-out completed notification to the main control section 37 at step 148.

When the blocking of the pull-out detection sensor 55 is cleared at step 149, a judgment is made that the customer has pulled out the supplementary information, the pull-out notification is sent to the main control section 37 at step 150, and processing is ended.

In the first embodiment mode, the customer selects issuing of supplementary information independently from a deposit or withdrawal, and such supplementary information is issued, so that it is possible to issue supplementary information on a paper separate from the receipts, even though the receipt issuing section and issuing mechanism are shared, thereby enabling an enhancement in the supplementary provided to the customer.

When issuing either a receipt or supplementary information from the receipt issuing section 36, the end of the paper from which the issuing is done is fed out to a position which is opposite the printing head 48A.

Therefore, in this case, after the issuing of supplementary information, the end of the paper from the supplementary information paper roll 41B is returned to a position which is opposite the printing head 48A, so as to be ready for the next transaction.

(5-2) The second embodiment mode

FIGS. 14A to 14D are flowcharts of the main control section 37 of an automated teller machine according to the second embodiment mode. The operation of the main control section 37 is completed by the operations shown in FIGS. 14A through 14D. FIGS. 15A to 15F are flowcharts of the unit control section of the receipt issuing section 36 of the second embodiment mode. The operation of the unit control section is completed by the operations shown in FIGS. 15A through 15F.

The second embodiment mode is described below, with reference made to FIGS. 14A through 15F. Note that FIGS. 14A through 14D explain the operation of issuing the supplementary information during the withdrawal transaction. First, the operation of the main control section 37 will be described, with reference made to FIGS. 14A to 14D.

When a card is inserted into the card insertion/ejection opening 22 of the automated teller machine by the customer at step 201, the main control section 37 displays on the display screen 21A a transaction selection screen at step 202.

If the customer selects a withdrawal transaction from the transaction selection screen, using the keyboard 21B at step 203, the main control section 37 displays on the display screen 21A a screen which requests input of a personal identification number.

When the personal identification number is input from the keyboard 21B at step 204, the main control section sends the customer information that is recorded on a magnetic stripe on the card and the input personal identification number to a center computer for verification of the proper identity of the customer at step 205.

As a result of a check performed at the center computer, if the personal identification number was found to be proper at step 206, a screen is displayed which asks the amount to be withdrawn at step 207.

After the withdrawal amount input screen appears, when the customer inputs the amount to be withdrawn, using the keyboard 21B at step 208, the main control section 37 sends a transaction approval request, which asks whether it is possible to withdraw the specified amount, to the center computer at step 209.

At the host computer, an approval judgment is made, based on the customer information that had been sent, and if it is possible to make the withdrawal transaction, the customer information is updated to the state it will become after the withdrawal, and a response indicating that the withdrawal is possible is sent to the main control section 37 of the automated teller machine.

When the main control section 37 receives the response that the withdrawal is possible at step 210, the paper currency counting section 33 feeds out the specified amount of paper currency and begins the operation of paying out the withdrawal at step 211.

After this withdrawal operation is begun, the main control section 37 causes a supplementary information issuing selection screen to be displayed on the display screen at step 212, thereby asking the customer whether supplementary information is to be issued.

When issuing of supplementary information is input by the customer via the keyboard 21B at step 213, the main control section 37 sends supplementary information transmission request to the center computer at step 214.

When the main control section 37 receives the supplementary information data from the center computer at step 215, it performs control so as to issue a receipt onto which is printed the particulars of the current transaction and the supplementary information, using the receipt issuing section 36.

Because, in contrast to the supplementary information which is only supplementary information, the receipt is proof that the withdrawal transaction was performed, the issuing sequence gives priority to the issuing of the receipt, the supplementary information being issued afterwards.

First, the main control section 37 sends a receipt issuing section 36 paper setting status transmission command to the receipt issuing section 36 at step 216.

When the paper setting status is received from the unit control section, the main control section 37 makes a determination of whether the paper which is currently fed out to a position opposite the printing head 48A is the appropriate one, that is, a determination of whether the paper is from the receipt paper roll 41A at step 217, and if this paper setting status indicates that paper from the supplementary information paper roll 41B is currently fed out to a position opposite the printing head 48A, it sends a paper switching command step 218. After receiving the paper switching completed notification, from the unit control section at step 219, the receipt printing data is sent to the unit control section at step 220 and the printing operation is started at step 220.

If at step 217 the paper currently fed out to the position opposite the printing head 48A was paper from the receipt paper roll 41A, the main control section 37 sends the receipt printing data to the unit control section and starts the printing operation at step 220 without sending a paper switching command.

When the main control section 37 receives a printing completed notification from the unit control section at step 221, a command is sent to the unit control section to cut and eject the printed paper part step 222.

In response to this ejection command, the unit control section of the receipt issuing section 36 causes execution of the ejection of the cut piece of paper. If the end of the paper from the roll after this cutting operation is not returned, however, switching becomes complex in the case in which the next issuing operation is for supplementary information.

Because of this, when an issuing operation of supplementary information is done when performing a withdrawal transaction or a deposit transaction, a command which causes a return of the end of the paper from the receipt paper roll 41A to the paper end detection sensor 45A is included with the ejection command sent at step 222.

When the ejection completed notification is received at step 223, the main control section 37 waits for the customer to pull out the cut piece of paper, that is, the receipt, and at the point at which the pull-out notification is received from the unit control section at step 224, it performs controls so as to issue supplementary information.

After step 224, the operation as explained at steps 112 to 117 is executed. That is, the main control section 37 sends a paper switching command at step 112 to the unit control section so as to feed out the paper of the supplementary information paper roll 41B to the position opposite the printing head 48A.

When the paper switching completed notification is received from the main control section 37 at step 113, the main control section 37 supplementary information printing data to the unit control section, and starts the printing operation at step 111.

When the main control section 37 receives the printing completed notification from the unit control section at step 114, it sends a command to the unit control section so as to cut the printed part and eject it at step 115. When the ejection completed notification is received from the unit control section at step 116, the main control section waits for the customer to pull out the piece of paper, that is, the supplementary information, and when it receives a paper pull-out notification from the unit control section at step 117, it verifies that the withdrawal operation has been completed, and ends the processing at step 225.

Next, the operation of the unit control section will be described, with reference made to FIGS. 15A through 15F.

First, when a paper setting transmission command is received from the main control section 37 of the automated teller machine at step 241, the unit control section accesses memory to determine the last issued paper, and sends to the main control section 37 the type of roll paper that is currently fed out to a position opposite the printing head 48A as the paper setting status at step 242.

After sending the paper setting status, when a switching command, that is, a command to perform the necessary switching with the receipt paper roll 41A because the supplementary information paper roll 41B is currently positioned opposite the printing head 48A, is sent from the main control section 37 at step 243, the unit control section drives the first stepping motor 50 in the paper returning direction, the electromagnetic clutch 57B provided on the paper feed-out roller 46B is set to on at step 244, and the operation of returning the paper of the receipt paper roll 41B is started.

At this point, the unit control section counts the pulses sent to the first stepping motor 50, and at the point at which a prescribed number of pulses is reached at step 245 (corresponding to the distance at which the end of the paper from the supplementary information paper roll 41B is from the merging roller 47), it stops the drive to the first stepping motor 50 and sets the electromagnetic clutch 57B to off at step 246, thereby completing the return of the paper from the supplementary information paper roll 41B.

Specifically, the end of the paper from the supplementary information paper roll 41B is returned to a position at which it does not hinder the feedout of the paper from the receipt paper roll 41A.

When the return of the paper from the supplementary information paper roll 41B is completed, the unit control section performs control so that the end of the paper from the receipt paper roll 41A is returned to the position opposite the printing head 48A.

Specifically, the unit control section drives the first stepping motor 50 and the second stepping motor 54 in the direction of paper feedout, and sets the electromagnetic clutch 57A which is provided on the paper feedout roller 46A to on at step 247, thereby feeding out the paper from the receipt paper roll 41A.

After performing this feedout operation, at the point at which the number of pulses to the first stepping motor 50 reaches a prescribed number at step 248 (corresponding to feedout until the end of the paper from the receipt paper roll 41A is at the position opposite the printing head 48A), the drive to the first stepping motor 50 and the second stepping motor 54 is stopped, thereby stopping the feedout at step 249, the fact that the roll of paper whose end is positioned opposite the printing head 48A has been switched is sent to the main control section 37 at step 250, at which time the receive wait condition for receipt printing data is entered.

If at step 243 the paper which was fed out so as to have its end positioned opposite the printing head 48A was the paper from the receipt paper roll 41A, the main control section 37 simply waits for printing data, without the main control section 37 sending a switching command and without the unit control section performing the switching operation.

When the receipt printing data is received at step 251, the unit control section starts up the printer unit 48 at step 252, causing the received data to be printed on the paper from the receipt paper roll 41A.

When the printing of the received data is completed at step 253, the unit control section sends a receipt printing completed notification to the main control section 37 at step 254.

After the printing completed notification is sent, when an ejection command is received from the main control section 37 at step 25, the unit control section performs control so as to executed cutting and ejection of the printed part of the paper from the receipt paper roll 41A, and return of the paper from the receipt paper roll 41A.

In consideration of the next supplementary information to be issued, the ejection command received by the unit control section from the main control section 37 includes a command which causes transport of the end of the paper from the receipt paper roll 41A to the position of the paper end detection sensor 45A, that is, to a position which is at a distance from the merging roller 47.

Specifically, the unit control section drives the first stepping motor 50 and the second stepping motor 54 in the paper feedout direction at step 256, thereby feeding out the paper from the receipt paper roll 41A, and according to the detection, by the reflection sensor 51 provided near the cutter 52, of the black mark applied to the paper at step 257, the number of pulses to the first stepping motor 50 are counted. When the number of pulses reaches a prescribed number at step 258 (corresponding to feedout to a point at which the black mark is positioned opposite the cutter 52), the drive to the first stepping motor 50 and the second stepping motor 54 is stopped at step 259, thereby temporarily stopping the feedout of paper from the receipt paper roll 41A.

Next, the unit control section causes the second stepping motor 54 to be driven in the return direction at step 260 to cause the cutter 52 to perform a cutting operation.

When the second stepping motor 54 is driven in the returning direction, while the cutter 52 performs a cutting operation by the action of the cam unidirectional clutch 54D, the action of the transport unidirectional clutch 54C keeps the drive pulley 53A for the purpose of driving the transport belt 53 from turning in the returning direction.

Therefore, by driving the second stepping motor 54 in the returning direction, it is possible to have the cutter 52 perform the cutting operation with the paper in the stopped condition.

When the second stepping motor 54 is driven in the returning direction, the cam 52B for the purpose of causing the cutter 52 to swing turns one rotation, thereby blocking the cam sensor 52C at step 261.

When this happens, the unit control section judges that the cutting operation has been completed, whereupon it stops the second stepping motor 54 at step 262.

Next, the unit control section performs control so that the cut piece of paper is transported to the ejection opening as the receipt, and so that the end of the paper from the receipt paper roll 41A is returned to a point that is at a distance from the merging roller 47.

Specifically, the unit control section drives the second stepping motor 54 in the paper feedout direction and also drives the first stepping motor 50 in the paper returning direction so as to return the end of the paper from the receipt paper roll 41A at step 263.

When the blockage of the paper end detection sensor 45A by the paper from the receipt paper roll 41A is cleared, that is, when the end of the paper from the receipt paper roll 41A passes by the paper end detection sensor 45 at step 264, the unit control section stops the first stepping motor 50 and sets the electromagnetic clutch 57A to off at step 265.

Next, based on the transport by the second stepping motor 54 of the cut piece of paper, that is, the receipt, past the pull-out detection sensor 55 which is provided near the ejection opening at step 266, the unit control section stops the second stepping motor 54 at step 267, and sends an ejection completed notification to the main control section 37 at step 268.

When the blockage of the pull-out detection sensor 55 is cleared at step 269, it is judged that the customer has pulled out the receipt, whereupon notification of the pulling out of the receipt is sent to the main control section 37 at step 270.

The above completes the receipt issuing operation, after which the unit control section performs control so as to issue supplementary information.

Specifically, when a paper switching command is received from the main control section 37 at step 271, the same steps 127 to 150 as explained before are executed. That is, the unit control section drives the first stepping motor 50 and the second stepping motor 54 in the paper feedout direction, and sets the electromagnetic clutch 57B, which is provided on the paper feedout roller 46B, to on at step 127, thereby feeding out paper from the supplementary information paper roll 41B.

After this feedout operation, when the number of pulses to the first stepping motor 50 reaches a prescribed number at step 128 (corresponding to feedout to a position at which the end of the paper from the receipt paper roll 41A is opposite the printing head 48A), the drive to the first stepping motor 50 and the second stepping motor 54 is stopped at step 129, and notification of the fact that the paper set to be opposite the printing head 48A has been switched is sent to the main control section 37 at step 130, at which time the receive wait condition for supplementary information printing data is entered.

When supplementary information printing data is received at step 131, the unit control section starts up the printer unit 48 at step 132, causing it to print the received supplementary information data onto the paper from the supplementary information paper roll 41B.

When the printing of the supplementary information printing data is completed at step 133, the unit control section sends a supplementary information printing completed notification to the main control section 37 at step 134.

After notification of the completion of printing, when an ejection command is received from the main control section 37 at step 135, the unit control section performs control so as to execute the cutting of the paper from the supplementary information paper roll 41B, the ejection of the cut piece of paper, and the return of the paper from the supplementary information paper roll 41B.

Specifically, the unit control section drives the first stepping motor 50 and the second stepping motor 54 in the paper feed direction at step 136, thereby feeding out paper from the supplementary information paper roll 41B. Based on the detection, by the reflection sensor 51 which is provided near the cutter 52, of the black mark applied to the paper at step 137, the number of pulses to the first stepping motor 50 is counted, and when the number reaches a prescribed number at step 138 (corresponding to feedout to a point at which the black mark is at a position opposite the cutter 52), the drive to the first stepping motor 50 and the second stepping motor 54 is stopped at step 139, thereby temporarily stopping the feedout of the paper from the supplementary information paper roll 41B.

Next, the unit control section drives the second stepping motor 54 in the paper returning direction, so as to cause the cutter 52 to operate at step 140.

When the second stepping motor 54 is driven in the paper returning direction, the cam 52B for the purpose of causing the cutter 52 to swing turns one rotation, thereby blocking the cam sensor 52C at step 141.

When this happens, the unit control section makes the judgment that the cutting operation has been completed, whereupon it stops the second stepping motor 54 at step 142.

Next, the unit control section performs control so as to transport the cut piece of paper to the ejection opening as the supplementary information, and also so as to return the paper from the supplementary information paper roll 41B so that the end of the paper is opposite the printing head 48A.

Specifically, the unit control section drives the second stepping motor 54 in the paper feedout direction so as to eject the cut piece of paper, and also drives the first stepping motor 50 so as to return the end of the paper from the supplementary information paper roll 41B at step 143.

At this point the unit control section counts the pulses to the first stepping motor 50, and when a prescribed number of pulses is reached at step 144 (corresponding to return of the paper from the supplementary information paper roll 41B so that the end of the paper is opposite the printing head 48A), it stops the drive to the first stepping motor 50 and sets the electromagnetic clutch 57B to off at step 145.

Next, based on the blockage of the pull-out detection sensor 55 provided near the ejection opening by the piece of paper, that is, by the supplementary information which is transported by the second stepping motor 54, the unit control section stops the second stepping motor 54 at step 147 and sends an ejection completed notification to the main control section 37 at step 148.

Then, when the blockage of the pull-out detection sensor 55 is cleared at step 149, a judgment is made that the customer has pulled out the supplementary information, whereupon notification of the pull-out of the supplementary information is sent to the main control section 37 at step 149, and processing is terminated.

The second embodiment mode enables the issuing of supplementary information along with deposit and withdrawal transactions, thereby eliminating the need to operate the automated teller machine once again to issue supplementary information.

Furthermore, in the case in which the supplementary information is a history of past transactions, it is possible to combine this with the history of the current withdrawal or deposit transaction, thereby further enhancing the supplementary information provided to the customer.

(5-3) The third embodiment mode

Figure 16A:
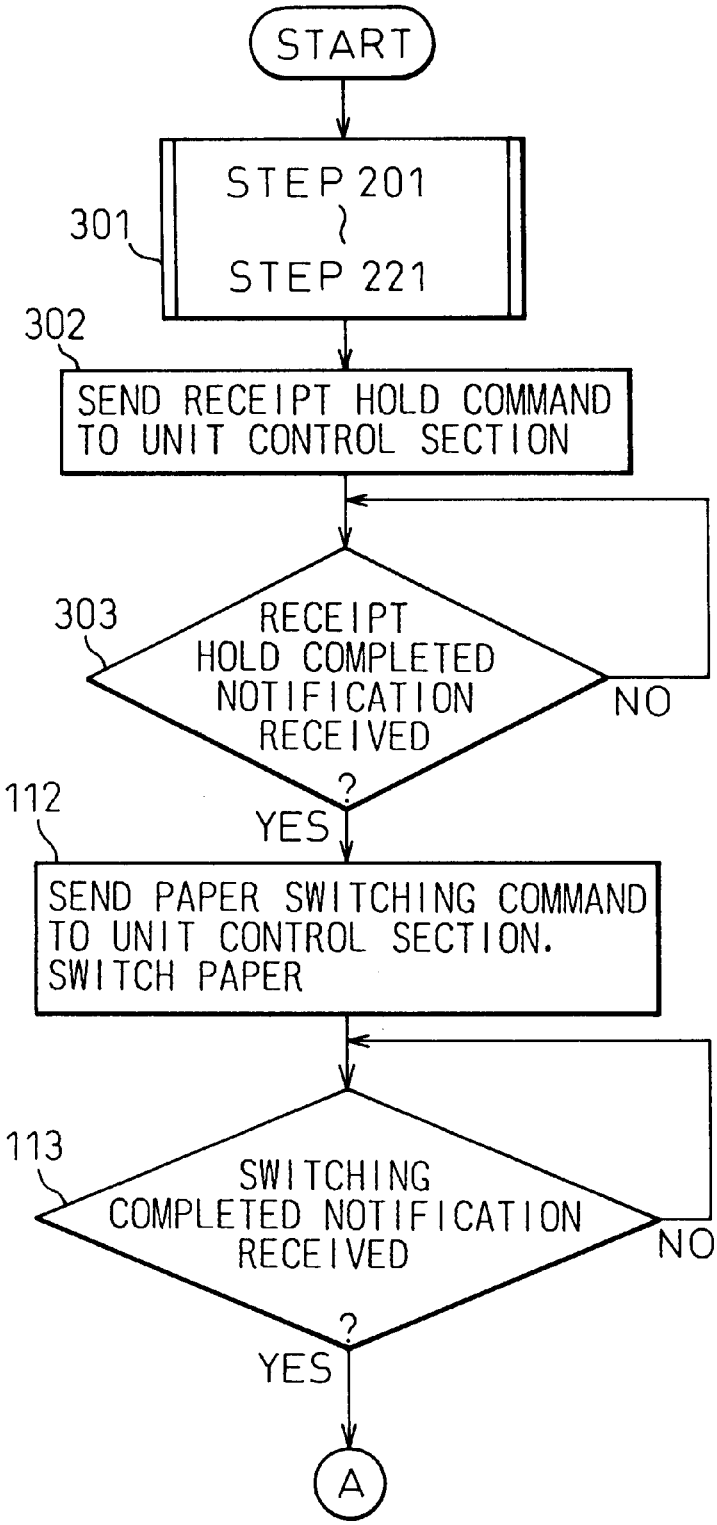
FIGS. 16A and 16B are flowcharts showing the operation of the main control section of an automated teller machine of the third mode of an embodiment of the present invention.
Figure 16B:
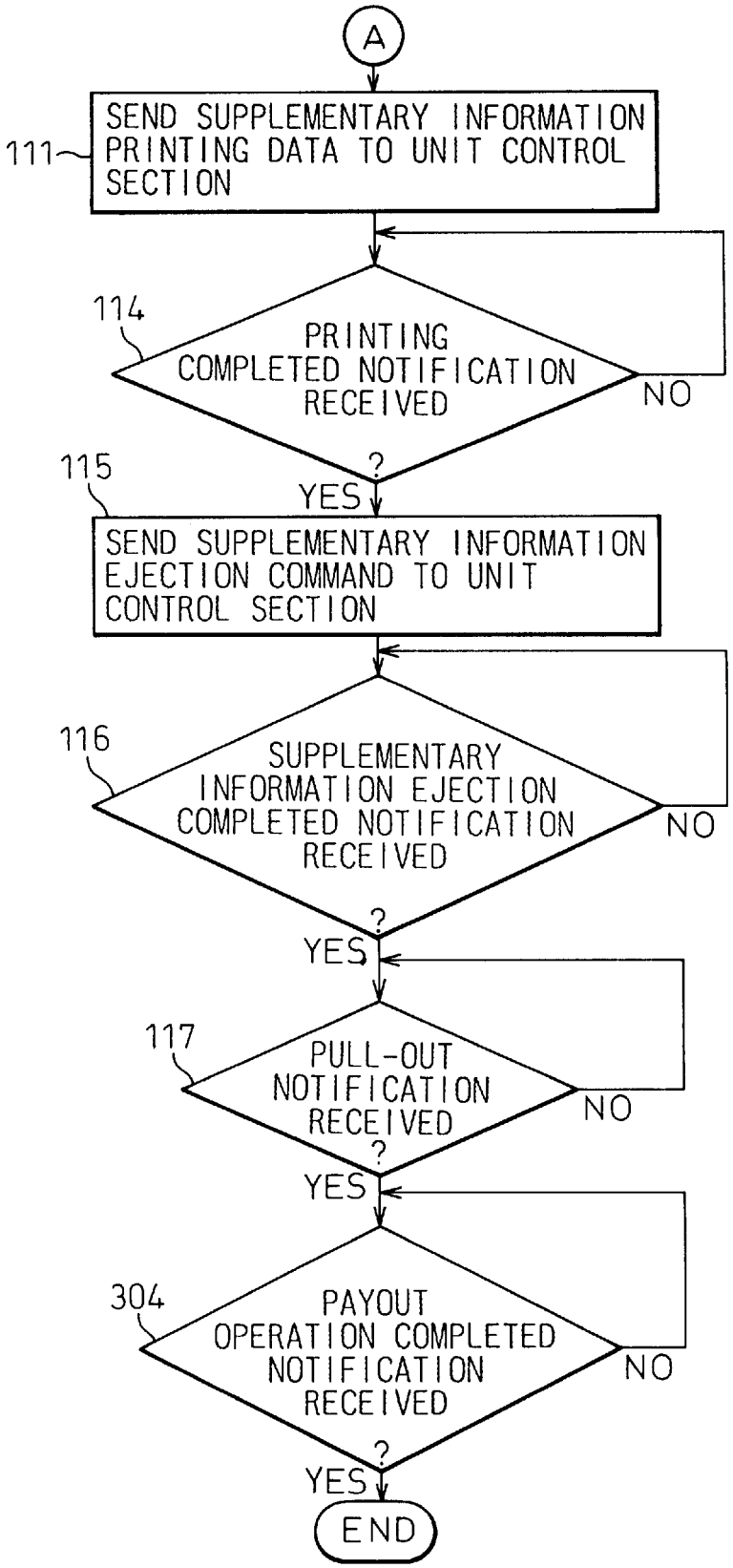
Figure 17A:
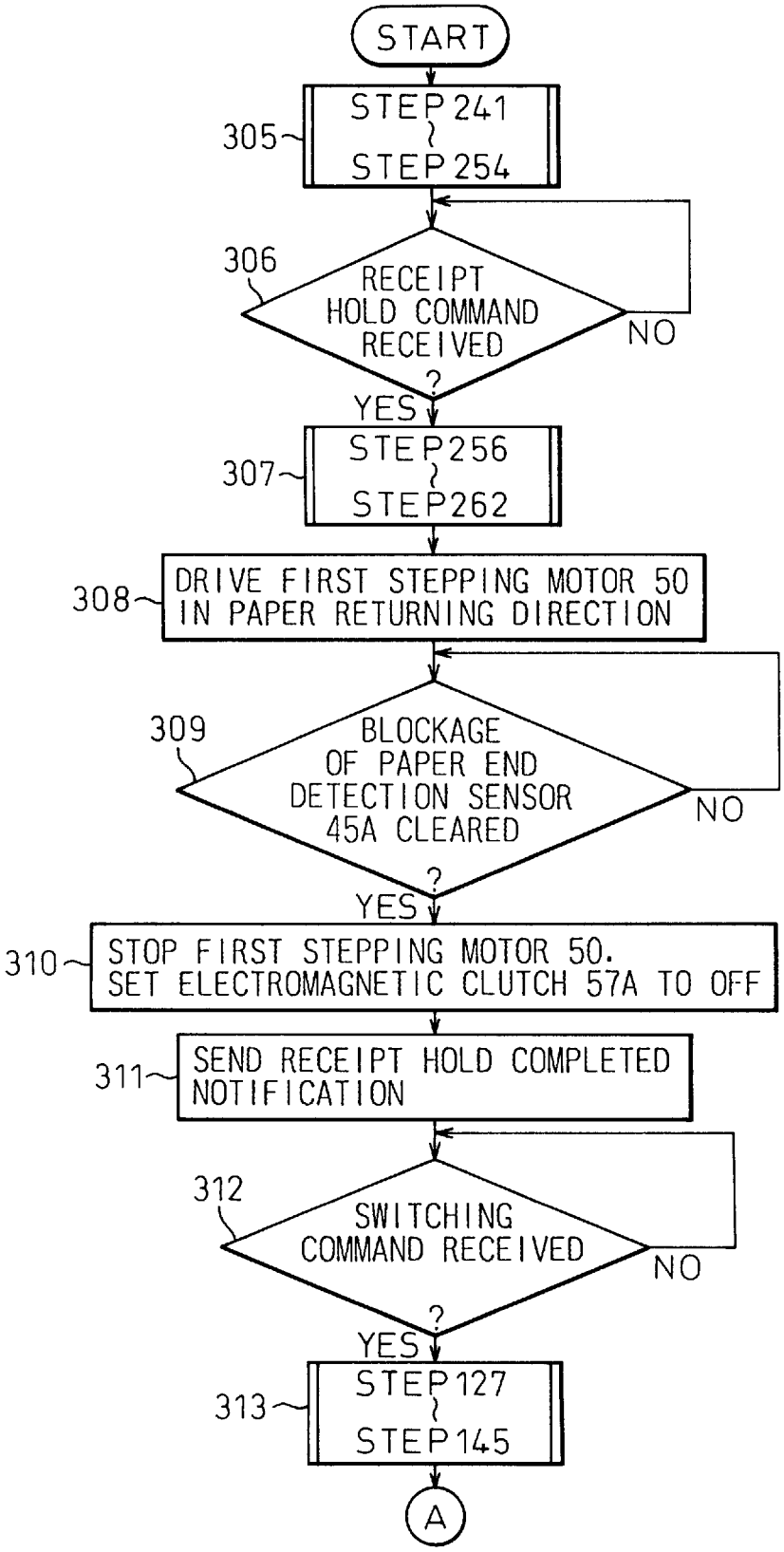
FIGS. 17A and 17B are flowcharts showing the operation of the unit control section of the receipt issuing section of an automated teller machine of the third mode of an embodiment of the present invention.
Figure 17B:
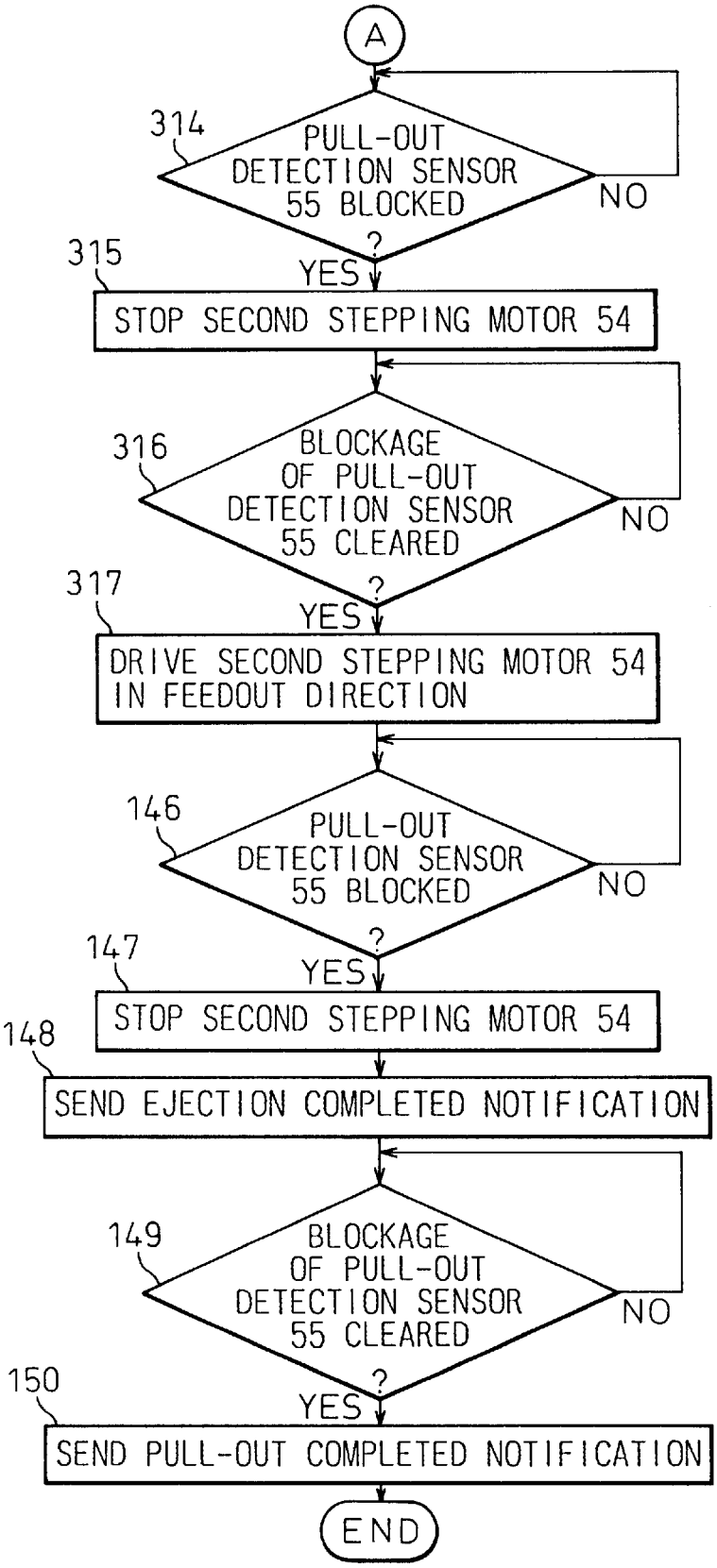

FIGS. 16A and 16B are flowcharts of the main control section 37 of an automated teller machine according to the third embodiment mode. FIGS. 17A and 17B are flowcharts of the unit control section of the receipt issuing section 36 of the third embodiment mode. The third embodiment mode is described below, with reference made to FIGS. 16A through 17B. FIGS. 16A through 17B illustrate the operation occurring when issuing supplementary information during a withdrawal operation.

First, the operation of the main control section 37 will be described, with reference made to FIGS. 16A and 16B. In the third embodiment mode, steps 201 through 221 are executed in the same manner as described in the second embodiment mode at step 301. Specifically, when performing the operation of making a payout of money in response to a customer request for a withdrawal, if the issuing of supplementary information is selected, after the receipt is printed by the receipt issuing section 36, a receipt printing completed notification is received.

When the receipt printing completed notification is received at step 221, the main control section 37 sends a command to the unit control section to cut and hold the printed part at step 302. Based on this hold command, the unit control section of the receipt issuing section executes the operations of cutting and returning the end of the paper from the receipt paper roll 41A, the cut piece of paper being held, rather than ejected immediately. This is so that the supplementary information, which is issued next, can be ejected simultaneously with the receipt.

When a hold completed notification is received from the unit control section at step 303, the main control section 37 performs control so as perform the next issuing, that of supplementary information. The following operation is the same as the first embodiment mode, so that the same operations are assigned the same step numbers as explained in the first embodiment mode. Specifically, the main control section 37 sends to the unit control section a paper switching command at step 112 for the purpose of feeding the end of the paper of the supplementary information paper roll 41B so that it is positioned opposite the printing head 48A.

When the paper switching completed notification is received from the unit control section at step 113, the main control section 37 sends supplementary information printing data to the unit control section to start the printing operation at step 111. When a printing completed notification is received from the unit control section at step 114, the main control section 37 sends commands to the unit control section at step 115 so as to cut the printed part and eject it together with the receipt that had been held.

When an ejection completed notification is received from the unit control section at step 116, the main control section 37 goes into the condition of waiting for pull-out of the receipt and supplementary information by the customer, and when a pull-out notification is received from the unit control section at step 117 and when the end of the transaction is verified, that is, when the payout operation completed notification is received at step 304, processing is ended.

Next, the operation of the unit control section will be described, with reference being made to FIGS. 17A and 17B. In the third embodiment mode, the same steps 241 through 254 as explained in the second embodiment mode are executed at step 305. Specifically, a command is received from the main control section 37, the unit control section feeds out paper from the receipt paper roll 41A, the received receipt printing data is caused to be printed by the printer unit 48, and when the printing is completed, a printing completed notification is sent to the main control section 37.

After sending of the printing completed notification, when a receipt hold command is received from the main control section 37 at step 306, the same operation as explained in the second embodiment mode by steps 256 through 262 are executed. That is, the unit control section performs control so as to execute the operations of cutting the paper from the receipt paper roll 41A, holding the cut piece of paper, and returning the paper from the receipt paper roll 41A. At this point, in consideration of issuing of supplementary information next, the hold commands received by the unit control section from the main control section 37 include commands which, after the cutting by the cutting, cause the transport of the end of the paper from the receipt paper roll 41A to the position of the paper end sensor 45A, that is, to a position which is at a distance from the merging roller 47.

As the unit control section drives the first stepping motor 50 and the second stepping motor 54 in the paper feed direction (step 256), thereby feeding out the paper from the receipt paper roll 41A, based on the detection by the reflection sensor 51, which is provided near the cutter, of the black mark applied to paper (step 257), the number of pulses to the first stepping motor 50 is counted, and when this reaches a prescribed number (corresponding to feedout of the paper so that the black mark is at a position opposite the cutter 52; step 258), the first stepping motor 50 and the second stepping motor 54 drive is stopped (step 259), thereby temporarily stopping the feedout of paper from the receipt paper roll 41A.

Next, the unit control section drives the second stepping motor 54 in the paper returning direction, so as to cause the cutter 52 to operate (step 260). When the second stepping motor 54 is driven in the paper returning direction, the cam 52B for the purpose of causing the cutter 52 to swing turns one rotation, thereby blocking the cam sensor 52C (step 261). When this happens, the unit control section judges that the cutting operation has been completed, whereupon it stops the drive to the second stepping motor 54 (step 262).

Next, the unit control section leaves the cut piece of paper as is, and performs control so as to return the end of the paper from the receipt paper roll 41A to a position which is at a distance from the merging roller 47. Specifically, the unit control section drives the first stepping motor 50 in the paper returning direction so as to return the end of the paper from the receipt paper roll 41A at step 308, but does not drive the second stepping motor 54, so that the receipt which was cut by the cutter 52 is held at the cutting position.

When the blockage of the paper end detection sensor 45A by the paper from the receipt paper roll 41A is cleared at step 309, that is, as the end of the paper from the receipt paper roll 41A passes by the paper end detection sensor 45A, the unit control section stops the drive to the first stepping motor 50, sets the electromagnetic clutch 57A to off at step 310, and sends a receipt hold completed notification to the main control section 37 at step 311.

Next, the unit control section performs control for the purpose of issuing supplementary information. Specifically, when a paper switching command is received from the main control section 37 at step 312, the unit control section drives the first stepping motor 50 and the second stepping motor 54 in the same manner as explained in the first embodiment mode by steps 127 through 145 at step 313.

That is, the unit control section drives the first stepping motor 50 and the second stepping motor 54 in the paper feedout direction, and sets the electromagnetic clutch 57B, which is provided on the paper feedout roller 46B to on (step 127), thereby feeding out paper from the supplementary information paper roll 41B.

By driving the second stepping motor 54, the receipt which was being held at the cutting position is transported by the transport belt 53, but because the distance from the cutter 52 to the ejection opening is insufficient in comparison to the distance from the merging roller 47 to the cutter 52, the receipt does not reach the ejection opening.

After feedout, when the number of pulses to the first stepping motor 50 reaches a prescribed number (corresponding to feedout of the end of the paper from the receipt paper roll 41A to a position opposite the printing head 48A; step 128), the drive to the first stepping motor 50 and the second stepping motor 54 is stopped (step 129), and the fact that the paper which is set at the position opposite the printing head 48A has been switched is sent to the main control section 37 (step 130), at which time the receive wait condition for supplementary information printing data is entered.

When the supplementary information printing data is received (step 131), the unit control section starts up the printer unit 48 (step 132), causing the received data to be printed on the paper from the supplementary information paper roll 41B. When the printing of the received supplementary information printing data is completed (step 133), the unit control section sends a supplementary information printing completed notification to the main control section 37 (step 134).

After sending the printing completed notification, when an ejection command is received from the main control section 37 (step 135), the unit control section performs control so as to execute the operations of cutting and ejecting the paper from the supplementary information paper roll 41B, and returning the paper from the supplementary information paper roll 41B.

Specifically, the unit control section drives the first stepping motor 50 and the second stepping motor 54 in the paper feedout direction (step 136) so as to feed out the paper from the supplementary information paper roll 41B, and based on the detection by the reflection sensor 51, which is provided near the cutter, of the black mark applied to paper (step 137), the number of pulses to the first stepping motor 50 is counted, and when this reaches a prescribed number (corresponding to feedout of the paper to that the black mark is at a position opposite the cutter 52; step 138), the first stepping motor 50 and the second stepping motor 54 drive are stopped (step 139), thereby temporarily stopping the feedout of paper from the supplementary information paper roll 41B.

Next, the unit control section drives the second stepping motor 54 in the paper returning direction, so as to cause the cutter 52 to operate (step 140). When the second stepping motor 54 is driven in the paper returning direction, the cam 52B for the purpose of causing the cutter 52 to swing turns one rotation, thereby blocking the cam sensor 52C (step 141). When this happens, the unit control section judges that the cutting operation has been completed, whereupon it stops the drive to the second stepping motor 54 (step 142).

Next, the unit control section preforms control so as to transport the receipt and the supplementary information which have been cut to the ejection opening, and so as to return the end of the paper form the supplementary information paper roll 41B, which had been cut to a position opposite the printing head 48A. Specifically, the unit control section drives the second stepping motor 54 in the paper feedout direction so as to eject the cut piece of paper, and also drives the first stepping motor 50 in the paper returning direction so as to return the end of the paper from the supplementary information paper roll 41B (step 143).

The unit control section counts the number of pulses to the first stepping motor 50, and when it reaches a prescribed number (corresponding to return of the end of the paper from the supplementary information paper roll 41B to a position opposite the printing head 48A; step 144), it stops the drive to the first stepping motor 50 and sets the electromagnetic clutch 57B to off (step 145). By driving the first stepping motor 50 in the paper returning direction and driving the second stepping motor 54 in the paper feedout direction, the supplementary information is transported to the ejection opening together with the receipt, which had already been held on the transport belt.

These two medium arrive at the ejection opening in the sequence of the receipt followed by the supplementary information, and the unit control section first, based on the blocking of the pull-out detection sensor 55 at step 313, provided near the ejection opening, by the transported receipt, stops the second stepping motor 54 at a step 315. Then, when the blockage of the pull-out detection sensor 55 is cleared at step 316, the judgment is made that the customer has pulled out the receipt, at which point the second stepping motor 54 is again driven in the paper feedout direction at step 317, thereby transporting the supplementary information to the ejection opening.

When the thus transported supplementary information blocks the pull-out detection sensor 55, which is provided near the ejection opening at step 146, the unit control section stops the second stepping motor 54 at step 147, and sends a supplementary information ejection completed notification to the main control section 37 at step 148.

Then, when the blockage of the pull-out detection sensor 55 is cleared at step 149, the judgment is made that the customer has pulled out the supplementary information, at which point a supplementary information pull-out completed notification is sent to the main control section 37 at step 150), which completes the processing.

In the third embodiment mode is the case in which issuing of supplementary information is specified in addition a transaction such as a deposit or a withdrawal, the receipt and the supplementary information are ejected to the customer with the same timing.

By doing this, the time between the ejection of the receipt and the ejection of the supplementary information is shortened, thereby preventing the customer from becoming annoyed and from forgetting to take the supplementary information.

In the embodiment of the present invention as described in detail above, while the customer's transaction history or promotional information for the financial institution is issued as the supplementary information, it is also possible to store a paper roll for the purpose of payment instruments such as checks or travelers checks, the required items being printed onto the paper in response to a selection made by the customer.

When issuing such payment instruments, a selection is made, for example, of whether or not to pay out a deposit using such an instrument, the instrument being issued together with the receipt, thereby providing enhanced supplementary information to the customer.

Additionally, it is possible to store a paper roll for the purpose of a journal into the receipt issuing section of the automated teller machine of this embodiment, and to perform journal printing using a common printing head, thereby further improving the compactness of the automated teller machine.

What is claimed is:

1. A medium issuing apparatus operated by an operator for issuing a first medium and a second medium on which first and second information are printed respectively, comprising:

a plurality of medium holding means each of which holds a medium respectively;

a plurality of medium drive means each of which performs feedout or return drive of said medium respectively;

common printing means which performs printing onto said medium which is fed out by said medium drive means from each of said medium holding means;

common cutting means which cuts said medium fed out from each of said medium holding means to a prescribed length;

common transport means which transports pieces of said medium cut from each of media by said common cutting means;

control means for controlling each of said means mutually; and a common ejection opening which ejects said cut pieces of medium which are transported by said common transport means, wherein said first information is information relating to only a present transaction and has a fixed form; and said second information is information relating to all purposes other than that of said first information and includes various types of data having no fixed form.

2. A medium issuing apparatus according to claim 1, wherein said control means drives said common printing means to print said first information onto said first medium based on the transportation of said first medium to said printing means, and drives said common printing means to print said second information onto said second medium based on the transportation of said second medium to said printing means.

3. A medium issuing apparatus according to claim 1, wherein said control means drives said common cutting means to cut one of said medium on which one of said information is printed by said common printing means, and drives said cut piece of medium to be ejected from said common ejection opening via said common transport means, after which said control means drives said medium drive means to return the end of the medium to the side of said medium holding means via said common printing means, and further said control means drives said drive means to feedout another medium, drives said common printing means to print another information, drives said common cutting means to cut another medium, and after which said control means drives said common transport means to eject another piece of medium to a common ejection opening.

4. A medium issuing apparatus according to claim 1, wherein said control means drives said common cutting means to cut one of said medium on which one of said information is printed by said common printing means, drives said common cutting means to cut another medium on which another information is printed by said common printing means before said common transport means ejects one of said medium from said common ejection opening, and said control means drives said transport means to transport cut one and another pieces of medium to said common ejection opening to be ejected together.

5. A medium issuing apparatus according to claim 1, wherein said medium is a paper roll.

6. An automated teller machine including a medium issuing apparatus for issuing first and second media on which a transaction information and a supplementary information are printed respectively, which is operated by a customer and performs transactions, comprising:

a plurality of medium holding means each of which holds a medium respectively;

a plurality of medium drive means each of which performs feedout or return drive of said medium respectively;

common printing means which performs printing onto said medium which is fed out by said medium drive means from each of said medium holding means;

common cutting means which cuts medium fed out from each of said medium holding means to a prescribed length;

common transport means which transports pieces of medium cut from each of medium by said common cutting means;

particulars of transaction data generating means which generates data related to the particulars of a transaction executed in response to a customer operation;

supplementary information data generating means which generates supplementary information other than the particulars of a transaction;

instructing means which issues an instruction to said common printing means to print;

control means, whereby when said instruction means instructs the printing of the particulars of a transaction, the medium is fed out by said medium drive means, the common printing means is caused to print the data of the particulars of transaction of the particulars of transaction data generating means, and whereby when the printing of supplementary information is specified by said instructing means, said medium drive means feeds out medium, and said common printing means is caused to print the data of the supplementary information data generating means; and a common ejection opening which ejects said cut pieces of medium which are transported by said common transport means, wherein said first information is information relating to only a present transaction and has a fixed form, and said second information is information relating to all purposes other than that of said first information and includes various types of data having no fixed form.

7. An automated teller machine according to claim 6, wherein said medium has a plurality of formats.

8. An automated teller machine according to claim 6, further comprising:

a display section which asks the customer to select a desired type of transaction from types of transactions; and a customer operating section from which the customer selects a desired transaction.

9. An automated teller machine according to claim 6, further comprising:

a display section which asks the customer, either during execution of a transaction or after the execution of a transaction, whether the issuing of supplementary information is required; and a customer operating section from which the customer selects whether or not issuing of supplementary information is required.

10. An automated teller machine according to claim 6, wherein said control means drives said common cutting means to cut one of said medium on which one of said information is printed by said common printing means, drives said common cutting means to cut another medium on which another information is printed by said common printing means before said common transport means ejects one of said medium from said common ejection opening, and said control means drives said transport means to transport one and another pieces of medium to said common ejection opening to be ejected together.

11. An automated teller machine according to claim 6, wherein the direction of printing of the particulars of a transaction printed by said common printing means differs from the direction of printing of the supplementary information.

12. An automated teller machine according to claim 6, wherein said medium is a paper roll.

13. An automated teller machine according to claim 12, wherein said paper roll is comprised of continuous preprinted payment instruments, each having a blank area, required supplementary information is printed in the blank area of the payment instrument in response to a selection made by the customer, and a single payment instrument is ejected.

14. An automated teller machine according to claim 13, wherein said control means drives said common printing means to print said first information onto said first medium based on the transportation of said first medium to said printing means, and drives said common printing means to print said second information onto said second medium based on the transportation of said second medium to said printing means.

15. An automated teller machine according to claim 13, wherein said control means drives said common cutting means to cut one of said medium on which one of said information is printed by said common printing means, and drives said cut piece of medium to be ejected from a common ejection opening via said common transport means, after which said control means drives said medium drive means to return the end of the medium to the side of said medium holding means via said common printing means, and further said control means drives said drive means to feedout another medium, drives said common printing means to print another information, drives said common cutting means to cut another medium, and after which said control means drives said common transport means to eject another piece of medium to a common ejection opening.

16. An automated teller machine according to claim 13, wherein said common printing means is caused to print the particulars of a transaction performed by the customer onto paper from one paper roll, and further wherein said common printing means is caused to print supplementary information other than the particulars of a transaction onto paper from another paper roll.

17. An automated teller machine according to claim 16, wherein said control means drives said display section to display information on its screen which asks the customer whether issuing of supplementary information is required during or after the execution of a transaction selected by a customer, drives said common printing means to print the particulars of a transaction onto one of said paper roll, drives said common cutting means to cut the printed part of one of said paper roll, and, in the case in which the customer has not selected issuing of supplementary information from the customer operating section, said control means drives said transport means to transport cut printed piece of paper so as to eject it from said common ejection opening, in the case in which the customer has selected issuing of supplementary information from the customer operating section, said control means drives said paper roll drive means to feed out another paper roll to said common printing means to print supplementary information thereon before said transport means eject said one of piece of paper from said common ejection opening, drives said common cutting means to cut another paper roll on which supplementary information is printed, and said control means drives said transport means to transport cut one and another pieces of medium to said common ejection opening to be ejected together.

18. An automated teller machine according to claim 13, wherein said paper roll holding means holds paper rolls having the same width.

19. A medium issuing apparatus operated by an operator for issuing a first medium and a second medium on which first and second information are printed respectively, comprising:

a plurality of medium holding units each of which holds a medium respectively;

a plurality of medium drive units each of which performs feedout or return drive of said medium respectively;

a common printing unit which performs printing onto said medium which is fed out by said medium drive units from each of said medium holding units;

a common transport unit which transports pieces of said medium cut from each of media by a common cutting unit; and a common ejection opening to eject cut pieces of medium which are transported by said common transport unit, wherein said first information is information relating to only a present transaction and has a fixed form, and said second information is information relating to all purposes other than that of said first information and includes various types of data having no fixed form.

20. A medium issuing apparatus operated by an operator for issuing a first medium and a second medium on which first and second information are printed respectively, consisting of:

a plurality of medium holding means each of which holds a medium respectively;

a plurality of medium drive means each of which performs feedout or return drive of said medium respectively;

common printing means which performs printing onto said medium which is fed out by said medium drive means from each of said medium holding means;

common cutting means which cuts said medium fed out from each of said medium holding means to a prescribed length;

common transport means which transports pieces of said medium cut from each of media by said common cutting means;

control means for controlling each of said means mutually; and a common ejection opening which ejects said cut pieces of medium which are transported by said common transport means.

21. A medium issuing apparatus operated by an operator for issuing a first medium and a second medium on which first and second information are printed respectively, consisting of:

a plurality of medium holding units each of which holds a medium respectively;

a plurality of medium drive units each of which performs feedout or return drive of said medium respectively;

a common printing unit which performs printing onto said medium which is fed out by said medium drive units from each of said medium holding units;

a common transport unit which transports pieces of said medium cut from each of media by a common cutting unit; and a common ejection opening to eject cut pieces of medium which are transported by said common transport unit.

* * * * *